US011255623B2

(12) United States Patent
Kras et al.

(10) Patent No.: US 11,255,623 B2
(45) Date of Patent: Feb. 22, 2022

(54) SUPPRESSOR WITH REDUCED GAS BACK FLOW AND INTEGRAL FLASH HIDER

(71) Applicant: Sig Sauer, Inc., Newington, NH (US)

(72) Inventors: Krzysztof J. Kras, Fremont, NH (US); Evan Miller, Exeter, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 16/861,684

(22) Filed: Apr. 29, 2020

(65) Prior Publication Data

US 2021/0041200 A1 Feb. 11, 2021

Related U.S. Application Data

(60) Provisional application No. 62/952,737, filed on Dec. 23, 2019, provisional application No. 62/840,659, filed on Apr. 30, 2019.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/00; F41A 21/28; F41A 21/34; F41A 21/36
USPC ..... 89/14.4
See application file for complete search history.

(56) References Cited

U.S. PATENT DOCUMENTS

| | | | |
|---|---|---|---|
| 1,000,702 | A | 8/1911 | Thurler |
| 1,341,363 | A | 5/1920 | Fiala |
| 1,427,802 | A | 9/1922 | Goodwin |
| 1,462,158 | A | 7/1923 | Wildner |
| 1,736,319 | A | 11/1929 | Maxim |
| 1,773,443 | A | 8/1930 | Wilman |

(Continued)

FOREIGN PATENT DOCUMENTS

| | | |
|---|---|---|
| EP | 1764577 | 3/2007 |
| GB | 743111 | 1/1956 |

(Continued)

OTHER PUBLICATIONS

Volk, Oleg, "Thermal Defense Solutions: 3D-Printed Inconel Sound Suppresors" AllOutdoor.com, https://www.alloutdoor.com/2018/04/03/thermal-defense-solutions-3d-printed-steel-sound-suppressors/ (Apr. 3, 2018).

(Continued)

*Primary Examiner* — John Cooper
(74) *Attorney, Agent, or Firm* — Finch & Maloney PLLC

(57) ABSTRACT

A suppressor for a firearm includes a baffle stack having an outer surface, the baffle stack comprising a plurality of baffles that define an inner chamber coaxially aligned with a central axis of the baffle stack and a projectile pathway through the baffle stack along the central axis. An outer housing is around the baffle stack and has an inner surface separated from and confronting the outer surface of the baffle stack. An outer chamber is defined between the inner surface of the outer housing and the outer surface of the baffle stack. Flow-directing structures are in the outer chamber. An end cap is connected to a distal end of the outer housing and defines a central opening aligned with the central axis.

24 Claims, 24 Drawing Sheets

(56) References Cited

U.S. PATENT DOCUMENTS 2,101,849 A 12/1937 Green
2,150,161 A 3/1939 Green
2,165,457 A 7/1939 Cutts, Jr.
2,351,037 A 6/1944 Green
2,468,926 A 12/1944 Garrett
2,514,996 A * 7/1950 Faust, Jr. ..... F41A 21/30 181/223
3,368,453 A 2/1968 Shaw
3,385,164 A 5/1968 Walther et al.
3,667,570 A 6/1972 WerBell, III
3,693,750 A 9/1972 Takkunen
3,786,895 A 1/1974 Perrine
4,291,610 A * 9/1981 Waiser ..... F41A 21/30 89/14.4
4,454,798 A 6/1984 Shea et al.
4,482,027 A 11/1984 Gould
4,501,189 A 2/1985 Brandl et al.
4,510,843 A 4/1985 Rabatin
4,530,417 A 6/1985 Daniel
4,576,083 A 3/1986 Seberger, Jr.
4,583,445 A 4/1986 Blair
4,588,043 A 5/1986 Finn
4,907,488 A 3/1990 Seberger
4,930,396 A * 6/1990 Johnson ..... F41A 21/36 89/14.3
4,946,105 A 8/1990 Pan, Jr. et al.
4,974,489 A 12/1990 Fishbaugh
5,010,676 A 4/1991 Kennedy
5,029,512 A * 7/1991 Latka ..... F41A 21/30 89/14.4
5,036,747 A 8/1991 McClain, III
5,078,043 A 1/1992 Stephens
5,092,223 A 3/1992 Hudson
5,136,924 A 8/1992 Foerster et al.
5,164,535 A 11/1992 Leasure
5,425,299 A 6/1995 Teetzel
5,433,133 A 7/1995 LaFrance
5,486,425 A 1/1996 Seibert
5,590,484 A 1/1997 Mooney et al.
5,656,166 A 8/1997 Linnersten et al.
5,661,255 A 8/1997 Webb, III
5,679,916 A 10/1997 Weichert
5,698,810 A 12/1997 Rose
5,777,258 A 7/1998 Soon
5,952,625 A 9/1999 Huff
6,079,311 A 6/2000 O'Quinn et al.
6,298,764 B1 10/2001 Sherman et al.
6,302,009 B1 10/2001 O'Quinn et al.
6,308,609 B1 10/2001 Davies
6,374,718 B1 4/2002 Rescigno et al.
6,376,565 B1 4/2002 Dyer et al.
6,425,310 B1 7/2002 Champion
6,490,822 B1 12/2002 Swan
6,499,245 B1 12/2002 Swan
6,575,074 B1 * 6/2003 Gaddini ..... F41A 21/30 89/14.4
6,732,628 B1 5/2004 Coburn et al.
6,792,711 B2 9/2004 Battaglia
6,796,214 B2 9/2004 Hausken et al.
6,959,509 B2 11/2005 Vais
7,308,967 B1 12/2007 Hoel
7,587,969 B2 9/2009 Silvers
7,610,710 B2 11/2009 Brittingham
7,661,349 B1 2/2010 Brittingham
7,676,976 B2 3/2010 Dueck et al.
7,707,762 B1 5/2010 Swan
7,789,008 B2 9/2010 Petersen
7,823,314 B1 11/2010 Wheatley
7,832,323 B1 * 11/2010 Davies ..... F41A 21/325 89/14.4
7,836,809 B2 11/2010 Noveske
7,870,815 B2 1/2011 Hung
7,905,319 B2 3/2011 Sullivan
7,987,944 B1 8/2011 Brittingham et al.
8,167,084 B1 5/2012 Moore
8,196,701 B1 6/2012 Oliver
8,286,750 B1 10/2012 Oliver
8,307,946 B1 11/2012 Johnston
8,490,535 B1 7/2013 Moore et al.
8,516,941 B1 8/2013 Oliver
8,522,662 B2 9/2013 Presz, Jr. et al.
8,579,075 B2 11/2013 Brittingham et al.
8,671,818 B1 3/2014 Oliver
8,790,434 B1 7/2014 Oliver
8,826,793 B2 9/2014 Oliver
8,844,422 B1 * 9/2014 Klett ..... F41A 21/30 89/14.2
8,875,612 B1 * 11/2014 Klett ..... C22C 19/03 89/14.4
8,973,481 B2 3/2015 Dueck et al.
9,052,152 B2 6/2015 Moss et al.
9,163,891 B1 * 10/2015 Dater ..... F41A 21/34
9,175,920 B2 11/2015 Moore
9,194,640 B2 11/2015 Wirth et al.
9,207,033 B2 12/2015 Vais
9,239,201 B1 * 1/2016 Reis Green ..... F41A 21/30
9,316,456 B1 4/2016 Oliver
9,347,727 B1 * 5/2016 Cler ..... F41A 21/30
9,410,761 B2 * 8/2016 Morris ..... F41A 21/30
9,423,198 B1 8/2016 Oliver
9,435,600 B2 9/2016 Oliver
9,482,484 B2 11/2016 Barney
9,500,427 B1 * 11/2016 Larue ..... F41A 21/30
9,709,354 B2 * 7/2017 Larue ..... F41A 21/325
9,835,399 B1 * 12/2017 Lessard ..... F41A 21/34
10,024,617 B1 7/2018 Moore et al.
10,030,929 B1 7/2018 Lessard
10,126,084 B1 * 11/2018 Oglesby ..... F41A 21/30
10,228,210 B2 * 3/2019 Parker ..... F41A 21/30
10,234,231 B2 * 3/2019 Gianelloni, III ..... F41A 21/34
10,254,068 B2 4/2019 Piemme et al.
10,371,476 B1 8/2019 Oglesby
10,393,463 B1 * 8/2019 Sanders ..... F41A 21/325
10,415,917 B2 9/2019 White
10,458,739 B2 10/2019 Smith
10,480,883 B2 11/2019 Smith
10,480,888 B2 11/2019 Barrett
10,502,513 B2 * 12/2019 Ellison ..... F41A 21/30
10,533,819 B2 * 1/2020 Thomas ..... F41A 21/30
10,634,445 B1 * 4/2020 Klett ..... F41A 21/34
10,648,756 B2 5/2020 Mooty
10,655,926 B2 5/2020 Young et al.
10,690,432 B2 * 6/2020 Campbell ..... F41A 21/28
10,746,491 B2 * 8/2020 Garst ..... F41A 21/30
10,753,699 B2 * 8/2020 Klett ..... F41A 21/30
10,890,403 B2 * 1/2021 Petersen ..... F41A 21/30
10,890,404 B2 * 1/2021 Petersen ..... F41A 21/30
2007/0107590 A1 * 5/2007 Silvers ..... F41A 21/30 89/14.4
2007/0107982 A1 5/2007 Sullivan
2007/0256347 A1 11/2007 Fitzpatrick et al.
2009/0200105 A1 8/2009 Geyer, III
2009/0235568 A1 9/2009 Auvine
2010/0048752 A1 2/2010 Vignola et al.
2010/0163336 A1 7/2010 Presz, Jr. et al.
2010/0199834 A1 8/2010 Dueck et al.
2011/0067950 A1 3/2011 Shults et al.
2012/0272818 A1 * 11/2012 Dueck ..... F41A 21/325 89/14.4
2014/0035076 A1 2/2014 Zhang et al.
2014/0262605 A1 9/2014 Washburn, III et al.
2014/0353076 A1 * 12/2014 Bethlenfalvy ..... F41A 21/30 181/223
2014/0360807 A1 12/2014 McKenzie
2015/0136519 A1 5/2015 Moore
2015/0253099 A1 * 9/2015 Shults ..... F41A 21/34 181/223
2015/0260472 A1 9/2015 Smith
2016/0084602 A1 3/2016 Smith
2016/0109205 A1 4/2016 Coppinger et al.
2016/0238335 A1 8/2016 Bertschinger et al.
2017/0160034 A1 * 6/2017 Parker ..... F41A 21/30
2017/0205175 A1 * 7/2017 Garst ..... F41A 21/30

(56) References Cited

U.S. PATENT DOCUMENTS

| | | | | |
|---|---|---|---|---|
| 2017/0299314 | A1* | 10/2017 | Palu | F41A 21/30 |
| 2017/0321984 | A1* | 11/2017 | Palu | F41A 21/34 |
| 2018/0135932 | A1* | 5/2018 | Tomczak | F41A 21/30 |
| 2018/0313626 | A1 | 11/2018 | Tomczak | |
| 2018/0313627 | A1* | 11/2018 | Tomczak | F41A 21/30 |
| 2018/0340750 | A1* | 11/2018 | Mooty | F41A 21/30 |
| 2019/0257607 | A1* | 8/2019 | Dobrinescu | F41A 21/30 |
| 2020/0064099 | A1* | 2/2020 | Young | F41A 21/28 |
| 2020/0096279 | A1 | 3/2020 | Hibbitts et al. | |
| 2020/0116450 | A1 | 4/2020 | Ellison et al. | |
| 2020/0224989 | A1 | 7/2020 | Bundy et al. | |
| 2020/0240737 | A1 | 7/2020 | Wheeler et al. | |
| 2020/0263947 | A1 | 8/2020 | Calerwood et al. | |
| 2021/0071979 | A1 | 3/2021 | Plunkett, Jr. et al. | |

FOREIGN PATENT DOCUMENTS

| | | | |
|---|---|---|---|
| GB | 2287780 | A | 9/1995 |
| GB | 2288007 | A | 10/1995 |
| WO | 9902826 | A1 | 1/1999 |
| WO | 2015016998 | | 2/2015 |
| WO | 2020081268 | A2 | 4/2020 |

OTHER PUBLICATIONS

RAD 22 Suppressor, OSSSuppressors.com, https://osssuppressors.com/suppressors/rimfire/ (last visited Apr. 29, 2019).

M16A1 Birdcage Flash Hider, RetroRifles.com, https://retrorifles.com/m16a1-birdcage-flash-hider-4-options/ (last visited Dec. 17, 2019).

Operators Suppressor Systems Info Sheet 2015, 1 page.

Office Action in U.S. Appl. No. 15/089,165 dated Oct. 20, 2016, 9 pages.

Office Action in U.S. Appl. No. 15/089,165 dated Feb. 16, 2017, 7 pages.

Office Action in U.S. Appl. No. 15/089,165 dated Jul. 13, 2017, 15 pages.

Notice of Allowance in U.S. Appl. No. 15/089,165 dated Aug. 4, 2017, 19 pages.

Office Action in U.S. Appl. No. 15/447,304 dated Nov. 17, 2017, 29 pages.

* cited by examiner

SUPPRESSOR WITH REDUCED GAS BACK FLOW AND INTEGRAL FLASH HIDER

RELATED APPLICATIONS

This application claims priority under 35 U.S.C. § 119(e) to U.S. Provisional Patent Application No. 62/840,659, titled SUPPRESSOR WITH INTEGRAL FLASH HIDER AND REDUCED GAS BACK FLOW and filed on Apr. 30, 2019; and to U.S. Provisional Patent Application No. 62/952,737, titled INTEGRATED FLASH HIDER FOR SMALL ARMS SUPPRESSORS and filed on Dec. 23, 2019; the contents of these applications are incorporated herein by reference in their entireties.

FIELD OF THE DISCLOSURE

This disclosure relates to muzzle accessories for use with firearms and more particularly to a suppressor configured for use with semi-automatic and automatic firearms.

BACKGROUND

Firearm design involves many non-trivial challenges. In particular, firearms, such as rifles and machine guns, have faced particular complications with reducing the audible and visible signature produced upon firing a round, while also maintaining the desired ballistic performance. Some accessories are designed to be mounted to the muzzle-end of a firearm barrel to control the flow of propellant gases leaving the barrel. For example, a muzzle brake is typically mounted to the barrel and redirects propellant gases to the side or rearward to assist the user in controlling recoil forces. Suppressors are a muzzle accessory that reduces the audible report of the firearm by slowing the expansion and release of pressurized gases from the barrel. A flash hider is yet another accessory that can be attached to the muzzle. A flash hider controls the expansion of gases leaving the barrel for the purpose of reducing visible flash.

Figure 1A:
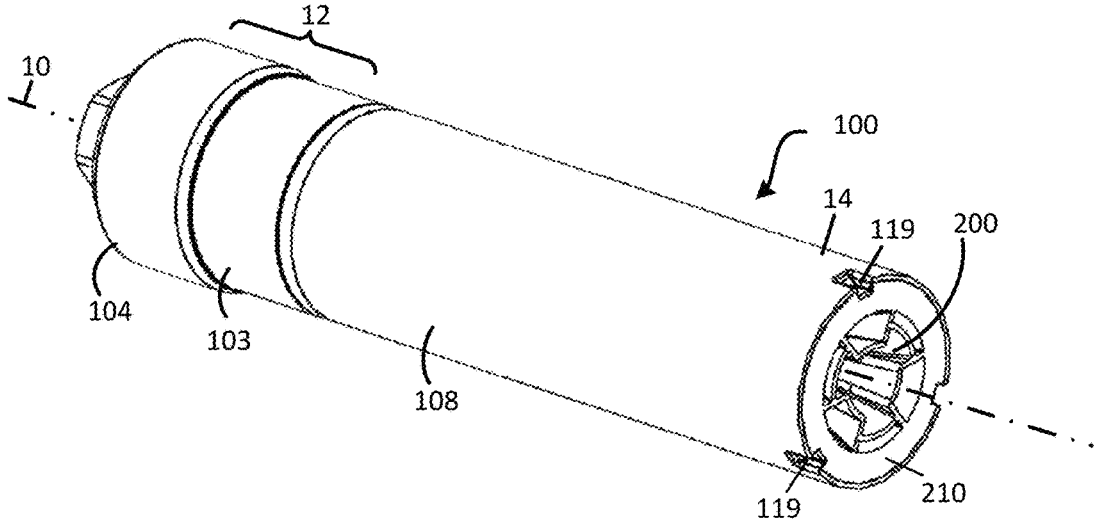
FIG. 1A illustrates a front perspective view of a suppressor with an integral flash hider, in accordance with one embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed herein is a suppressor assembly having reduced gas back flow, in accordance with some embodiments. The disclosed suppressor is configured to be attached directly or indirectly to the distal end of a firearm barrel. In some examples, a suppressor of the present disclosure improves suppression of the audible signature and/or visible signature of a firearm by providing an inner chamber that includes the path of the projectile, and an outer chamber that is concentric with and radially outside of the inner chamber, where gases in the outer chamber vent independently or semi-independently of gases flowing through the inner chamber. As gases enter the suppressor, a first portion of the gases is directed to the outer chamber by the cone of the first baffle, a diffusor cone in the blast chamber, or both. A second portion of gases flow through the inner chamber along the central axis and along a variety of off-axis or cross-axis flow paths. In accordance with some embodiments, the inner and outer chambers divide the gases into two volumes that can, in some embodiments, better expand to fill the entire suppressor volume and reduce localized areas of high pressure in the suppressor. Compared to traditional baffle suppressors, the suppressors of the present disclosure can reduce localized volumes of high-pressure gas and the resulting flow of combustion gases backward through the barrel and into the rifle's receiver after firing.

The inner chamber includes a plurality of baffles that promote gas expansions and a tortuous path for gases, which induces turbulence and energy dissipation within the inner chamber. Baffles are arranged to define an outer chamber that is largely isolated from the inner chamber. For example, a cylindrical body of each baffle connects to the body of adjacent baffles to define an inner wall separating the inner chamber from the outer chamber. The outer chamber defines an alternate flow path for a portion of the gases to flow through the suppressor. The outer chamber communicates with the inner chamber via openings through the wall at various locations along the length of the suppressor, promoting gas mixing between the inner and outer chambers and augmenting the degree to which gases in the inner volume assume a sinuous flow path.

In accordance with one embodiment of the present disclosure, a suppressor baffle has a cylindrical baffle body connected at its proximal end to a radially expanding baffle wall (e.g., a conical wall) that tapers rearward from the baffle body to a central opening. The cylindrical body includes vanes on the outside surface, where each vane extends transversely to the central axis. The vanes are arranged in alternating directions so as to form an open zig-zag pattern around the outside of the cylindrical body. Openings in the body can be positioned between converging or diverging vanes, which provide areas of localized high and low pressure, to provide gas flow into or out of the body, respectively. The expanding baffle wall can include a gutter that extends rearward from and circles around part of the central opening. For example, the gutter is similar to half of a tube merged with a frustocone. When combined with the expanding baffle wall, the gutter defines an elongated and larger central opening when approached in a direction generally along the surface of the expanding baffle wall, yet the central opening retains a circular shape when viewed along the central axis. Accordingly, gases tend to enter the baffle through the enlarged area of the central opening in a direction that promotes off-axis flow. Openings in the baffle body can be positioned so that gases entering the baffle body through openings amplify the flow's deviation from the central axis. Adjacent baffles are arranged so that the gutter of one baffle is rotated 180° from the gutter of an adjacent baffle. As a result, gases flowing through the inner chamber take a sinuous flow path through the inner chamber. In some embodiments, adjacent baffles can be rotated more or less than 180° (e.g., ~190-235°) with respect to each other to promote a helical flow path through the inner chamber.

In accordance with some embodiments, the distal end portion of the suppressor includes an integral flash hider to reduce visible flash. In one example embodiment, the flash hider has a first or inner flash hider portion defining a central expanding gas passageway and a second or outer flash hider portion coaxially arranged with the inner flash hider portion. For example, the outer flash hider portion can be an expanding frustoconical annulus outside of the inner flash hider portion, which also may have a frustoconical geometry. In other words, the outer flash hider portion is an expanding volume situated between a wall defining the inner flash hider portion and an outer wall arranged concentrically with the inner flash hider portion. In some embodiments, the outer flash hider portion can include a single annular volume that vents gases from the outer chamber of the suppressor. In other embodiments, the outer flash hider portion includes a plurality of expanding gas passageways distributed circumferentially around the outside of the central volume of the inner flash hider portion. The dual flash hider can be integral to the suppressor, such as being welded to, formed as a single monolithic part with, or otherwise attached to the end of a cylindrical outer wall and/or to baffles of the suppressor assembly.

In another example, a flash hider has a body with an outer wall that extends along a central axis from a proximal end to a distal end. For example, the outer wall has a frustoconical shape. The proximal end defines a central opening to a central volume that expands along the central axis to the distal end. Outer volumes are located radially outside of the central volume and are distributed circumferentially about the central volume. In one example, the outer volumes have a circumferentially spaced-apart arrangement, such as when the outer volumes are defined between flow partitions extending inward from the outer wall of the flash hider body. For example, each flow partition generally has a U-shape with straight sides and an arcuate inner surface. The negative space between adjacent flow partitions defines an outer volume or gas expansion region that directs exiting propellent gas away from central axis. In some embodiments, the outer volumes are continuous with the central or inner volume and function as expansion chambers for propellant gases entering the flash hider through the central opening. In other embodiments, the outer volumes are isolated from the central volume and receive propellant gasses through vent openings in the outer wall.

In another embodiment, the flash hider has a first flash hider portion and a second flash hider portion. The first flash hider portion includes an inner volume and a plurality of outer volumes. The second flash hider portion includes gas passageways interspersed circumferentially with the outer volumes of the first flash hider portion, where the gas passageways are isolated from the central and outer volumes and communicate via vent openings to an outside of the flash hider body. For example, the flow partitions are hollow and define gas passageways that are isolated from the central and outer volumes by the wall defining each gas passageway.

In some embodiments, the flash hider can include forward venting ports to vent off-axis gas flows and reduce the pressure of flow through the central volume. In one example, a portion of gases enter through the central opening to flow through the inner and outer volumes of the first flash hider portion. A second portion of gases, such as off-axis gas flows in the suppressor's inner chamber or gases in an outer chamber, can enter the passageways of the second flash hider portion via the vent openings, where the second flash hider portion provides an additional flow path for propellant gases to exit the suppressor. In another example, the flash hider defines openings through a flange extending radially outward from the distal end of the suppressor body. Providing multiple exit pathways for propellant gases can reduce the build-up of pressure in the suppressor and therefore reduce the amount of propellant gases flowing backward to the firearm receiver.

General Overview

As noted above, non-trivial issues may arise that complicate weapons design and performance of firearms. For instance, one non-trivial issue pertains to the fact that the discharge of a firearm normally produces an audible report resulting from rapidly expanding propellant gases and from the projectile leaving the muzzle at a velocity greater than the speed of sound with respect to ambient conditions. It is generally understood that attenuating the audible report may be accomplished by slowing the rate of expansion of the propellant gases. Slowing down gas expansion and delaying venting from the suppressor can be accomplished by forcing the gas to take a longer flow path through the suppressor, such as around baffles and other obstacles.

Reducing the visible signature or flash also can be accomplished by controlling the expansion of gases exiting the muzzle. Muzzle flash may include two main components. A red glow is visible where gas flow transitions from supersonic to subsonic flow, sometimes referred to as a Mach disk or flow diamond. A brighter or white flash is visible when oxygen from the ambient air ignites and burns with the propellant gases. Flash can be reduced by reducing the amount of ambient air that mixes with gases exiting the muzzle (e.g., by reducing turbulence), restricting the gas expansion, or both. More specifically, it has been found that the size of the Mach disk and the position of the Mach disk relative to the muzzle can be controlled with certain features of the flash hider. Reducing flash is a function of temperature, pressure, barrel length, the type of ammunition being fired, among other factors. Reducing one component of muzzle flash may enhance another component of flash, as will be appreciated.

Suppressors can have additional challenges associated with reducing visible flash and attenuating sound. For example, slowing down the expansion and release of combustion from the muzzle when a shot is fired, some suppressor designs result in a containment, trapping and delayed release of pressurized gas from the suppressor, which results in a localized volume of high-pressure gas. As a natural consequence, the pressurized gases within the suppressor take the path of least resistance to regions of lower pressure. Such condition is generally not problematic in the case of a bolt-action rifle because the operator opens the bolt to eject the spent casing in a time frame that is much greater than the time required for the gases in the suppressor to disperse through the distal (forward) end of the suppressor. However, in the case of a semi-automatic rifle, automatic rifle, or a machine gun, the bolt opens very quickly after firing (e.g., within 1-10 milliseconds) to reload the firearm for the next shot. In this short time, pressurized gases remain in the suppressor and some of the gases follow the path through the barrel and out through the chamber and ejection port towards the operator's face rather than following the tortuous path through the suppressor. To avoid introducing particulates and combustion residue to the chamber, and to avoid combustion gases being directed towards the operator's face, it would be desirable to reduce the pressure build up within the suppressor to reduce or eliminate back flow into the firearm's receiver. Additionally, it is desirable to reduce back flow of gases into the receiver while at the same time retaining effective sound suppression and effective flash suppression.

Thus, reducing the visible signature while also reducing the audible signature of a firearm presents non-trivial challenges. To address these challenges and others, and in accordance with some embodiments, the present disclosure includes a suppressor having reduced gas back flow, baffles for use in a suppressor assembly, and various flash hiders configured for a suppressor for small arms. In some embodiments, the flash hider is an integral part of the suppressor. For example, the flash hider can be made as a single piece with a suppressor body, or the flash hider can be welded or otherwise permanently fixed to the distal end of a suppressor. In other embodiments, the flash hider can be a removable part of the suppressor assembly, such as having a threaded interface with the suppressor body.

In one example, the suppressor includes an outer chamber positioned coaxially around an inner chamber. The suppressor is configured to direct a portion of the combustion gases through the inner chamber and, in tandem, direct another portion of the combustion gasses through the outer chamber. A blast chamber in the proximal end portion of the suppressor has an optional diffusor and a blast baffle responsible for dividing the flow of the combustion gas into two separate volumes. In some embodiments, the outer chamber structure is designed and constructed to allow the gas to flow faster than through the inner chamber (central path) and the inner chamber structure is designed to slow down the central blast and contain it, so it cannot readily and directly exhaust out of the suppressor, which would result in increased sound and flash signatures. In some embodiments, gases flowing through the inner chamber vent through a central opening in a distal end plate and gases flowing through the outer chamber vent through radially-outer openings in the distal end plate.

In some embodiments, the distal end portion of the suppressor can include a flash hider. In one example, the flash hider includes a first flash hider portion that controls gas expansion along an inner volume of the flash hider as well as providing outer gas expansion chambers radially outside of the inner volume. The outer volumes of the first flash hider portion are continuous with the generally conical inner volume. The flash hider can also include a second flash hider portion that includes gas pathways located outside of the inner volume of the first flash hider portion. In one such embodiment, gases flowing along the suppressor central axis enter the proximal end of the flash hider through a central opening and exit through passageways of the first flash hider portion. In some embodiments, off-axis gas flows and/or gases flowing through a radially outer chamber in the suppressor exit the suppressor via the second flash hider portion. A portion of the propellant gases flows through vent openings in an outer wall of the flash hider and then exits through radially outer volumes of the second flash hider portion. In another embodiment, propellant gases in a radially outer chamber of the suppressor vent forward through openings in a distal face of the flash hider. Such openings can be part of a third flash hider portion having flow paths that are distinct from those of the first and second flash hider portions.

In one embodiment, the first flash hider portion includes outer volumes that are interspersed circumferentially with volumes of the second flash hider portion. The flash hider can be configured to direct a portion of the combustion gases through the first flash hider portion and, in tandem, direct other portions of the combustion gasses through the second flash hider portion. In one example, the first flash hider portion has an expanding (e.g., frustoconical) inner volume that extends along a central axis of the suppressor. A second flash hider portion includes a plurality of outer gas passageways defined by U-shaped partitions connected to the inside of the flash hider body and extending inward. The gas passageways of the second flash hider portion can be distributed in a circumferentially spaced arrangement around the outside of the inner volume, where the radially inner faces of the partitions circumscribe the frustoconical inner volume. The first flash hider portion can also include outer volumes between adjacent partitions such that the outer volumes and the gas passageways of the second flash hider portion are interspersed around the outside of the inner volume. Some such embodiments approximate the combination of a three-prong flash hider within a frustoconical flash hider body.

In one example, the second flash hider portion includes three outer passageways of the same size (e.g., spanning ~70-80°) that are evenly spaced circumferentially. Each outer passageway communicates with the suppressor volume via a single rear vent opening and one or more smaller forward vent openings.

In yet other embodiments, the second flash hider portion includes secondary outer passageways radially outward of each outer volume of the first flash hider portion. For example, circumferential wall segments between adjacent partitions separate the secondary outer passageways from the outer volumes of the first flash hider portion such that each outer volume of the first flash hider portion shares the space between adjacent partitions with a secondary outer volume of the second flash hider portion. Still further, the flash hider can have a third flash hider portion with gas pathways isolated from those of the first and second flash hider portions. In one example embodiment, a distal face of the flash hider defines through openings that vent gases traveling along an off-axis flow path.

In one such embodiment, gases flowing along the suppressor central axis enter the proximal end of the flash hider through a central opening and exit through passageways of the first flash hider portion. In some embodiments, off-axis gas flows and/or gases flowing through a radially outer chamber in the suppressor exit the suppressor via the second flash hider portion. In one such embodiment, a portion of the propellant gases flow through vent openings in an outer wall of the flash hider and on through radially outer volumes of the second flash hider portion. In another embodiment, propellant gases in a radially outer chamber of the suppressor vent forward through openings in a distal face of the flash hider. Such openings can be part of a third flash hider portion having flow paths that are distinct from those of the first and second flash hider portions. Numerous variations and embodiments will be apparent in light of the present disclosure.

A suppressor including a flash hider in accordance with the present disclosure can reduce flash in the visible and infrared wavelengths emitted from the distal end of the suppressor. Also, being integrated into the suppressor, the suppressor housing protects the relatively thin walls of the flash hider from damage and eliminates the open prongs found in other flash hiders that are prone to snag on vegetation or the like. Another advantage is to provide a variety of pathways for propellant gases to exit the distal end of the suppressor, which can reduce both flash and pressure build up, in accordance with some embodiments.

A flash hider or a suppressor including the flash hider can be manufactured by molding, casting, machining, 3-D printing, or other suitable techniques. For example, additive manufacturing—also referred to as 3-D printing—can facilitate manufacture of complex geometries that would be difficult or impossible to make using conventional machining techniques. One additive manufacturing method is direct metal laser sintering (DMLS).

As will be appreciated in light of this disclosure, and in accordance with some embodiments, a suppressor assembly configured as described herein can be utilized with any of a wide range of firearms, such as, but not limited to, machine guns, semi-automatic rifles, short-barreled rifles, submachine guns, and long-range rifles. In accordance with some example embodiments, a suppressor configured as described herein can be utilized with firearms chambered for ammunition sized from 0.17 HMR rounds to 30 mm autocannon rounds. In some example cases, the disclosed suppressor is configured to be utilized with a rifle chambered, for example, for 5.56×45 mm NATO rounds, 7.62×51 mm rounds, 7.62×39 mm rounds, 6.5 mm Creedmoor rounds, 6.8×51 mm rounds, .338 Norma Magnum rounds, or .50 BMG rounds, to name a few examples. Examples of some host firearms include the SIG SLMAG, SIG MCX™, SIG516™, SIG556™, SIGM400™, or SIG716™ rifles produced by Sig Sauer, Inc, and the Barrett M82/M107. Other suitable host firearms and projectile calibers will be apparent in light of this disclosure.

It should be noted that, while generally referred to herein as a flash hider for consistency and ease of understanding the present disclosure, the disclosed flash hider is not limited to that specific terminology and alternatively can be referred to, for example, as a flash suppressor, a flash guard, a suppressor end cap, or other terms. As will be further appreciated, the particular configuration (e.g., materials, dimensions, etc.) of a flash hider or suppressor configured as described herein may be varied, for example, depending on whether the target application or end-use is military, tactical, or civilian in nature. Numerous configurations will be apparent in light of this disclosure.

Example Suppressor Configurations

Figure 1B:
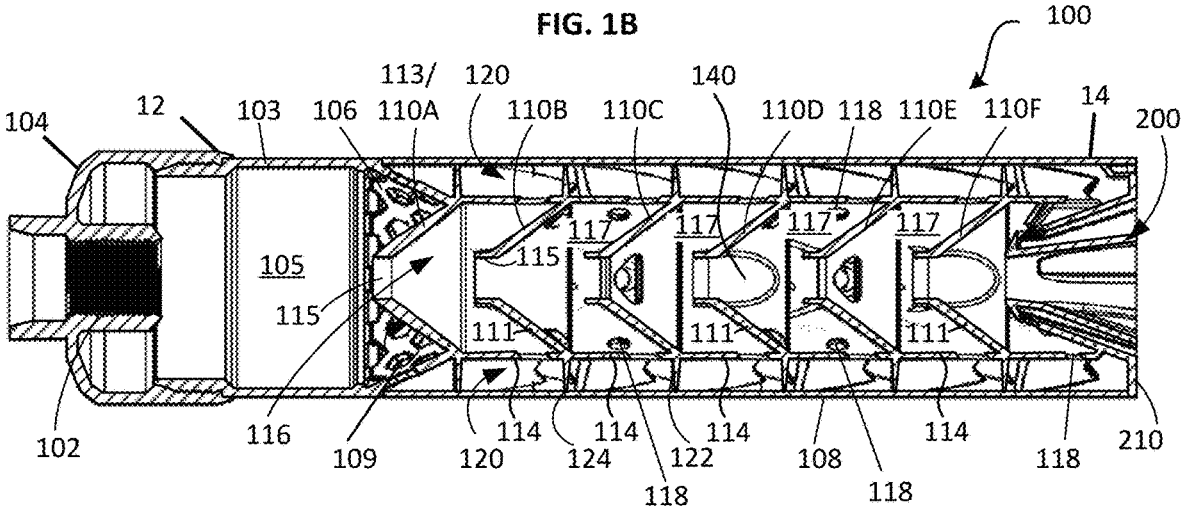
FIG. 1B illustrates a side cross-sectional view of a suppressor that includes an inner chamber and an outer chamber, the suppressor including gas directing vanes disposed within the outer chamber and including a flash hider in the distal end portion, in accordance with one embodiment of the present disclosure.
Figure 1C:
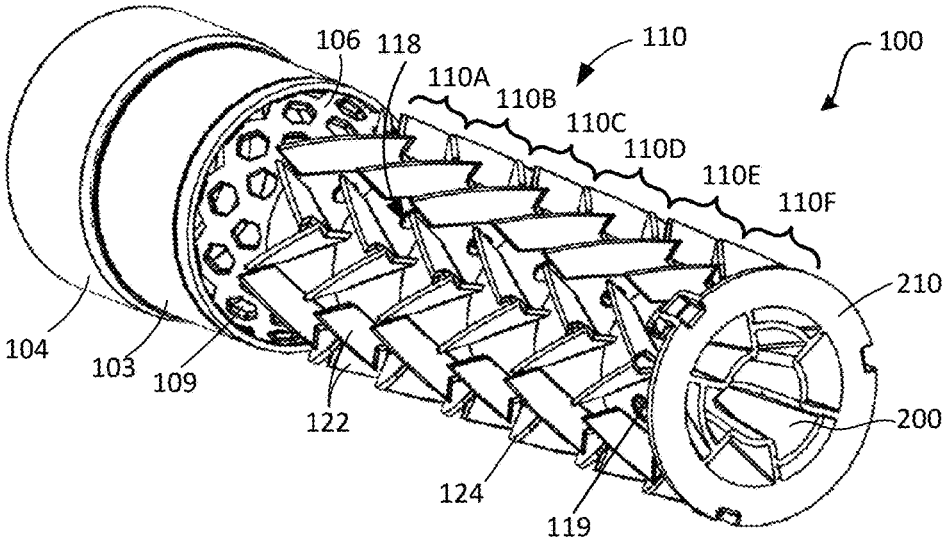
FIG. 1C illustrates a front perspective view of a suppressor shown without the outer housing to expose portions of the diffusor, baffle stack, and integrated flash hider, in accordance with one embodiment of the present disclosure.
Figure 1D:
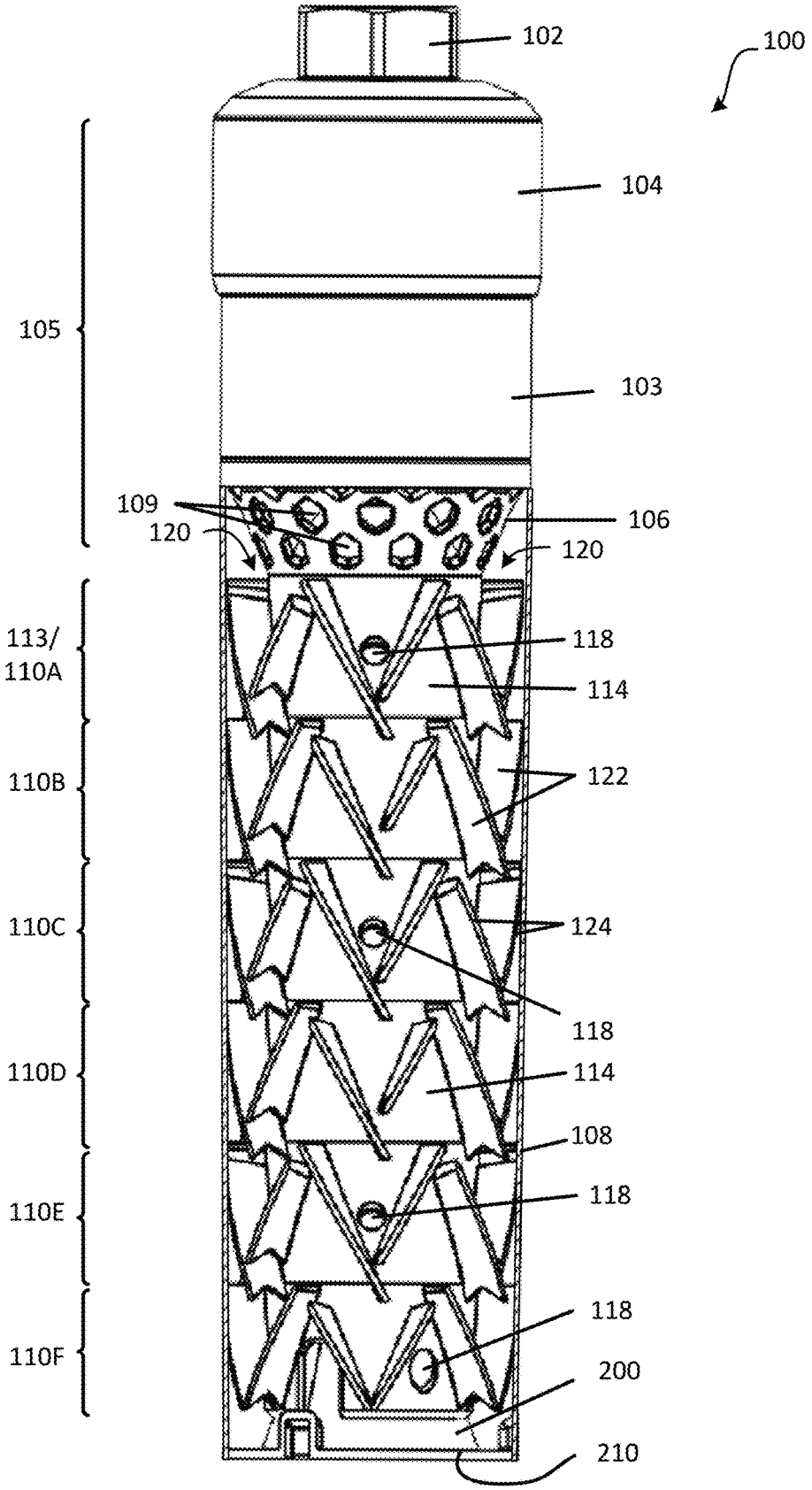
FIG. 1D illustrates a view of a suppressor in a vertical orientation with the outer housing shown cut away, where the suppressor includes a baffle stack, a diffusor, a flash hider, and a mount, in accordance with one embodiment of the present disclosure.

FIGS. 1A, 1B, 1C, and 1D illustrate various views of a suppressor 100, in accordance with an embodiment of the present disclosure. FIG. 1A is a front and side perspective view of the suppressor 100, FIG. 1B is a side view showing a longitudinal cross section of the suppressor 100 taken along the central axis, FIG. 1C is a front and side perspective view of the suppressor 100 shown without the outer housing 108, and FIG. 1D is a side view of the suppressor 100 in a vertical orientation shown with a cross section of the outer housing 108. Concurrent reference to these figures will facilitate explanation.

The suppressor 100, as shown at a high level in FIG. 1A, extends along a central axis 10 from a proximal end portion 12 to a distal end portion 14. The proximal end portion 12 includes a diffusor 103 connected to a mount 104. The distal end portion 14 includes a flash hider 200 integral to the suppressor 100 assembly. An outer housing 108, which has a cylindrical shape in this example embodiment, extends longitudinally and encloses a baffle stack 110 between the diffusor 103 and the flash hider 200. For example, the outer housing 108 is secured to the diffusor 103 at its proximal end and to the distal end cap 210 of the flash hider 200 at its distal end. Optionally, the suppressor 100 includes recessed notches 119 in the distal end portion 14 to facilitate engagement with a spanner or other tool used to assemble the suppressor with the mount 104, or to screw the suppressor onto the barrel or barrel attachment. Notches 119 can be seen in more detail in FIGS. 7A-7D. As shown in the cross-sectional view of FIG. 1B, an inner volume of the baffle stack 110 defines an inner chamber 116. An outer chamber 120 is defined between the baffle stack 110 and the outer housing 108 such that the outer chamber 120 is coaxially disposed around the inner chamber 116. Components of the baffle stack 110 are discussed in more detail below.

In more detail, the mount 104 can include a threaded portion 102 (visible in FIG. 1B and FIG. 1C) that is configured to connect to the barrel of a firearm. In various examples, the mount 104 can be configured for direct connection to the barrel of a firearm, or the mount 104 can be configured to receive an adapter or a quick-disconnect mount that facilitates indirect connection of the suppressor 100 to the barrel of a firearm. Other configurations of the mount 104 be apparent in light of the present disclosure.

The mount 104 may also be connected to or otherwise integral with a diffusor 103 having a tapered wall 106 that reduces in diameter as it extends distally to the baffle stack 110. In one embodiment, the diffusor 103 includes a diffusor cone with a tapered wall 106 having a larger proximal diameter where it connects to the outer housing 108 and a smaller distal diameter where it engages or connects to a blast baffle 113 at the proximal end of the baffle stack 110. Although the diffusor 103 is shown as having a tapered wall 106 with a single taper, such as a frustoconical geometry, the tapered wall 106 could be a combination of tapered and vertical sections or a combination of vertical and horizontal/cylindrical sections with a stepped profile, for example. Similarly, while the tapered wall 106 is shown as having a linear taper, it could have a non-linear taper or include sections with a non-linear taper. The tapered wall 106 of the diffusor 103 defines a plurality of openings 109 that communicate with an outer chamber 120 located radially outside of the baffle stack 110. The openings 109 can have a circular, hexagonal, slotted, ovoid, or other shape. Numerous geometries are acceptable for the tapered wall 106 and openings 109.

The diffusor 103 and mount 104 define an open blast chamber 105 in the proximal end portion 12. The blast chamber 105 is a relatively voluminous and open region in the proximal end portion 12. The blast chamber 105 allows combustion gases to initially expand upon entering the suppressor 100 from the smaller diameter of the barrel's bore. Gases can further expand after passing through openings 109 in the tapered wall 106 and into the outer chamber 120, or after passing through the central opening 115 of the blast baffle 113 and into the inner chamber 116.

In one embodiment, the blast chamber 105 is sized to accommodate a muzzle brake, flash hider, or similar muzzle attachment on the barrel of the firearm. For example, the suppressor 100 is constructed to be installed over a muzzle attachment attached to the firearm barrel, where the muzzle attachment is received in the blast chamber 105; however, no such muzzle attachment is required for effective operation of suppressor 100. In one example embodiment, the blast chamber 105 has an axial length from 0.5 inch to about 3 inches. Numerous variations and embodiments will be apparent in light of the present disclosure.

As will be described below in more detail, the openings 109 in the tapered wall 106 of the diffusor 103 allow a portion of the gases to travel from the blast chamber 105 and into the outer chamber 120. Gas flow through the openings 109 to the outer chamber 120 may also be promoted by the radially expanding and outward slope of an expanding baffle wall 111 of the blast baffle 113, which is positioned at least partially within the tapered wall 106 of the diffusor 103 in some embodiments. In one embodiment, the expanding baffle wall 111 of the blast baffle 113 has a frustoconical shape that expands in size moving distally along the central axis 10 and defines a central opening 115. The blast chamber 105 can, in one example, channel some of the gases produced by combustion of propellant into the inner chamber 116 along the path of the projectile along the central axis 10. It will be appreciated that the gases flowing through the inner chamber 116 are slowed and/or cooled by the operation of the baffles 110, which additionally induce localized turbulence and energy dissipation, thus reducing (or "suppressing") the sound and/or flash of expanding gases. For example, as the gases collide with baffles and other surfaces in the suppressor, the gases converge and then expand again in a different direction, for example. The various collisions and changes in velocity (direction and/or speed) result in localized turbulence, an elongated flow path, and heat and energy losses from the gases, thereby reducing the audible and visual signature of the rifle.

As will be appreciated in light of the present disclosure, propellant gases are divided into two volumes of gas that are largely separated from each other. These volumes of gas pass through their corresponding inner and outer chambers (with some mixing therebetween) before exiting the suppressor 100. This mixing of gases between the inner chamber 116 and outer chamber 120 allows for better filling of the chambers by the combustion gases, longer flow paths, increased gas turbulence, better cooling, and a faster reduction in total energy of the gases. These in turn, can produce the benefits described above.

The baffle stack 110 is connected to the tapered wall 106 of the diffusor 103, in accordance with some embodiments. The baffle stack 110 can be formed from a plurality of individual baffles 110A-110F (e.g., at least one, at least two, or at least three baffles) joined together, such as by welding. In this example, the first baffle 110A may also be referred to as a blast baffle 113 since it may have some features not found in the other baffles 110B-110F, and vice versa. In some embodiments, all baffles 110A-110F can have substantially the same geometry. In some such embodiments, the first baffle 110A may have or lack features that distinguish it structurally from other baffles 110B-110F, but it nonetheless may function as a blast baffle, and be referred to as such, in that it is subject to a blast of high temperature gases exiting the barrel, as will be appreciated. In other examples, individual baffles can be joined together by other connection mechanisms such as threaded interfaces or a compression fit. In yet other embodiments, the baffle stack 110 (and optionally the flash hider 200, outer housing 108, diffusor 103, and/or other components) can be made as a single monolithic structure using additive manufacturing techniques (e.g., direct metal laser sintering (DMLS)). Numerous variations and embodiments will be apparent in light of the present disclosure.

The baffle stack 110 generally partitions the inner chamber 116 into compartments 117 between adjacent baffles, where adjacent compartments 117 communicate via the central opening 115. Each of baffles 110A-110F includes a cylindrical baffle body 114 connected to a frustoconical expanding baffle wall 111, which is shown in cross-section in FIG. 1B. Each of the expanding baffle walls 111 defines a central opening 115 aligned with the central axis 10 for passage of a projectile through the suppressor 100. As shown in this example, the baffle bodies 114 have a cylindrical shape and the expanding baffle wall 111 has a frustoconical shape, but other geometries are acceptable. A conical shape of the sloped baffle wall 111 is not required and each baffle 110 can similarly use a partial vertical wall, a V-shaped wall, parabolic wall, tetrahedral walls, and other baffle configurations, each of which defines a central opening 115 for the projectile. The baffles 110A-110F shown in the present example correspond to a conical, stackable baffle with an asymmetric slot configuration, but it will be appreciated that other baffle types (and their analogous structures) can be used as individual baffles. Other example baffle types include an "M-baffle," "stepped baffle," and an "Omega baffle," among others.

Regardless of the baffle type, the alignment of the central openings 115 through the individual baffles 110A-110F creates the inner chamber 116 through which a projectile and some of the propellant gases can pass. In some embodiments, the central openings 115 can be defined to include an off-axis entrance, such as a crescent-shaped recess or a gutter 140. The gutter 140 can be, for example, a portion of a tube connected to the expanding baffle wall 111 at the central opening 115 and oriented transversely to the central axis 10. Furthermore, the recess or gutter 140 of one baffle 110 may, in some embodiments, be in a different rotational position relative to the gutter 140 of an adjacent baffle 110. In the example shown in FIG. 1B, the gutter 140 of one baffle (e.g., baffle 110D) is on a side of the baffle opposite to the location of the gutter 140 of an adjacent baffle (e.g., baffle 110C). For example, the gutter 140 of adjacent baffles is rotationally offset from zero to 180 degrees. In other examples, baffle can include a section removed from the part of the baffle body 114 at the central opening 115 so as to change the shape of the central opening 115 from being purely circular. Note that in some embodiments, the central opening 115 may be oriented transversely to the central axis 10 so as to appear circular as viewed along the central axis 10, while having an elliptical shape when viewed perpendicularly to the entrance. That is, because of the off-axis orientation of the central opening 115, the propellant gases can more easily flow through the central opening 115 in directions transverse to the central axis 10. As a result, each baffle promotes cross-axis flow of the gases that results in collisions, turbulence, direction changes, swirling, elongated flow path, etc. The flow of combustion gases between the inner chamber 116 and the outer chamber 120 can further induce turbulence, swirling and collisions, thus increasing energy dissipation and reducing the pressure and temperature of the combustion gases, reducing the sound signature further. Many other configurations are acceptable, as will be appreciated Further improving fluid communication between the inner chamber 116 and the outer chamber 120 are baffle ports 118 defined in one or more of the baffles 110A-110F. These baffle ports 118 can divert gas flows so as to further interrupt gas flow along the central axis 10 and promote mixing between the inner chamber 116 and the outer chamber 120 via the baffle ports 118. Gases can flow from the outer chamber 120 to the inner chamber 116, from the inner chamber 116 to the outer chamber 120, or both. Baffle ports 118 can be directed to promote flow from one chamber to another, as will be appreciated.

In one embodiment, baffle ports 118 are located and directed to promote gas flow predominantly from the outer chamber 120 to the inner chamber 116. For example, gas flow from the outer chamber 120 to the inner chamber 116 via baffle ports 118 results in a flow path that is transverse to the central axis 10. Gases flowing along such a path mix with gases flowing though the inner chamber 116 along the central axis 10 and other flow paths. By encouraging fluid flow of combustion gases between the inner chamber 116 and the outer chamber 120, the presence of the baffle ports 118 promotes gas mixing and turbulence, which can further reduce the pressure and temperature of the combustion gases as the gases flow from one baffle to the next by, in part, encouraging more complete filling of the chamber 116, 120 volumes. In one example, baffle ports 118 in a terminal baffle that is adjacent to the flash hider 200 (in this case, the baffle 110F) can be configured to enable combustion gas in the outer chamber 120 to flow into exit ports of the flash hider 200 that exhaust into the atmosphere via vents 228. In the view of FIG. 1B, it can be seen that a portion of the flash hider 200 (e.g., outer flash hider portion 220) can be partially disposed within baffle 110F. This enables communication between the outer chamber 120 and the exit ports 230 of the flash hider 200 via baffle ports 118 of the terminal baffle. The flash hider 200, and the fluid communication with the outer chamber 120, is described below in more detail in the context of FIGS. 4A-4D.

In some examples, flow structures 122 can be disposed within the outer chamber 120 (e.g., between baffle stack 110 and an inner surface of the outer housing 108). These flow structures 122 are visible in FIGS. 1B, 1C, and 1D (among others). In various examples, the flow structures 122 can be connected to one or both of an outer surface of the baffles 110A-110F (e.g., a surface opposite that of the inner chamber 116), or an inner surface of the outer housing 108 (e.g., a surface separated from and confronting the outer surface of the baffle stack 110).

In the example shown in FIGS. 1B and 1C (among others), the flow structures 122 are configured as vanes that can help channel or otherwise direct the flow of combustion gases. In some examples, the flow of gases can be channeled repeatedly between the inner chamber 116 and the outer chamber 120 by spacing and angling vanes relative to one another so as to form pairs of flow structures 122 (e.g., vane pairs) that are placed proximate to baffle ports 118. In one embodiment, for example, the vanes are arranged to preclude a direct linear path through the outer chamber 120 from the proximal end portion to the distal end portion. For example, gases entering the outer chamber 120 through openings 109 must take a tortuous path to reach the distal wall 204 of the flash hider 200. The wide end and the narrow end of these "V-shaped" pairs of structures can channel gas flow along a zig-zag path.

In some examples, the flow structures 122 can be cylinders, plates, or other configurations in any number of orientations that can direct gas flow and cause the baffle stack 110 and the outer housing 108 to be separated from one another. In some examples, flow structures 122 can include alternating vanes that extend part way upwardly and/or downwardly between the outer housing 108 and the baffle bodies 114 of the baffle stack 110. This configuration can define an oscillating flow path for the gases as they flow towards exit at the distal end of the suppressor 100.

In one example, the outer housing 108 is configured and dimensioned to connect to a surface on the mount 104 and/or to the diffusor 103, and to fit over the flow structures 122 of the baffle stack 110. In some examples the outer housing 108 may contact at least a portion of a terminal edge 124 of some or all of the flow structures 122. This contact may create a seal between the terminal edge 124 of the various flow structures and the outer housing 108 to define the outer chamber 120 through which gas can flow, but a seal is not required.

Figure 1E:
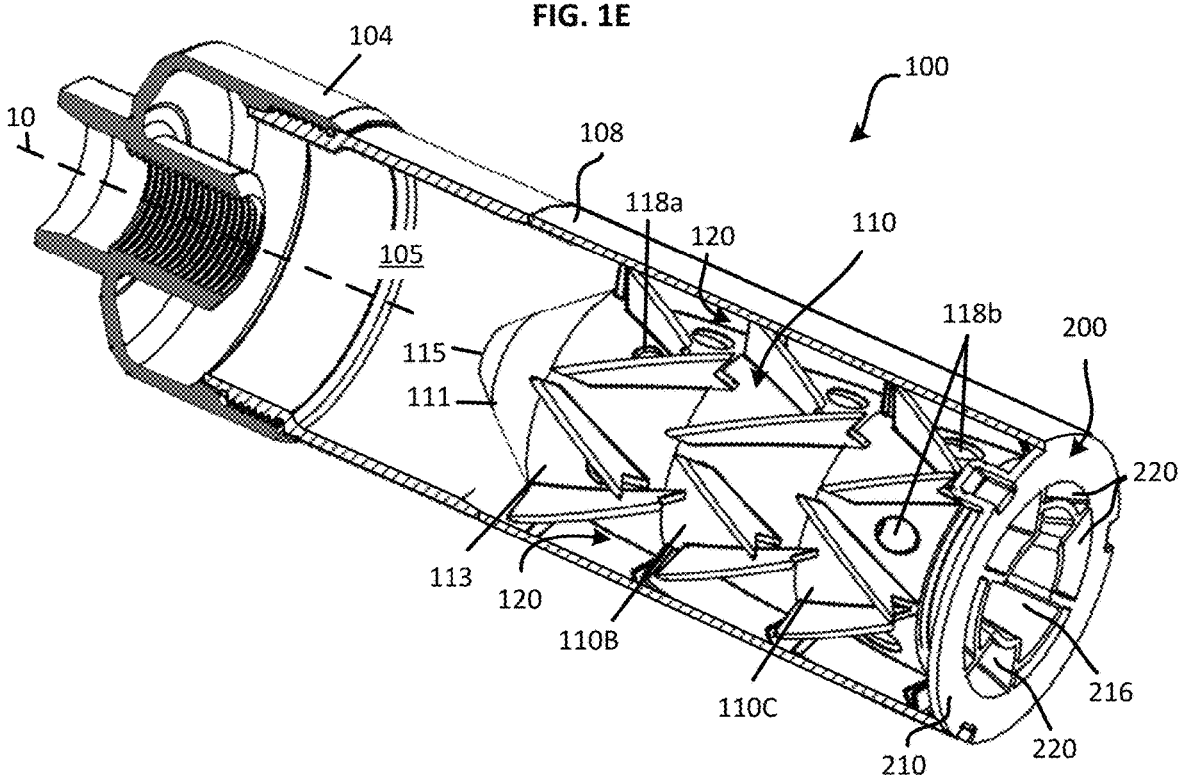
FIG. 1E illustrates a front perspective view of a suppressor with the outer housing and mount shown cut away to reveal baffle stack, in accordance with an embodiment of the present disclosure

Referring now to FIG. 1E, a front perspective view illustrates suppressor 100 with the outer housing 108 and mount 104 shown cut away to reveal baffle stack 110, in accordance with another embodiment of the present disclosure. In this embodiment, the baffle stack 110 includes three baffles, the first of which is configured as a blast baffle 113. An example of blast baffle 113 is discussed in more detail below with reference to FIGS. 4A and 4B. An example of baffles 110B and 110C is discussed in more detail below with reference to FIGS. 5A-5D. Baffle stack 110 can include more baffles as needed for a particular application.

As with embodiments discussed above, suppressor 100 defines an inner chamber 116 (not visible) within baffle stack 110 and an outer chamber 120 between baffle stack 110 and the outer housing 108. Gases entering the suppressor 100 initially expand in blast chamber 105. A portion of gases enter the blast baffle 113 through central opening 115 and another portion of gases are directed radially outward by expanding baffle wall 111 to outer chamber 120. The inner chamber 116 is in fluid communication with the outer chamber 120 by ports 118. Ports 118*a* positioned between converging flow structures 122 (e.g., vanes) typically result in a localized region of high pressure that directs gases from the outer chamber 120 into the inner chamber 116, and therefore may be referred to as inlet ports. Note that ports 118*a* are most often inlet ports, but that fluid dynamics within the suppressor 100 depends on many factors and the flow through ports 118*a* could reverse directions in some circumstances such that gases flow through ports 118*a* from the inner chamber 116 to the outer chamber 120. Ports 118*b* positioned between diverging vanes usually result in a localized region of low pressure that directs gases from the inner chamber 116 to the outer chamber 120, and therefore may be referred to as outlet ports. Note, however, that ports 118*b* between diverging vanes can be an inlet port or an outlet port, depending on other nearby structures and flow conditions within the suppressor 100, as will be appreciated. For example, adjacent distal end cap 210, ports 118*b* may behave as inlet ports.

In the example shown in FIG. 1E, flash hider 200 is integral to the suppressor 100 and includes distal end cap 210 attached to the outer housing 108. A first flash hider portion 216 vents gases primarily from the inner chamber 116 and a second flash hider portion 220 vents gases primarily from the outer chamber 120. Flash hider 200 shown in this example is discussed in more detail below with reference to FIGS. 7A-7E. Other flash hider configurations are acceptable, such as discussed below. Flash hider 200 can be selected for a given application, such as one that requires reduced flash or reduced back pressure. Numerous embodiments will be apparent in light of the present disclosure.

Figure 1F:
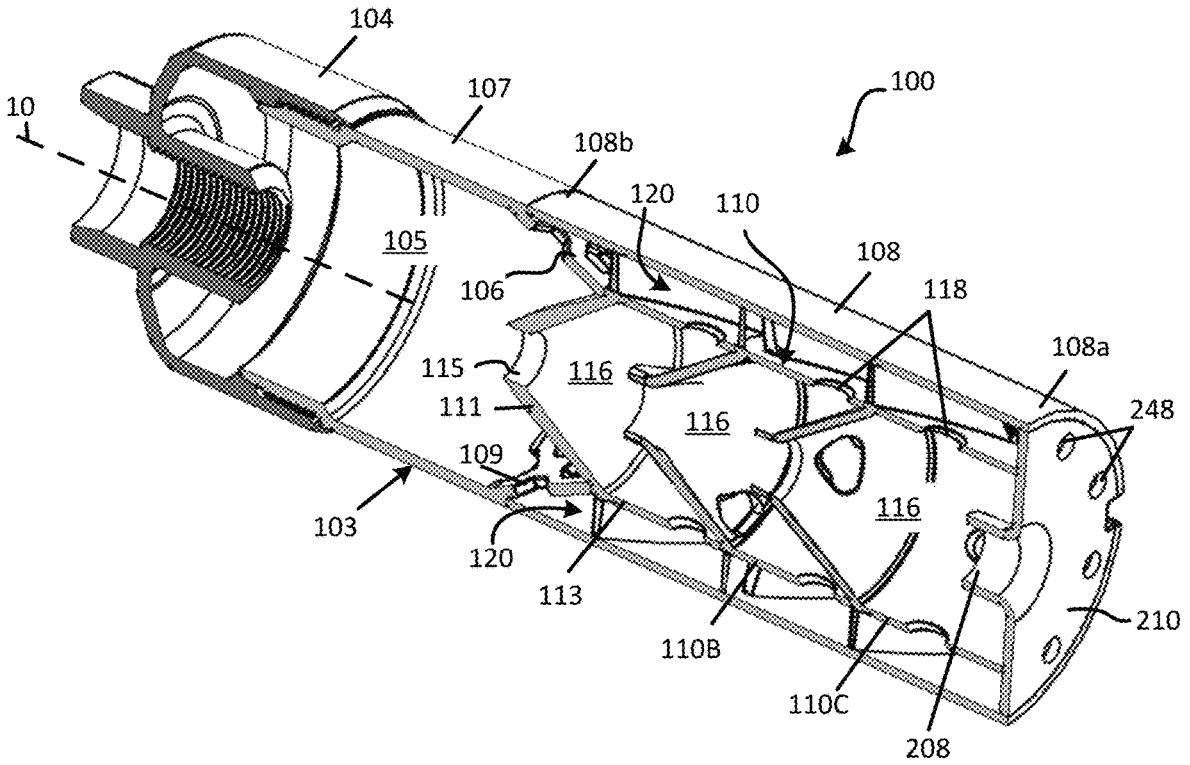
FIG. 1F illustrates a front perspective view shows a longitudinal section of suppressor that includes a mount, a diffusor, a baffle stack, and a distal end cap, in accordance with another embodiment of the present disclosure.

Referring to FIG. 1F, a front perspective view shows a longitudinal section of suppressor 100, in accordance with another embodiment of the present disclosure. In this example, suppressor includes a baffle stack 110, diffusor 103, and mount 104. An outer housing 108 is around the baffle stack 110 and connects at its distal end 108*a* to distal end cap 210, and at its proximal end 108*b* connects to diffusor body 107. Baffle stack 110 includes blast baffle 113 and additional baffles 110B, 110C. An example of blast baffle 113 is discussed in more detail below with reference to FIGS. 4A and 4B. An example of baffles 110B and 110C is discussed in more detail below with reference to FIGS. 5A-5D. Baffle stack 110 can include more baffles as needed for a particular application.

Suppressor 100 defines an inner chamber 116 within baffle stack 110 and an outer chamber 120 between baffle stack 110 and the outer housing 108. Gases entering the suppressor 100 initially expand in blast chamber 105 defined in part by diffusor 103 and in part by mount 104. Diffusor 103 includes a tapered wall 106 with openings 109. A portion of gases flowing along central axis 10 enters the blast baffle 113 through central opening 115 and flows into the inner chamber 116. Another portion of gases is directed radially outward by expanding baffle wall 111 of blast baffle 113 and by tapered wall 106 of diffusor 103 to outer chamber 120. The inner chamber 116 is in fluid communication with the outer chamber 120 via ports 118. Gases in inner chamber 116 can exit the suppressor 100 via central opening 208 of distal end cap 210. Gases in outer chamber 120 can exit the suppressor 100 via radially outer openings 248 in the distal end cap 210. As shown in this example, the outer chamber 120 is in direct fluid communication with the environment via radially outer openings 248 and inner chamber 116 is in direct fluid communication with the environment via central opening 208. Prior to venting to the environment, gases in the inner chamber 116 can flow into the outer chamber 120 via ports 118, and vice versa.

Figure 2:
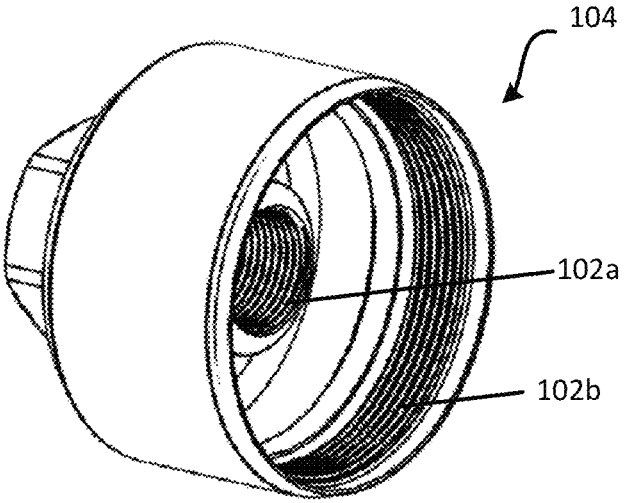
FIG. 2 illustrates a front perspective view of a mount that includes a cylindrical mount body with threaded portions, in accordance with one embodiment of the present disclosure.
Figure 3A:
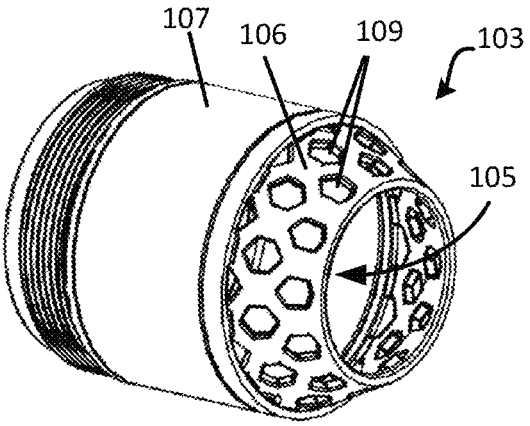
FIGS. 3A and 3B illustrate front perspective views of diffusors, in accordance with some embodiments of the present disclosure.
Figure 3B:
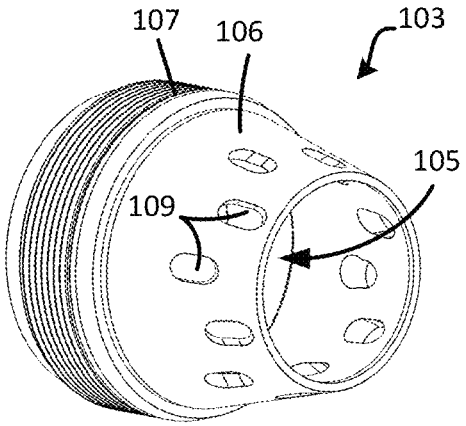

FIG. 2 illustrates a front perspective view of a mount 104, in accordance with one embodiment. The mount 104 can include a first threaded portion 102*a* for attachment to a firearm barrel or muzzle accessory attached thereto. The mount 104 can also include a second threaded portion 102*b* for attachment to the diffusor 103 that, at least in part, defines the blast chamber 105. The diffusor 103, such as shown in FIG. 3A or 3B, can be configured to connect to the second threaded portion 102*b* of the mount 104. In another example, the diffusor 103 and the mount 104 can be joined to one another using some other technique (e.g., welding) or in some cases be integral with one another. Regardless, when joined together the mount 104 and the diffusor 103 place the barrel of the firearm (and the propellant ignition gases that flow therefrom) in fluid communication with the inner chamber 116. As also described above, the tapered wall 106 of the diffusor 103 defines openings 109 that place the barrel of the firearm in fluid communication with the outer chamber 120.

FIGS. 3A and 3B illustrate front perspective views of example diffusors 103, in accordance with some embodiments. In each example, the diffusor 103 includes a cylindrical diffusor body 107, which at least in part defines blast chamber 105. The diffusor body 107 optionally can be threaded for attachment to the mount 104 or some other muzzle device. Optionally, the diffusor 103 includes a tapered wall 106 extends distally from the diffusor body 107 and reduces in size (e.g., diameter) to connect to the blast baffle 113, such as shown in the cross-sectional view of FIG. 1B. The tapered wall 106 defines a plurality of openings 109 for gas flow into the outer chamber 120. The perforated tapered wall 106 helps dissipate the energy of gas flow prior to reaching the first baffle 110A or blast baffle 113, but the tapered wall 106 is not required in all embodiments. As shown here, the axial length of the diffusor body 107 and the tapered wall 106 can be varied as needed. For example, some ammunition may require a more voluminous blast chamber 105, which can be offset by a reduced axial length of the tapered wall 106, for example. Further, some manufacturing techniques (e.g., DMLS) may produce hexagonal openings 109 or other shapes; however, the openings 109 are not limited to any particular shape.

Figure 4A:
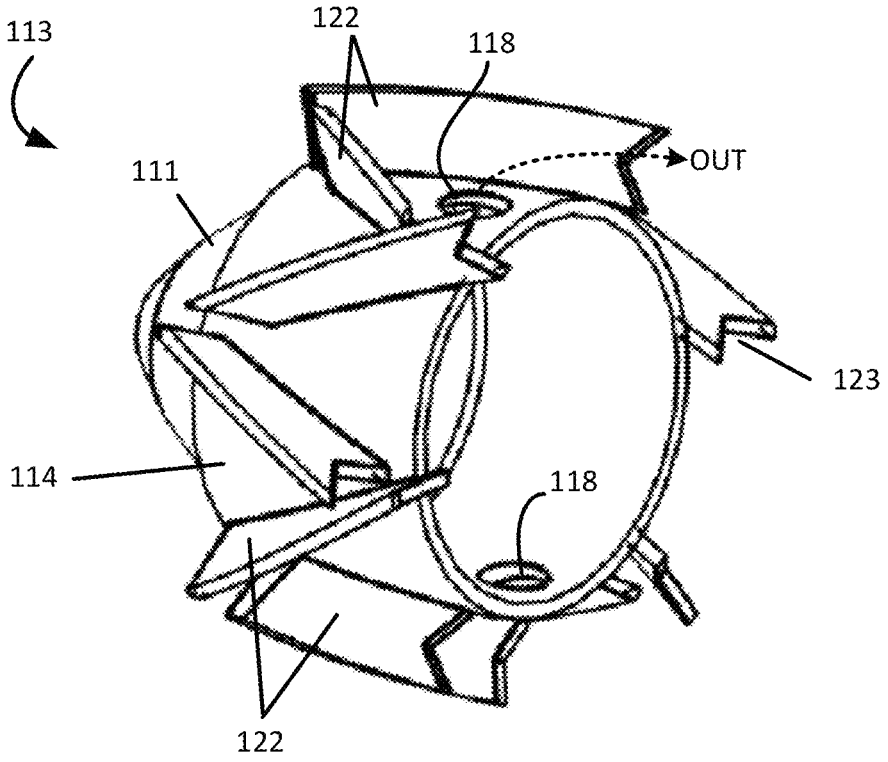
FIGS. 4A and 4B illustrate front and rear perspective views, respectively, of a blast baffle, in accordance with one embodiment of the present disclosure.
Figure 4B:
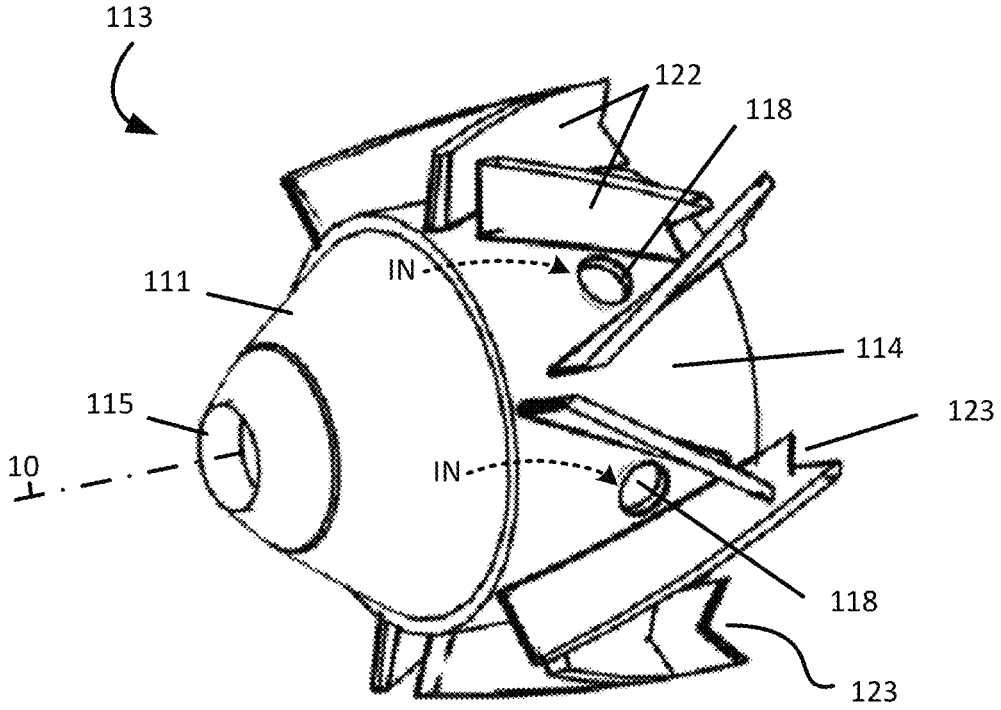

FIGS. 4A and 4B illustrates front and rear perspective views, respectively, of a blast baffle 113, in accordance with one embodiment. Blast baffle 113 in this example is configured as a first baffle and may also referred to as first baffle 110A, where blast baffle 113 is the first (proximal) baffle in the baffle stack 110 that includes additional baffles having the same or a different configuration.

Blast baffle 113 has an expanding baffle wall 111 that defines a central opening 115 that is coaxial with the central axis 10. In this example, the expanding baffle wall 111 has a frustoconical shape that expands as it extends axially from the central opening 115 to the baffle body 114. Other geometries are acceptable as noted above. In some embodiments, blast baffle 113 is structurally identical to baffles 110B-110F, except that blast baffle 113 lacks the off-axis crescent portion 115A or gutter 140 at the central opening 115 as found in some or all of baffles 110B-110F. As such, blast baffle is better configured to direct a portion of gases incoming to the blast chamber 105 to flow radially outward to the outer chamber 120.

The cylindrical baffle body 114 defines baffle ports 118 that enable fluid communication between the inner chamber and the other chamber, and the circuitous gas flow path that reduces the audible signature of expanding gases. Flow structures 122 extend radially from the outside of the baffle body 114 and are configured to direct gas flow along longer, tortuous paths, and through the baffle ports 118 and between the inner and outer chambers. In one example, flow structures 122 are vanes having a helical twist, where the vanes are oriented in a direction that is transverse to the central axis 10. As shown, for example, in FIG. 4B, some pairs of flow structures 122 define a converging gas flow path, such as where distal ends of two vanes are closely spaced. In such situations, the converging vanes will cause a localized region of high pressure such that gases will tend to flow through the baffle ports into the inner chamber 116. In other locations, such as shown in FIG. 4A, flow structures 122 define a diverging gas flow path that often results in a localized region of low pressure that causes to flow out through baffle ports 118 from the inner chamber 116 to the outer chamber 120.

In some embodiments, flow structures 122 define a V-shaped end portion 123. The V-shape is not required and is the result of additive manufacturing techniques (e.g., DMLS), in accordance with some embodiments. For example, when "printing" the baffles in a vertical orientation along the central axis 10, flow structures 122 may begin from a region of open space. In such situations, for example, to facilitate DMLS manufacturing requirements, the flow structure 122 is constructed over the open space by adding material to the nearest structure (e.g., baffle body 114 and outer housing 108) and then extending outward and upward to form the vane having a V-shaped end portion. The V-shape is not required, but it can be useful to provide or add to an opening for gas flow between converging vanes.

Figure 5A:
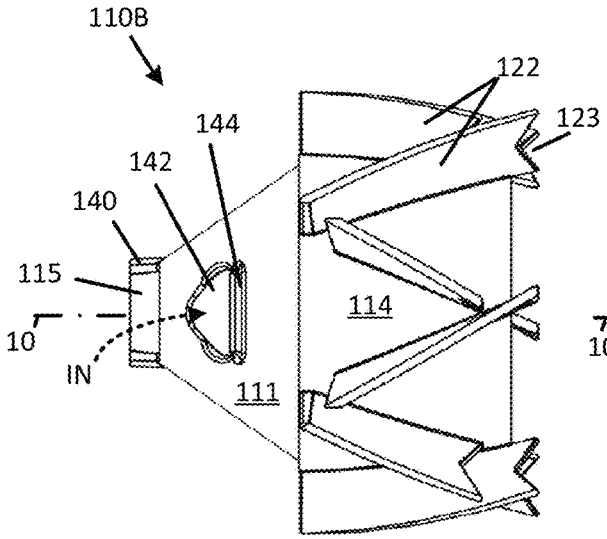
FIGS. 5A and 5B illustrate side and top views, respectively, of a baffle of a baffle stack, in accordance with an embodiment of the present disclosure.
Figure 5B:
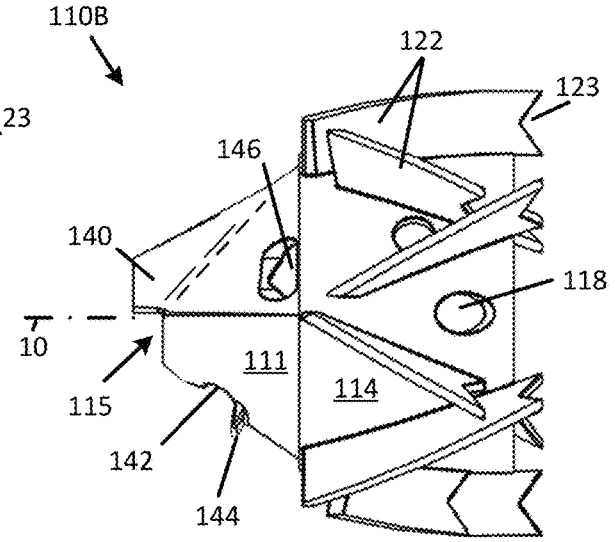
Figure 5C:
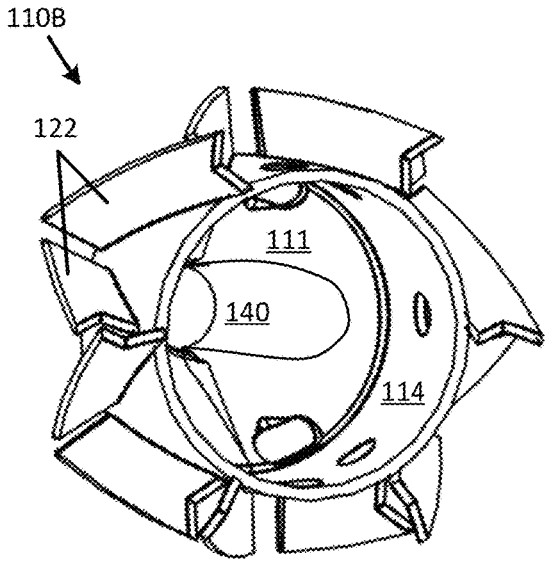
FIGS. 5C and 5D illustrate front and rear perspective views, respectively, of the baffle of FIGS. 5A-5B and showing a gutter at the central opening, in accordance with an embodiment of the present disclosure.
Figure 5D:
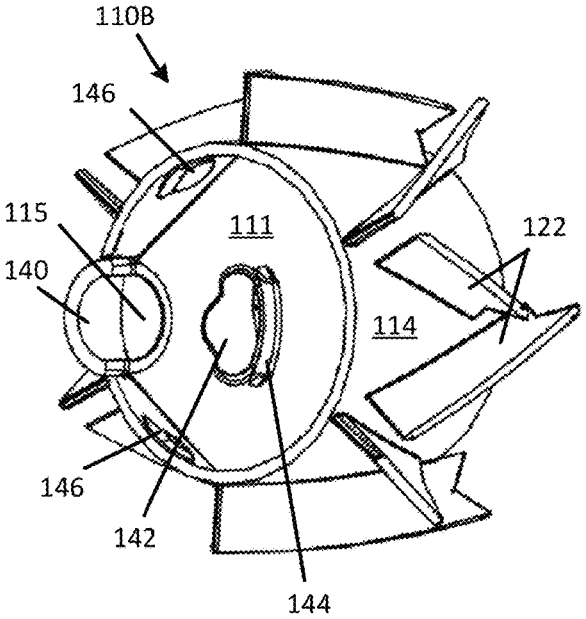

FIGS. 5A-5D illustrate various views of a baffle 110B, in accordance with one embodiment. FIG. 5A is a side view, FIG. 5B is a top view, FIG. 5C is a front perspective view, and FIG. 5D is a rear perspective view. Similar to blast baffle 113 discussed above, baffle 110B includes an expanding baffle wall 111 that expands as it extends from central opening 115 to a cylindrical baffle body 114 that includes flow structures 122. In this example, expanding baffle wall 111 is expanded on one side to define a partial collar or gutter 140 that connects to expanding baffle wall 111 at the central opening 115 and extends rearward therefrom. As shown in this example, the gutter 140 extends around about half of the central opening 115 and merges with the expanding baffle wall 111. As a result, the area of the central opening 115 has an elliptical or elongated shape when viewed at an angle transverse to the central axis 10 (e.g., as in FIG. 5D), where the elliptical shape is larger than the circular shape of the central opening 115 when viewed along the central axis 10. Due to the larger area, pressurized gases tend to enter the central opening 115 along the gutter 140 in a direction that is transverse to the central axis 10, thereby promoting cross-axis gas flow.

As shown, for example, in FIGS. 5B and 5D, the expanding baffle wall 111 defines a port 142 that is positioned 180° from the gutter 140. Gases impinging on the expanding baffle wall 111 enter the port 142 and flow laterally across the central axis 142, further promoting cross-axis flow and reinforcing flow across the central axis 10 due to gutter 140. In addition, it has been shown that port 142 also helps avoid stalled gas flow and the associated deposit of particulates that can occur in corners, at intersecting walls, and similar regions. The port 142 optionally includes a protrusion or other flow-directing structure 144 on the distal side the port 142 to direct gases into the port 142. For example, the flow-directing structure 144 is a wall or fin that extends outward from the expanding baffle wall 111 along the distal side of the port 142. Baffle 110B optionally defines additional ports 146 in the expanding baffle wall 111 that are above and below the central opening 115. These additional ports 146 further assist in preventing stalled gas flows and particle build-up as well as promoting off-axis, turbulent flows within the inner chamber 116.

In some embodiments, the gutter 140 and port 142 of adjacent baffles can be oriented 180° out of phase with each other to result in a sinuous or zig-zag flow through the inner chamber 116. Similarly, the gutter 140 and port 142 of adjacent baffles can be oriented 170°, 160°, 150°, 140° out of phase or within a range between any combination of said values. In addition to a sinuous flow, the gutter 140 and port 142 being rotationally out-of-phase between adjacent baffles can result in a helical or swirling flow through the inner chamber 116.

In addition to gutter 140, or as an alternative to gutter 140, central opening 115 optionally includes an off-axis recess 115A that deflect the gas flow away from the central axis and also facilitates the increase in turbulence, swirling and a longer gas flow path through the inner chamber. As shown, for example, in FIG. 1B, baffle ports 118 can be positioned adjacent the off-axis crescent portion 115A to bolster the flow of gases away from the central axis 10.

Figure 6:
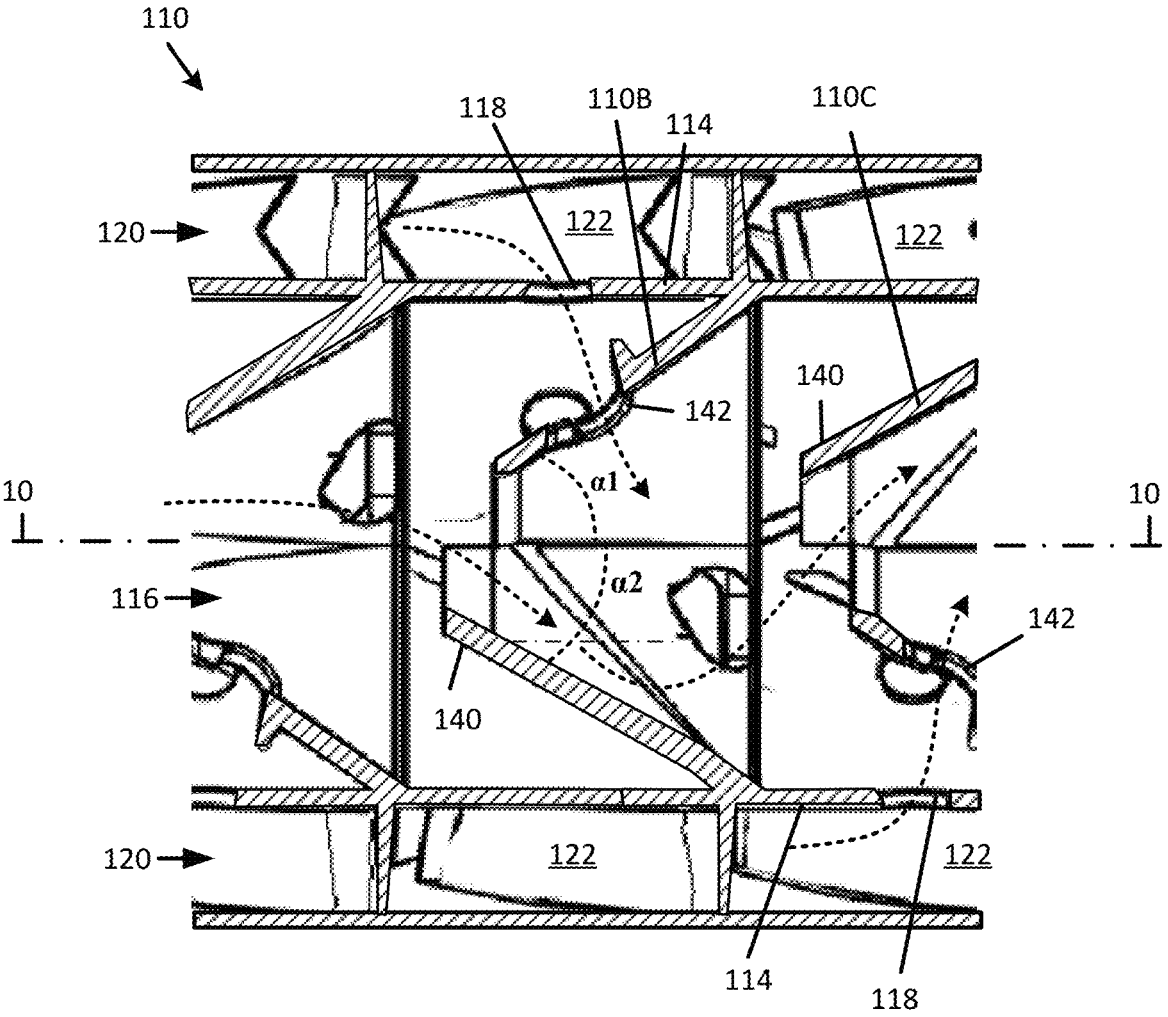
FIG. 6 illustrates a side view showing a longitudinal section of part of a suppressor that includes inner and outer chambers, and also showing example gas flow paths through the suppressor, in accordance with an embodiment of the present disclosure.

Referring now to FIG. 6, a side view illustrates a longitudinal cross section of adjacent baffles 110B, 110C of baffle stack 110, where the section is taken along a vertical plane extending through the central axis 10, in accordance with one embodiment. In this example, the expanding baffle wall 111 includes gutter 140. The gutter 140 extends outward from the otherwise conical expanding baffle wall 111. The gutter 140 defines a smaller angle $\alpha 2$ with respect to the central axis 10 than the angle $\alpha 1$ of the conical portion of the expanding baffle wall 111. For example, $\alpha 1$ is from 30-40°, or about 35°, and $\alpha 2$ is from 23 to 33°, or about 28° with respect to the central axis 10. As shown by broken lines in FIG. 6, gases tend to enter the central opening 115 along the axis of the gutter 140 due to the elongated and larger cross-sectional area when approached in this direction compared to the smaller circular area of central opening 115 when approached or viewed along central axis 10. Some baffle ports 118 in the baffle body 114 are positioned adjacent converging flow structures 122 and therefore direct gases from outer chamber 120 into the inner chamber 116. Some such baffle ports 118 are aligned with a port 142 that is located opposite of the gutter 140. The gas flow through these baffle ports 118 and ports 142 crosses the central axis 10 towards gutter 140, enhancing the amplitude of the sinuous gas flow through the inner chamber 116.

Figure 7A:
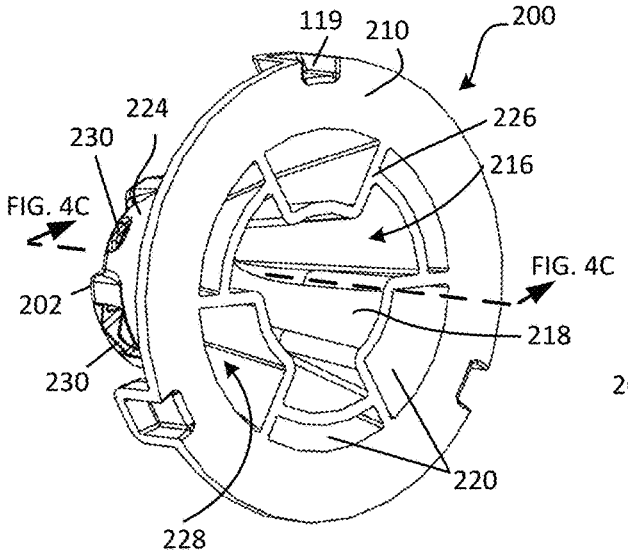
FIGS. 7A-7D illustrate front perspective, rear perspective, side view showing a longitudinal section, and side views, respectively, of a flash hider that can be integrated into a suppressor assembly, in accordance with an embodiment of the present disclosure.
Figure 7B:
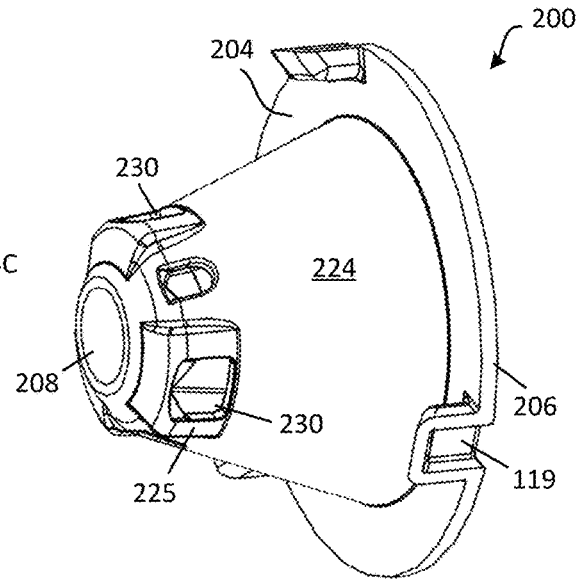
Figure 7C:
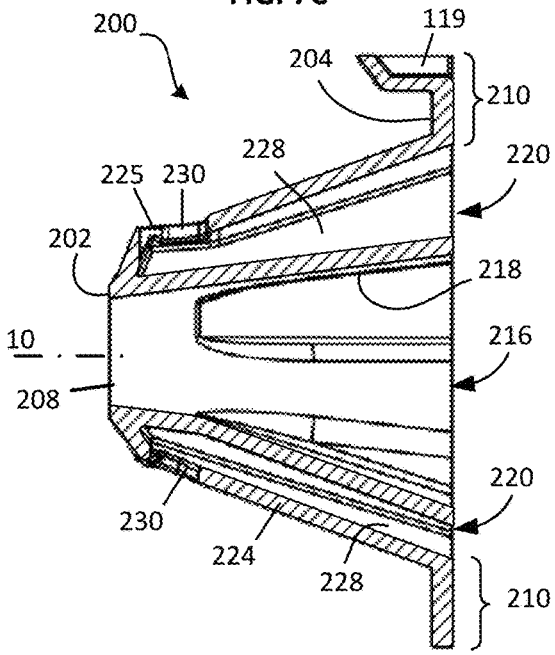
Figure 7D:
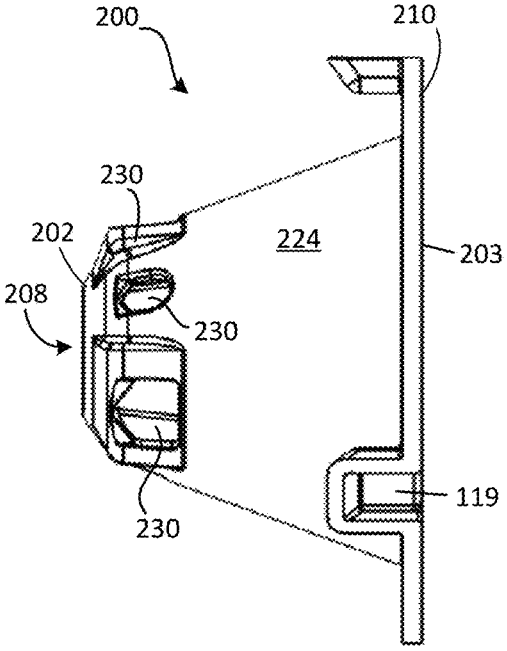
Figure 7E:
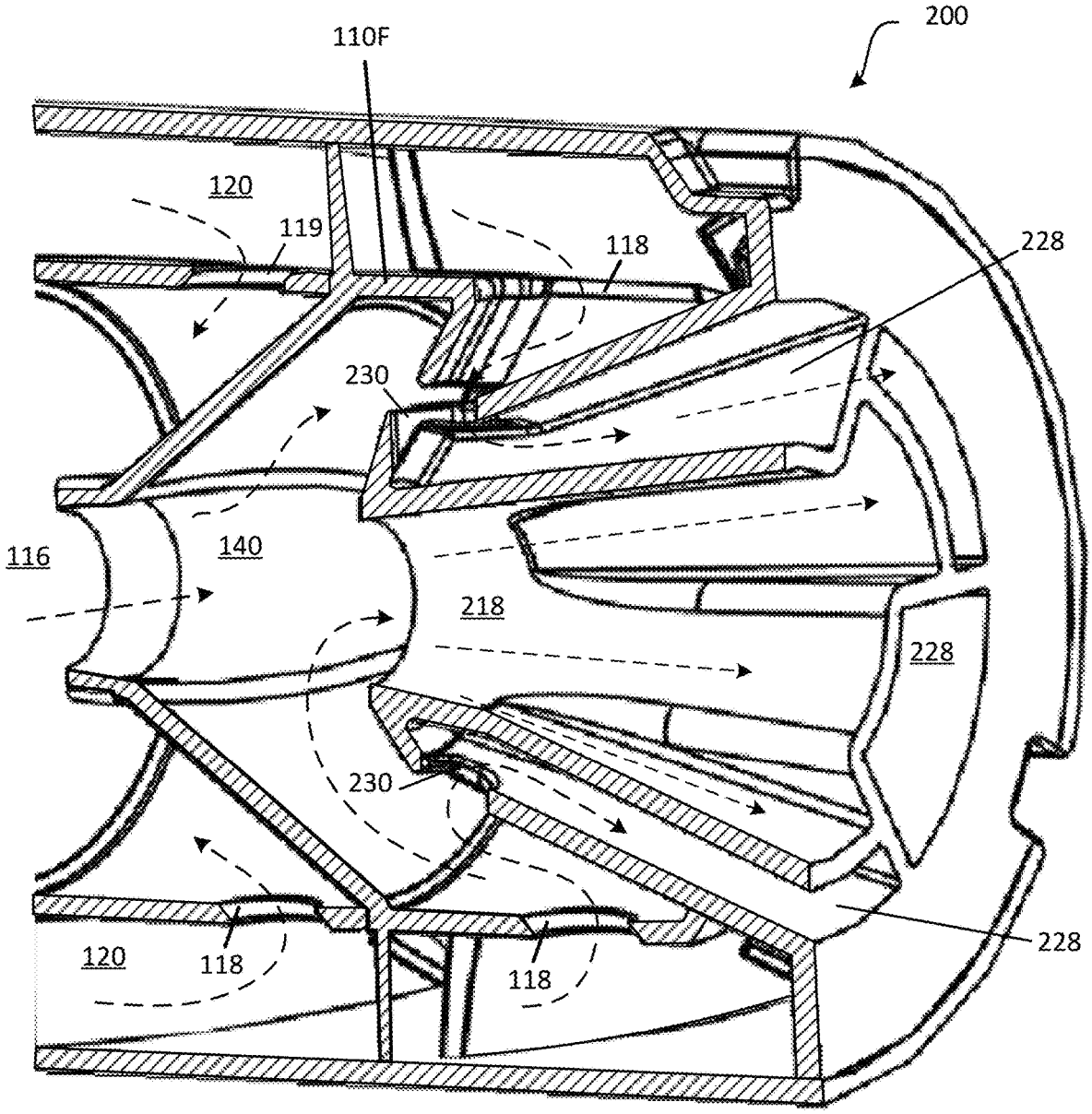
FIG. 7E illustrates a front perspective view showing a longitudinal section of a distal end portion of a suppressor assembly that includes the flash hider of FIGS. 7A-7D, in accordance with an embodiment of the present disclosure.

FIGS. 7A-7E illustrate various views of a flash hider 200 integrally formed with the distal end cap 210. FIG. 7A is a front perspective view, FIG. 7B is a rear perspective view, FIG. 7C is a side view showing a longitudinal cross section taken along the central axis 10, FIG. 7D is a side view, and FIG. 7E is a front perspective view showing a longitudinal cross section of the flash hider 200 integrated into the suppressor 100.

In some embodiments, the flash hider 200 includes a proximal end 202 defining a central opening 208, a distal end cap 210 with distal wall 204, a first or inner flash hider portion 216, and a second or outer flash hider portion 220. Optionally, the distal end cap 210 includes notches 119 for use with a spanner or like tool to assemble the suppressor 100 with a mount 104 and/or to assemble the suppressor 100 onto the barrel of a firearm. As shown, notches 119 are recesses defined in tabs that extend rearwardly from the rim 206 of distal end cap 210. In other embodiments, flats or other surface can be defined for engagement with a wrench or other tool, as will be appreciated. In some embodiments, the flash hider 200 is connected by welding, threaded engagement, or other attachment means to the outer housing 108 along the outer circumference of the distal end cap 210 as shown in FIG. 7E. In other embodiments, the flash hider 200 and other components of suppressor 100 are formed as a single, monolithic structure.

The outer flash hider portion 220 vents most of gases traveling through the outer chamber 120. Similarly, the inner flash hider portion 216 vents most of gases traveling through the inner chamber 116. As noted above, volumes of gases in the inner and outer chambers may mix at various locations along the length of the suppressor, including at the flash hider 200, in accordance with some embodiments. In some embodiments, the outer chamber 120 is isolated from the inner chamber 116 from points distal of the last baffle 110F. In one embodiment, for example, the proximal end 202 of the flash hider 200 can extend to connect to a proximally adjacent baffle, such as being connected to the central opening 115 of terminal baffle 110F, such as shown in FIGS. 8E-8F.

The distal end cap 210, which includes distal wall 204, provides a surface to which the outer housing 108 can be connected (e.g., via welding, compatible threaded portions). The distal wall 204 of the distal end cap 210 also can function as a terminal surface of the outer chamber 120, thus closing the outer chamber 120 to the ambient so as to channel combustion gases through the various baffle ports and out through the flash hider 200.

The outer flash hider portion 220 is concentrically and coaxially disposed around the inner flash hider portion 216, in accordance with some embodiments. The outer flash hider portion 220 is configured to hide a visible component of projectile propellant ignition (i.e., a flash). In particular, the outer flash hider portion 220 can be configured to reduce the intensity of visual phenomena that accompany expanding and/or burning combustion gases and that travel from a firearm barrel through the outer chamber 120.

The outer flash hider wall 224 defines exit ports 230 that allow the escape of gases from the outer chamber 120 via baffle ports 118. The location of exit ports 230 relative to terminal baffle ports 118 may be further apparent in FIG. 1D. The exit ports 230 are, in turn, in communication with vents 228, which allow transmission of combustion gases from the outer chamber 120 into the atmosphere. In some examples, the vents 228 can be separated by supports 226, but it will be appreciated that these are not required. In some embodiments, ports 230 are defined in a generally cylindrical bosses 225 that protrude radially outward from the outer wall 224 such that ports 230 are hidden from view when looking into the flash hider 200 from beyond the distal end 203. For example, the bosses 225 are substantially parallel to the central axis 10. Accordingly, ports 230 can be oriented so that gases enter each port 230 in a direction generally perpendicular to the central axis 10. In other embodiments, ports 230 can be positioned behind an obstruction, or otherwise can be oriented to preclude a line of sight into suppressor 100 through ports 230 when viewed looking into suppressor from the distal end 203 along or parallel to central axis 10. Eliminating a line of sight into ports 230 has been found to reduce the visible signature (flash) of the firearm.

The inner flash hider portion 216 communicates with the inner chamber 116 and reduces the audible and visible signatures (i.e., a report and a flash) from ignition of a propellant. As is shown in FIG. 7C, both the outer flash hider portion 220 (i.e., at vents 228) and the inner flash hider portion 216 have a cross-sectional profile that increases in size (e.g., diameter) toward the distal end. The increasing volume of the vents 228 and the inner flash hider portion 216 enable continued expansion of the ignition gases, further reducing the velocity and temperature of gas thus contributing to the reduction in the audible and visible signatures of combustion gases.

FIG. 7E illustrates a front perspective view showing a longitudinal section taken through the central axis of a flash hider, and some example flow paths that gases take through the flash hider 200, in accordance with an embodiment of the present disclosure. Gases may take one of many flow paths to exit the suppressor 100 to the environment. For example, gases from the outer chamber 120 can pass through a baffle port 118 in the terminal baffle 110F, through exit port 230, and then through vent 228 to the environment. Some gases flowing through the outer chamber 120 may collide with the distal wall 204 of the flash hider 200, turn, and then pass into vent 228. In another scenario, gases from the outer chamber 120 can pass through baffle port 118 in the terminal baffle 118F and curve around to enter the frustoconical passageway 218 of the inner flash hider portion 216. In another scenario, gases from the inner chamber 116 are deflected radially outward by gutter 140, pass through exit port 230, and then through vent 228 to the environment. In these examples, gas flow paths are represented by dashed lines; however, such flow paths are merely illustrative and do not prescribe any particular flow path. Numerous variations and flow paths are available, as will be appreciated.

Figure 8A:
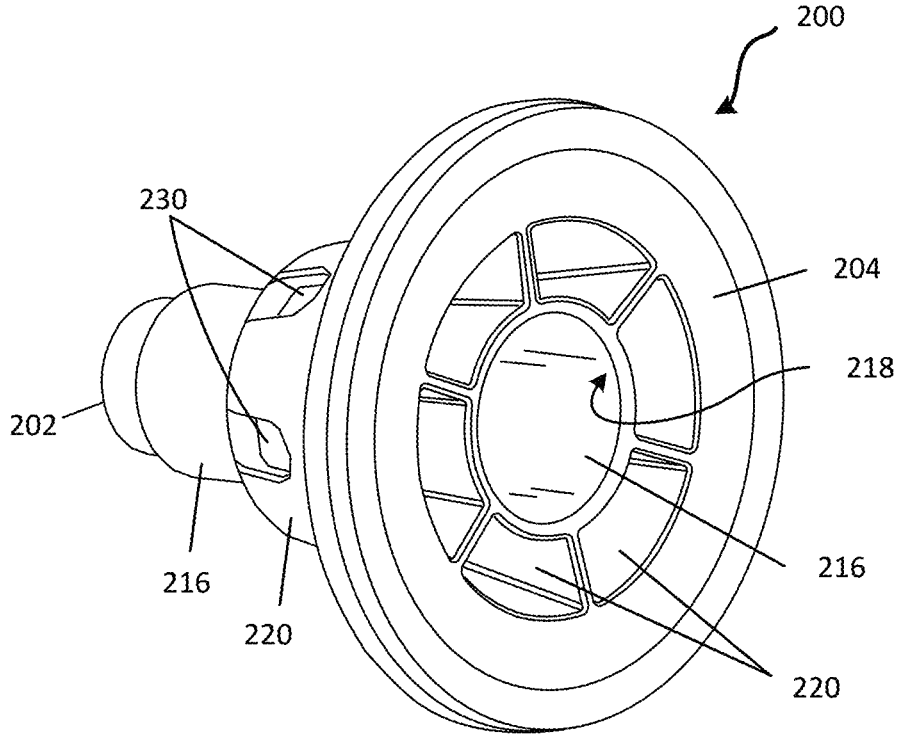
FIG. 8A illustrates a front perspective view of a flash hider with an inner flash hider portion and an outer flash hider portion, in accordance with an embodiment of the present disclosure.
Figure 8B:
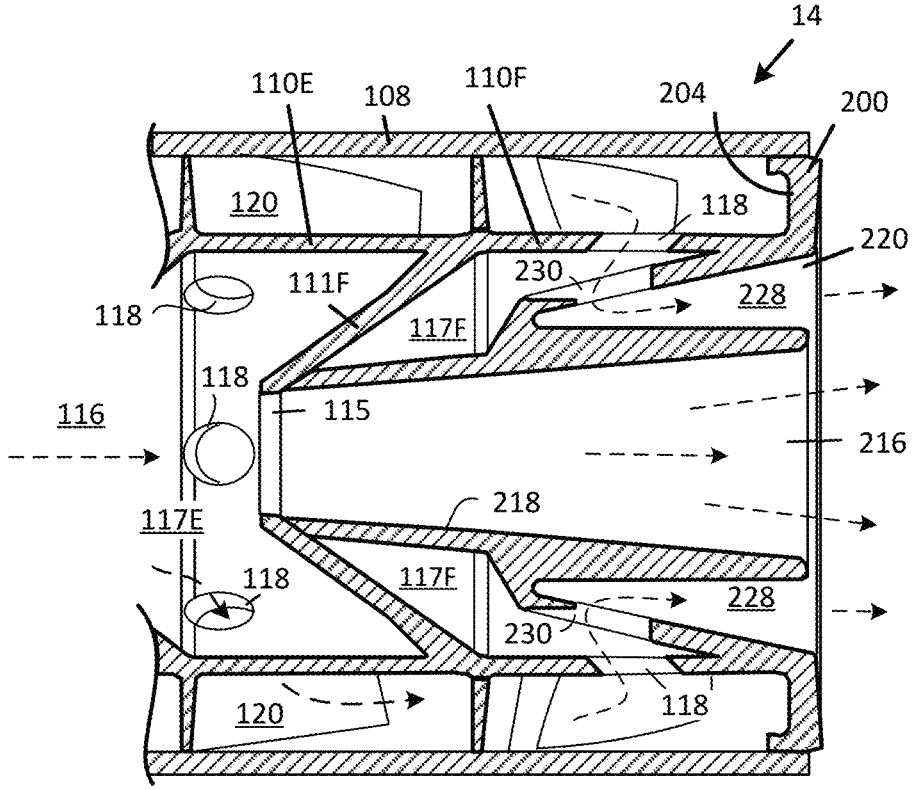
FIG. 8B illustrates a side view showing a longitudinal section of part of a suppressor that includes the flash hider of FIG. 8A, in accordance with an embodiment of the present disclosure.

FIG. 8A illustrates a front perspective view of a flash hider 200 with an elongated inner flash hider portion 216 that is configured to connect to the final baffle, in accordance with one embodiment. FIG. 8B illustrates a cross-sectional view of the distal end portion 14 of suppressor 100 with the flash hider 200 of FIG. 8A having an elongated inner flash hider portion 216. In this example embodiment, the flash hider 200 has an elongated frustoconical passageway 218 that extends and joins the central opening 115 of the final baffle (here, baffle 115F). The elongated inner flash hider portion 216 closes the last compartment 117F of the inner chamber 116 (defined between baffle 110F and distal wall 204) to direct communication with the inner flash hider portion 216. The result is that gases flowing through the outer chamber 120 do not mix with gases in the inner chamber 116 upon reaching the last baffle 110F. Gases in the next-to-last compartment 117E of the inner chamber 116 can either exit the suppressor 100 through the frustoconical passageway 218 of the inner flash hider portion 216, or the gases can flow into the outer chamber 120 via baffle ports 118 of baffle 110E. Gases flowing through the outer chamber 120 can enter and fill the last compartment 117F via final baffle port 118 and then exit through vents 228 of the outer flash hider portion 220.

The flash hider 200 of the embodiment shown in FIGS. 8A-8B prevents gases in the outer chamber 120 from mixing with gases in the inner chamber 116 just prior to being exhausted out of the suppressor 110 through the outer flash hider portion 220. The frustoconical passageway 218 of the inner flash hider portion 216 is connected to the expanding baffle wall 111 of baffle 110F such that frustoconical passageway 218 of the inner flash hider portion 216 directly communicates at its proximal end only with the inner chamber via central opening 115 of the terminal baffle (here, baffle 110F). As a result, the inner flash hider portion 216 only receives gases from the inner chamber 116 via central opening 115 of baffle 110F. Gases in the distal end of the outer chamber 120 can pass through the outer flash hider portion 220 by passing through terminal baffle ports 118 and exit port 230. As illustrated, gases passing through terminal baffle ports 118 can only exit through the outer flash hider portion 220 unless such gases return to the outer chamber 120, enter the inner chamber 116, and then flow through the inner flash hider portion 216 via central opening 115 of terminal baffle 110F. In such an embodiment, the inner flash hider portion 216 receives gases only from the inner chamber 116 (even if such gases have at one point traveled through the outer chamber 120). Similarly, the outer flash hider portion 220 only receives gases from the outer chamber 120 (even if such gases have at one point traveled through the inner chamber 116).

Figure 9A:
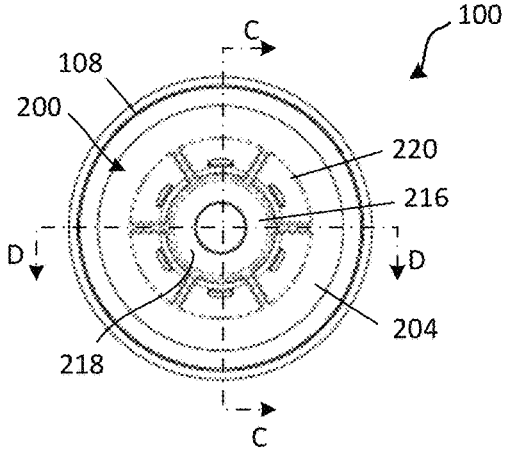
FIG. 9A illustrates a front view of a suppressor assembly showing the flash hider, in accordance with an embodiment of the present disclosure.
Figure 9B:
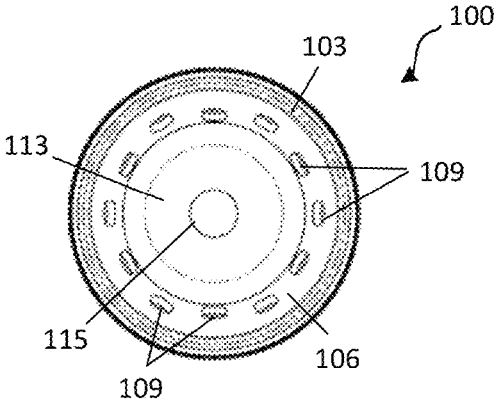
FIG. 9B illustrates a rear-end view of a suppressor assembly showing the diffusor, in accordance with an embodiment of the present disclosure.
Figure 9C:
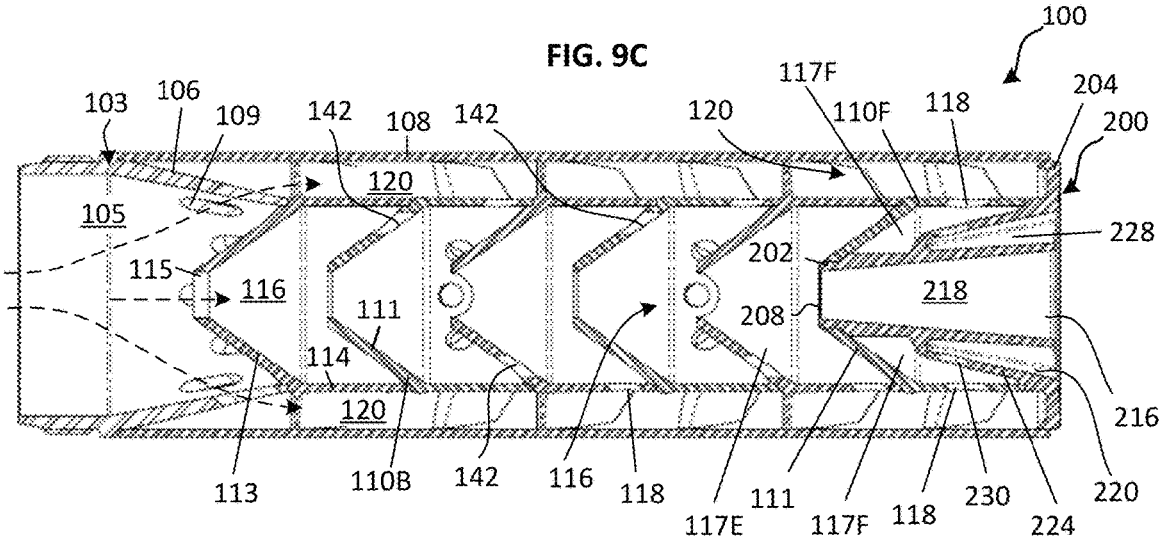
FIGS. 9C and 9D illustrate side and top views showing longitudinal sections taken along lines C-C and D-D, respectively, of FIG. 9A, in accordance with an embodiment of the present disclosure.
Figure 9D:
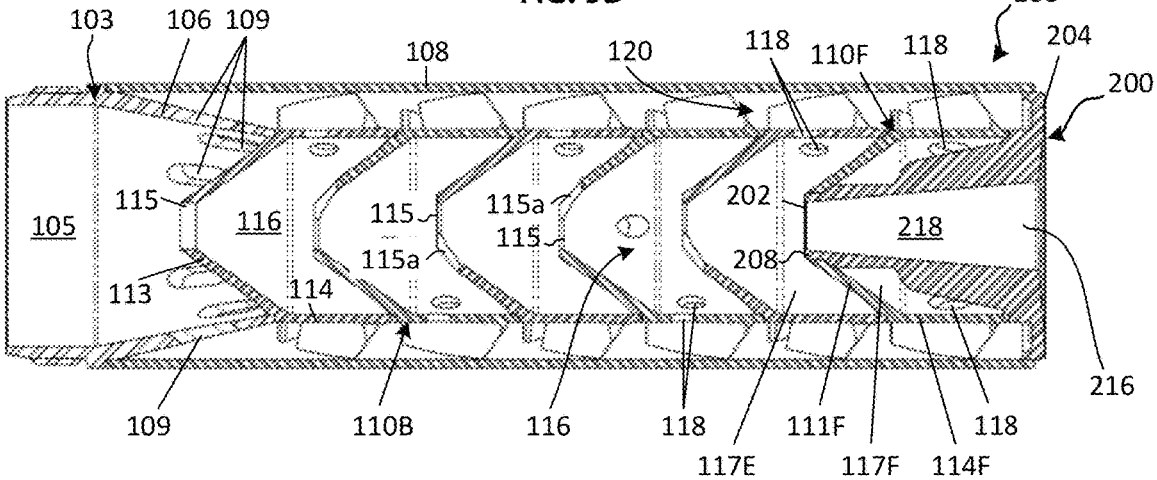

Referring now to FIGS. 9A-9D, various views show a suppressor 100 including a flash hider 200 and diffusor 103, in accordance with one embodiment of the present disclosure. FIG. 9A illustrates a distal end view of a suppressor 100 showing the flash hider 200. FIG. 9B illustrates a proximal end view of the suppressor 100 showing the diffusor 103. FIGS. 9C and 9D illustrate cross-sectional views of the suppressor 100 that includes the flash hider 200 and diffusor 103 shown in FIGS. 9A-9B, where the sections are taken along line C-C and line D-D, respectively, of FIG. 9A.

In this embodiment, the flash hider 200 includes an inner flash hider portion 216 and an outer flash hider portion 220.

Exit ports 230 place the outer chamber 120 in fluid communication with the vents 228 of the outer flash hider portion 220 via baffle ports 118 in terminal baffle 110F. Proximal end 202 defines a central opening 208 that places the inner chamber 116 in fluid communication with the frustoconical passageway 218 of the inner flash hider portion 216. The frustoconical passageway 218 of the inner flash hider portion 216 extends between and connects to the distal wall 204 and baffle body 114 of baffle 110F. The outer wall 224 of the outer flash hider portion 220 connects to an outside of the frustoconical passageway 218 and to the distal wall 204. For example, the outer wall 224 connects to a middle portion of the frustoconical passageway 218.

The tapered wall 106 of the diffusor 103 extends distally from a diffusor body 107 and reduces in diameter until it connects to the blast baffle 113 (note that the blast baffle 113 may also be referred to generally as the proximal baffle 110A.) In one embodiment, the tapered wall 106 connects to the blast baffle 113 at or near the junction between the expanding baffle wall 111 and the baffle body 114 of the blast baffle 113. In other embodiments, the tapered wall 106 connects along the expanding baffle wall 111 or other suitable location. As noted above, the tapered wall 106 defines a plurality of openings 109 distributed circumferentially.

As combustion gases enter the suppressor 100, they expand in the blast chamber 105 and then travel distally through the central opening 115 of the blast baffle 113 into the inner chamber 116 or through openings 109 into the outer chamber 120. In this embodiment, most of gases in the inner chamber 116 exit through the inner flash hider portion 216. In some instances, gases in the inner chamber 116 can pass through baffle ports 118 to the outer chamber 120 and then exit through the outer flash hider portion 220. Most of gases in the outer chamber 120 exit through the outer flash hider portion 220. In some instances, gases in the outer chamber 120 can pass through baffle ports 118 to the inner chamber 120 and exit through the inner flash hider portion 216.

Figure 10A:
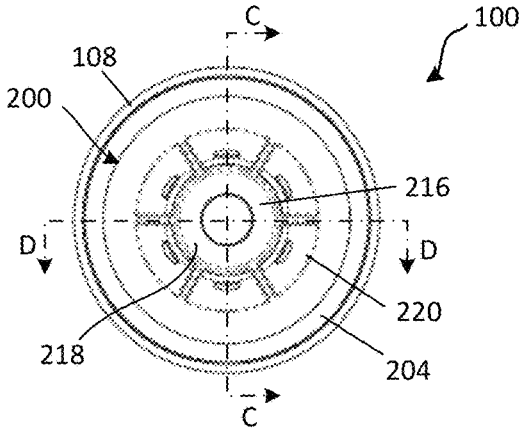
FIG. 10A illustrates a front view of a suppressor assembly showing the flash hider, in accordance with an embodiment of the present disclosure.
Figure 10B:
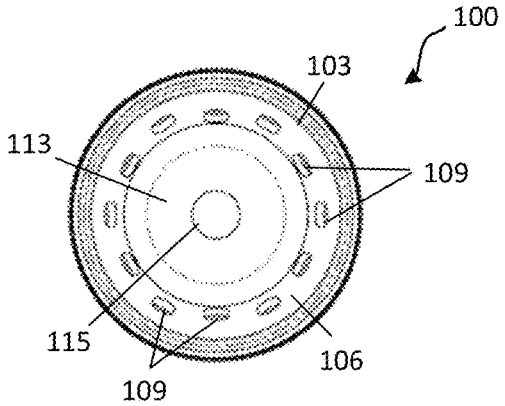
FIG. 10B illustrates a rear-end view of a suppressor assembly showing the diffusor, in accordance with an embodiment of the present disclosure.
Figure 10C:
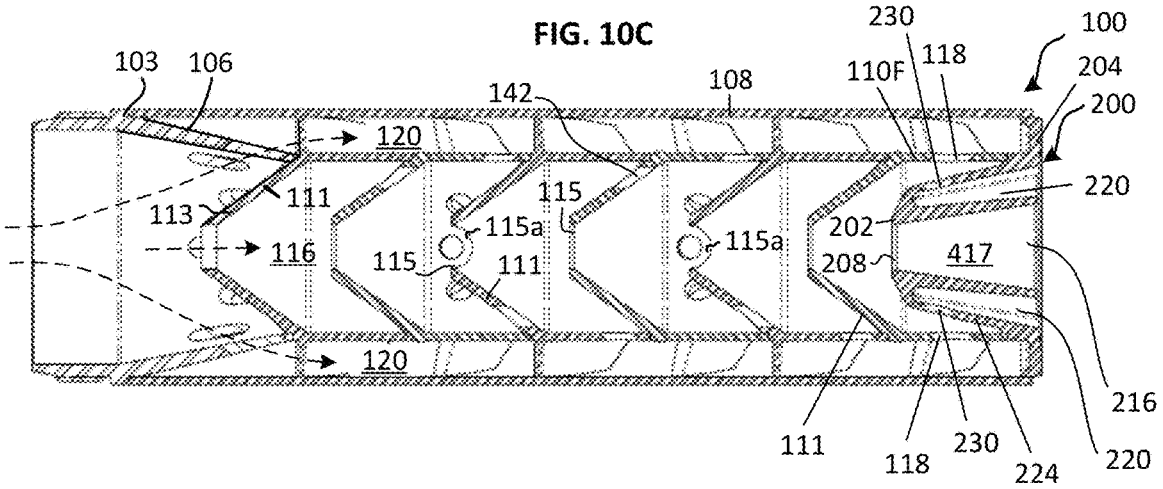
FIGS. 10C and 10D illustrate side and top views showing longitudinal sections taken along lines C-C and D-D, respectively, of FIG. 10A, in accordance with an embodiment of the present disclosure.
Figure 10D:
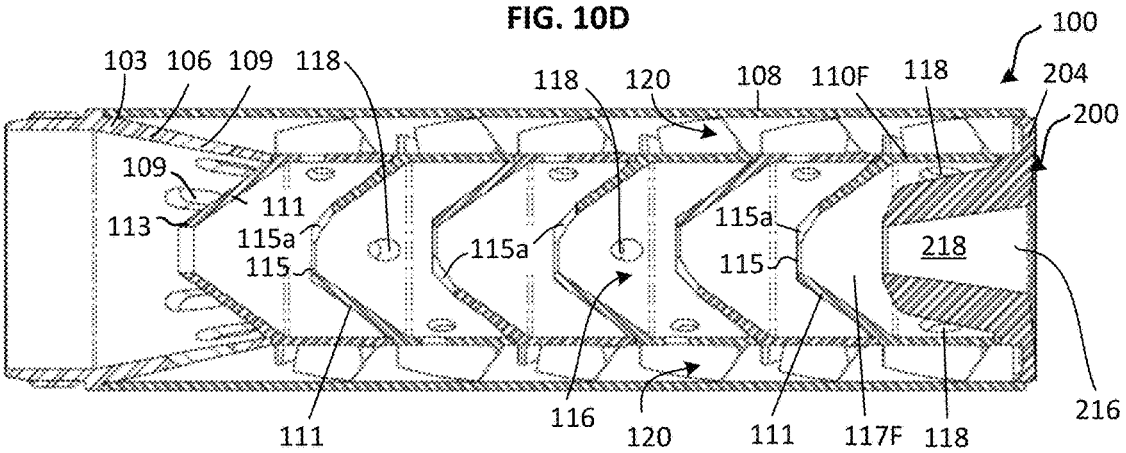

Referring now to FIGS. 10A-10D, various views show a suppressor 100 including a flash hider 200 and diffusor 103, in accordance with one embodiment of the present disclosure. FIG. 10A illustrates a distal end view of a suppressor 100 showing the flash hider 200 and FIG. 10B illustrates a proximal end view of the suppressor 100 showing the diffusor 103. FIGS. 10C and 10D illustrate cross-sectional views of the suppressor 100 that includes the flash hider 200 and diffusor 103 shown in FIGS. 10A-10B, where the sections are taken along line C-C and line D-D, respectively, of FIG. 10A.

In this embodiment, the flash hider 200 includes an inner flash hider portion 216 and an outer flash hider portion 220. Exit ports 230 place the outer chamber 120 in fluid communication with the vents 228 of the outer flash hider portion 220 via baffle ports 118 in terminal baffle 110F. Proximal end 202 defines a central opening 208 that places the inner chamber 116 in fluid communication with the frustoconical passageway 218 of the inner flash hider portion 216. The frustoconical passageway 218 of the inner flash hider portion 216 connects to the distal wall 204. The outer wall 224 of the outer flash hider portion 220 connects to an outside of the frustoconical passageway 218 and to the distal wall 204. For example, the outer wall 224 connects to the frustoconical passageway 218 adjacent the proximal end 202.

As discussed above, the tapered wall 106 of the diffusor 103 extends distally and connects to the blast baffle 113 along the expanding baffle wall 111, in accordance with one embodiment. In other embodiments, the tapered wall 106 connects along the blast baffle 113 or along the outer baffle wall 111. As noted above, the tapered wall 106 defines a plurality of openings 109 distributed circumferentially. Central openings 115 of at least some baffles include an off-axis recess 115*a* to divert gases in the inner chamber 116 away from the central axis 10.

Gases in the inner chamber 116 can exit either through the inner flash hider portion 216 or by passing through exit ports 230 and out through the outer flash hider portion 220. Gases in the outer chamber 120 can pass through baffle ports 118 in the terminal baffle 110F into the inner chamber 116 of the terminal baffle 110F. From the inner chamber 116 of the terminal baffle 110F, gases can then exit through the outer flash hider portion 220 via exit ports 230 or pass through the central opening 208 and out of the suppressor 100 through the inner flash hider portion 216.

Example Flash Hider Configurations

Referring now to FIGS. 11-21 various embodiments of flash hider 200 are shown, in accordance with some embodiments of the present disclosure. Any of the flash hiders 200 disclosed herein can be incorporated into a suppressor 100, whether as a permanent component or a removable component of the suppressor 100. As noted above, the flash hider 200 can be made as a single, monolithic structure with other components of the suppressor assembly 100, such as when made using additive manufacturing techniques (e.g., direct metal laser sintering). In other embodiments, the flash hider 200 can be a component that is welded or otherwise permanently or semi-permanently secured to the outer housing 108, for example. In yet other embodiments, the flash hider 200 can be a replaceable component that can be removed and exchanged with a different flash hider 200 as needed, such as when a rifle is to be used in a situation where more or less attenuation is desired for the visible or audible signature. In one such embodiment, the flash hider 200 includes threads around the rim 206, threaded sockets configured to receive fasteners, or other suitable structure for removably installing the flash hider 200 in the suppressor 100. Note that some features of the flash hiders shown in FIGS. 11-21 can be incorporated into the flash hider shown in FIGS. 7-10 and vice versa. For example, ports 230 in the flash hider embodiments of FIGS. 8-15 and 18 can be oriented to preclude a linear path from inside the suppressor 100 to the ambient through port 230, such as shown in the embodiment of FIGS. 7A-7E.

In some embodiments, flash hider 200 is integral to a suppressor 100 having reduced gas back flow, such as embodiments shown in FIGS. 7-15, 18, and 21. In other embodiments, such as shown in FIGS. 16, 17, 19, and 20, flash hider 200 is generally applicable to a suppressor 100 having an integral flash hider 200 and configured as needed for a given application. Numerous variations and embodiments will be apparent in light of the present disclosure.

Figure 11A:
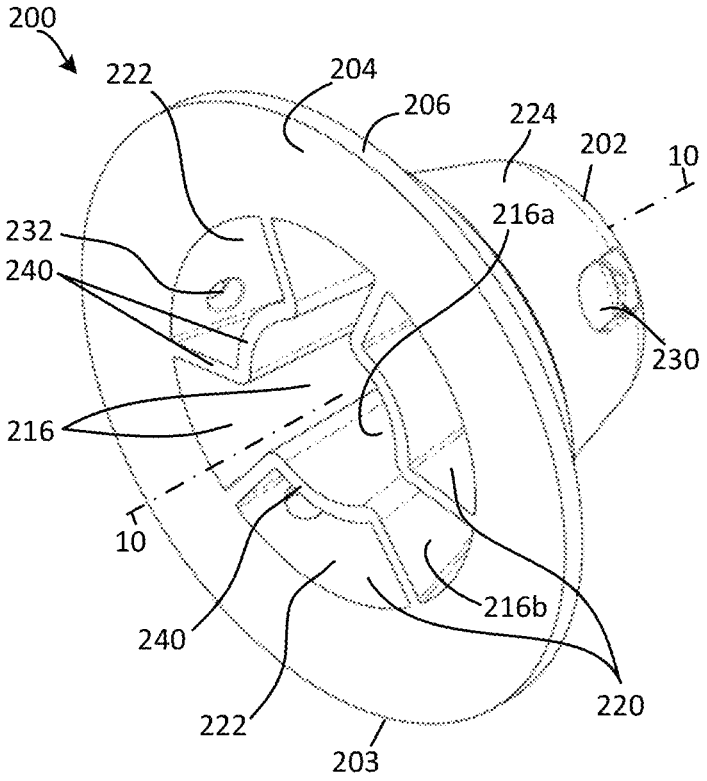
FIGS. 11A and 11B illustrate a front perspective view and a front view, respectively, of a flash hider with a first flash hider portion and a second flash hider portion, in accordance with an embodiment of the present disclosure.
Figure 11B:
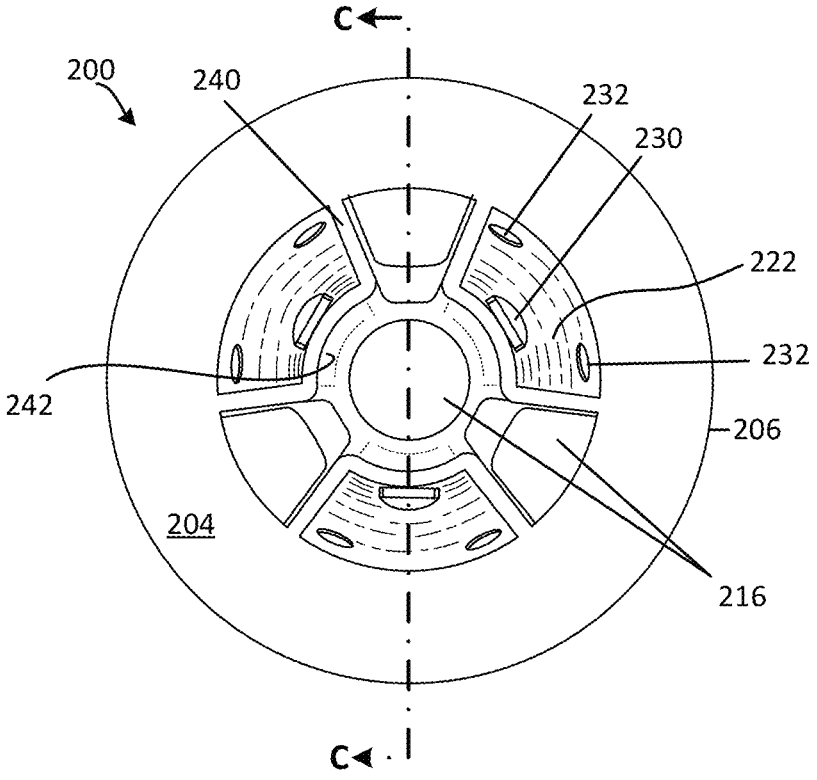
Figure 11C:
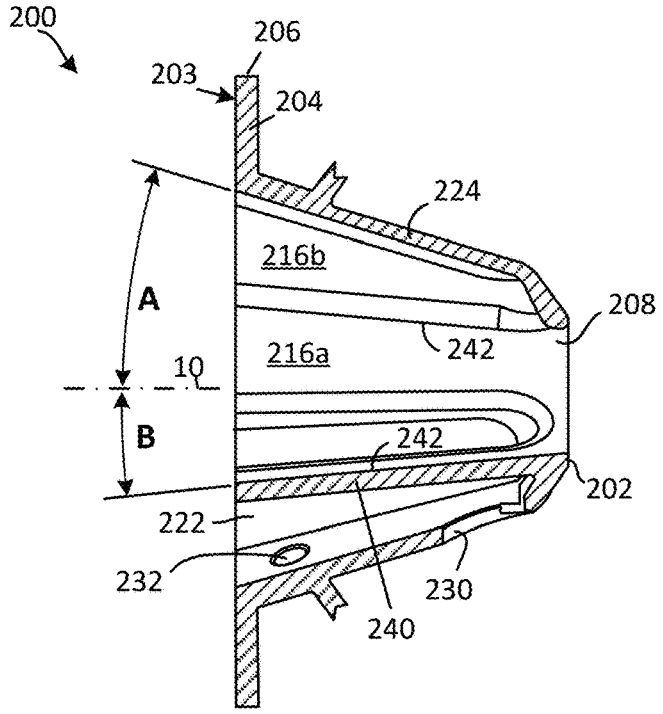
FIG. 11C illustrates a side view showing a longitudinal section of the flash hider as taken along line C-C of FIG. 11B, in accordance with an embodiment of the present disclosure.
Figure 11D:
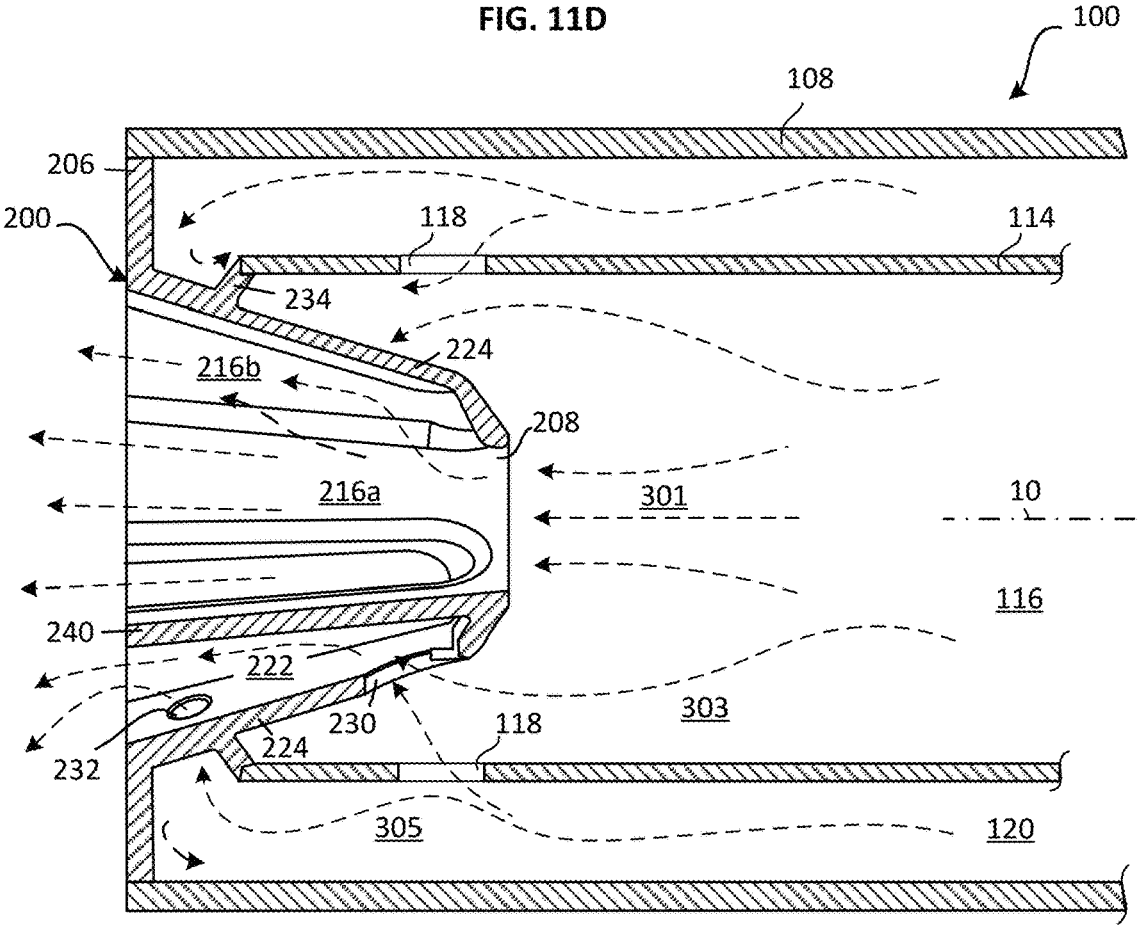
FIG. 11D illustrates a view showing a longitudinal section of the distal end portion of a suppressor that includes the flash hider of FIG. 11C, and shows example gas flow paths through the suppressor and flash hider, in accordance with an embodiment of the present disclosure.

FIGS. 11A-11D illustrate a flash hider 200 with a first flash hider portion 216 and a second flash hider portion 220, in accordance with an embodiment of the present disclosure. FIG. 11A is a front perspective view of flash hider 200, FIG. 11B is a front view, FIG. 11C is a side view showing a longitudinal section taken along line C-C of FIG. 11B, and FIG. 11D is a side view showing a longitudinal section of part of a suppressor assembly, and also showing example gas flow paths through the flash hider 200 when incorporated as part of a suppressor assembly 100. The flash hider 200 extends along a central axis 10 from a proximal end 202 to a distal end 203. An outer wall 224 extends between and connects the proximal end 202 and distal end 203. The proximal end 202 defines a central opening 208 for passage of a projectile and for gases to enter the first flash hider portion 216. Propellant gases exit through the distal end 203, which, in this embodiment, includes a flange or distal wall 204 extending radially outward to a rim 206. In some embodiments, the rim 206 can be connected to a suppressor housing 108, such as by welding or a threaded connection.

As can be seen in the side view of FIG. 11C, the outer wall 224 defines an expanding volume as it extends distally. In this example, the outer wall 224 extends from the central opening 208 to the distal wall 204. The outer wall 224 directs propellant gases away from the central axis 10 and controls the expansion of the propellant gases. In some embodiments, the outer wall 224 has a frustoconical shape that defines an outer wall angle A with respect to the central axis 10. Examples of acceptable values for the outer wall angle A include 10-30°, 15°-20°, and 16-18°. In other embodiments, the outer wall 224 can have other cross-sectional shapes, such as a square or rectangle, a hexagon, or other polygonal or elliptical shape. The outer wall 224 (or portions thereof) can be linear or non-linear between the proximal end 202 and the distal end 203. Examples of a non-linear outer wall 224 include a curved (e.g., elliptical or parabolic) or stepped profile.

Gases enter the first flash hider portion 216 through the central opening 208. In this example, the first flash hider portion 216 includes both an inner volume 216*a* and a plurality of outer volumes 216*b*, where the outer volumes 216*b* are continuous with and communicate with the inner volume 216*a*. The inner volume 216*a* is circumscribed by and defined in part by the radially inner faces 242 of the flow partitions 240. Each outer volume 216*b* is radially between the inner volume 216*a* and the outer wall 224. Each outer volume 216*b* is also located circumferentially between adjacent flow partitions 240 of the second flash hider portion 220. For example, the inner volume 216*a* has a frustoconical geometry extending along the central axis 10. In some such embodiments, the inner faces 242 of the flow partitions 240 have an inner wall angle B with the central axis 10 from 4-11°, including 5-8°, or 6-7°, for example. Such a value for the inner wall angle B has been found to slow down propellant gases as they exit to the environment as well as to reduce the amount of hot propellant gases that mix with ambient air/oxygen. Accordingly, and without being constrained to any particular theory, it is believed that such an inner wall angle B permits adequate gas expansion yet also desirably reduces the size of a "Mach disk" or "flow diamond"—appearing as an orange or red flash—as propellant gases transition from supersonic to subsonic flow.

A first portion of gases enters the first flash hider portion 216 through the central opening 208 and flows through the inner volume 216*a* generally along the central axis 10. A second portion of gases enters the first flash hider portion 216 through the central opening 208 and can expand into the outer volumes 216*b*, constrained by the outer wall 224. In this example, the outer volumes 216*b* generally resemble sectors of an annular volume between the inner volume 216*a* and the outer wall 224.

In some embodiments, the radially outer volumes 222 of the second flash hider portion 220 are defined by and are isolated from the first flash hider portion 216 by flow partitions 240 connected along their lengths to the inside surface of the outer wall 224. In this example, each flow partition 240 connects to the proximal end 202 of the flash hider 200 adjacent the central opening 208 and extends forward to the distal end 203. Accordingly, the flow partition 240 isolates the radially outer volume 222 from the first flash hider portion 216.

In one example, each flow partition 240 generally has a U shape as viewed from the distal end 203, where a radially outer volume 222 is defined between the flow partition 240 and the outer wall 224. The radially outer volumes 222 are distributed and spaced circumferentially about the central axis 10. In some embodiments, all flow partitions 240 have the same dimensions and are evenly distributed about the central axis 10, although this is not required.

Gases can enter the radially outer volumes 222 of the second flash hider portion 220 via ports 230 in the proximal portion of the outer wall 224, rather than through the central opening 208, in accordance with some embodiments. Optionally, the distal end portion of the outer wall 224 defines one or more distal ports 232 in communication with one or more of the radially outer volumes 222 of the second flash hider portion 122. To distinguish from distal ports 232, ports 230 may be referred to as first ports 232 or proximal ports 232 in some embodiments. When the flash hider 100 is part of a suppressor assembly, some or all of the gases flowing through the suppressor along a radially outer flow path can enter the second flash hider portion 220 through proximal ports 230 and/or through distal ports 232 (when present). Absent any openings through the flow partition 240 or gases entering the second flash hider portion 220 from the distal end 203, gases entering the central opening 208 are isolated from and cannot flow through the radially outer volumes 222 of the second flash hider portion 220.

One advantage of venting radially outer volumes or off-axis flow of the suppressor 100 is to reduce pressure of the gases flowing along the central axis 10. In doing so, flash is also reduced. Venting through the second flash hider portion 220 also can reduce pressure in the suppressor and therefore reduce back flow of gases into the firearm's chamber, such as when used with semi-automatic or automatic rifles. Further, isolating the gas flow through the second flash hider portion 220 from the first flash hider portion 216 can inhibit mixing and turbulence of gases exiting the flash hider 200, and therefore reduces the visible signature of the firearm, as will be appreciated.

Referring now to FIG. 11D, a cross-sectional view taken along the central axis 10 illustrates example gas flow paths through a suppressor assembly 100 that includes the flash hider 200 of FIGS. 11A-11C. The flash hider 200 is secured to the distal end of the suppressor outer housing 108. For example, the outer housing 108 connects to the rim 206 of the flash hider 200 by being integrally formed as a single part, or as separate components secured together by welding, a threaded interface, or other suitable attachment method. An inner wall of the suppressor assembly 100 (e.g., formed by baffle bodies 114 of baffle stack 110) connects to the outer wall 224 of the flash hider 200, such as at a flange 234 extending outward from the outer wall 224. The suppressor 100 has an outer chamber 120 between the inner wall (e.g., baffle body 114 of baffle stack 110) and the outer housing 108. Note that the flow paths depicted in broken lines are shown for illustration purposes and may not accurately represent the actual flow paths. Also, features on the inside of the suppressor 100 (e.g., baffles, vanes, etc.) are not illustrated.

When a shot is fired, gases 301 flowing along the central axis 10 enter the flash hider 200 through the central opening 208. A portion of gases 301 expands into the outer volume 216*b* of the first flash hider portion 216. Another portion of gases 301 expands to a lesser extent as it flows along the frustoconical inner volume 216*a*. The flash hider's flow partitions 240 extending radially inward from the outer wall 224 function to disperse and cool propellant gases passing through the first flash hider portion 216. The flow partitions 240 can extend linearly or helically along the outer wall 224. In combination, the outer volumes 216*b* of the first flash hider portion 216 provide radial expansion of propellant gases passing through the central opening 208 and direct a portion of the expanding propellant gases away from the central axis 10. At the same time, the inner volume 216*a* directs and controls the expansion of gases traveling along the central axis 10.

A portion of gases 303 flowing along an off-center flow path in the inner chamber 116 of the suppressor 100 can enter the second flash hider portion 220 through the proximal vent 230 and travel through radially outer volumes 222. A portion of gases 305 in the outer chamber 120 of the suppressor 100 may pass through an opening in the inner wall of the suppressor 100 (e.g., baffle port 118) and mix with off-axis gases 303, or vice versa. In this example, gases 305 flowing through the outer chamber 120 can enter the radially outer volume 222 of the second flash hider portion 220 via distal port 232.

Note that the radially outer volume 222 of the second flash hider portion 220 is physically separated from the inner volume 216*a* by flow partition 240 that connects to the outer wall 224 and defines the radially outer volume 222. In some embodiments, the sides of the flow partitions 240 extend generally radially toward the central axis 10, providing larger radially outer volumes 222 and smaller outer volumes 216*b* of the first flash hider portion 216. Also, as noted above, using the second flash hider portion 220 to vent the suppressor's outer chamber 120 and off-axis gases 303 in the inner chamber 116 can reduce pressure of gases 301 exiting the suppressor through the central opening 208. Forward venting of secondary gas flows can reduce pressure build-up in the suppressor 100, which, especially for semi-automatic and automatic weapons, can reduce gas flow backward into the chamber when the action cycles. Reducing pressure in the suppressor 100 also reduces velocity and turbulence of the central gas flow, and in turn, reduces the size of the Mach disk.

Figure 12A:
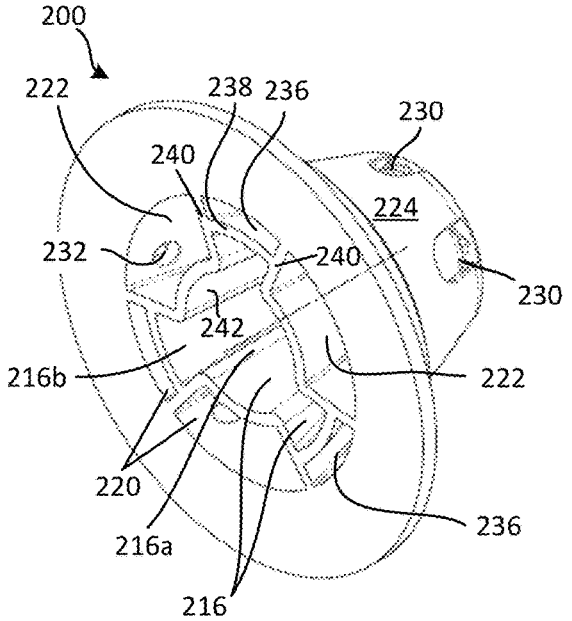
FIGS. 12A-12B illustrate a front perspective view and a front view, respectively, of a flash hider having first and second flash hider portions, where the second flash hider portion includes radially outer volumes and secondary radially outer volumes, in accordance with another embodiment of the present disclosure.
Figure 12B:
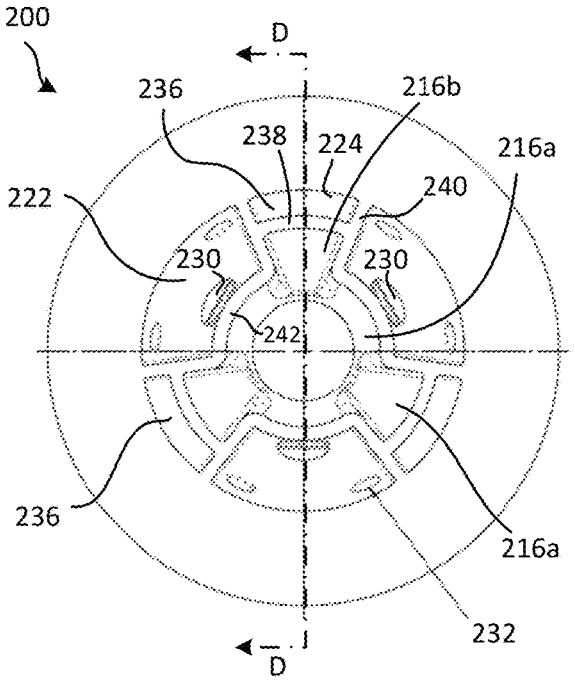
Figure 12C:
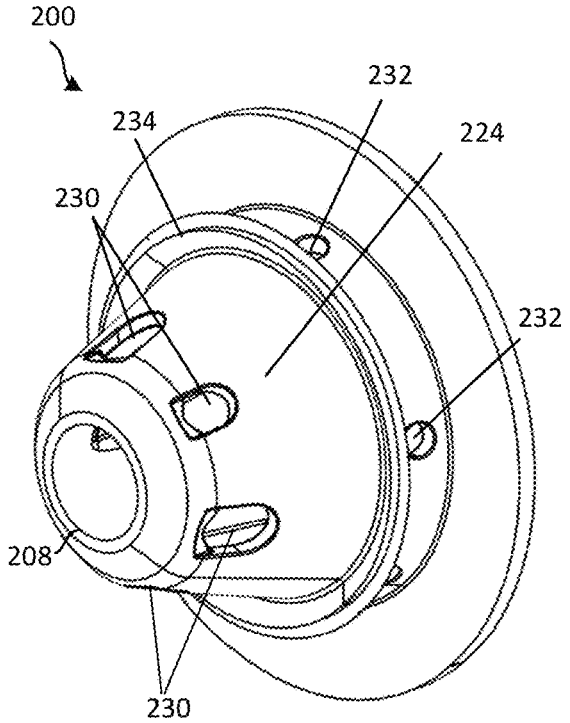
FIG. 12C illustrates a rear perspective view of the flash hider of FIGS. 12A-12B, in accordance with an embodiment of the present disclosure.
Figure 12D:
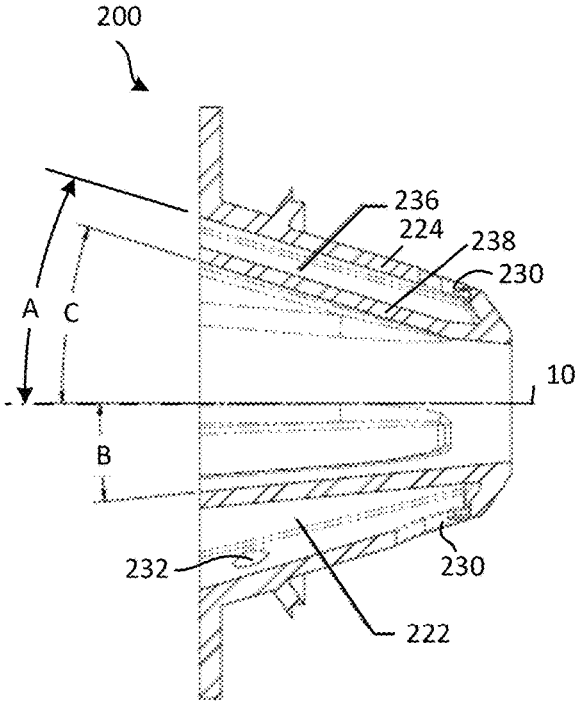
FIG. 12D illustrates a side view showing a longitudinal section of the flash hider as taken along line D-D of FIG. 12B, in accordance with an embodiment of the present disclosure.

Referring now to FIGS. 12A-12D, various views illustrate flash hider 200 with a first flash hider portion 216 and a second flash hider portion 220, in accordance with another embodiment of the present disclosure. FIG. 12A shows a front perspective view, FIG. 12B shows a front view, and FIG. 12C shows a rear perspective view, and FIG. 12D illustrates a side view showing a longitudinal section taken along line D-D of FIG. 12B. This example embodiment has some features common to those in the embodiment of FIGS. 11A-11D. One difference, however, is that the second flash hider portion 220 includes secondary radially outer volumes 236 in addition to the (primary) radially outer volumes 222. In general, the secondary radially outer volumes 236 are shown as being smaller than the radially outer volumes 222, but this is not required. The secondary radially outer volumes 236 are interspersed circumferentially with radially outer volumes 222 along the outer wall 224.

In the example of FIGS. 12A-12D, each of the secondary radially outer volumes 236 is defined in part by a circumferential wall segment 238 connecting the flow partitions 240 of adjacent radially outer volumes 222. For example, the circumferential wall segment 238 divides the open region between adjacent flow partitions 240 into radially inner and radially outer portions: the radially inner portion of the region between adjacent flow partitions 240 is an outer volume 216*b* of the first flash hider portion 216 and the radially outer portion of the region is a secondary radially outer volume 236. Note that the circumferential wall segments 238 are located radially between the radially inner face 242 of the flow partitions 240 and the outer wall 224, in accordance with some embodiments. Optionally, the outer wall 224 includes a flange 234 or like structure on its outer surface for connecting to an inner wall of a suppressor 100 (e.g., baffle body 114 of baffle stack 110, shown in FIG. 1B).

As shown in the side cross-sectional view of FIG. 12D, for example, the secondary radially outer volume 236 is bounded in part by circumferential wall segment 238 that is substantially parallel to the outer wall 224. In some embodiments, the circumferential wall segment 238 defines an angle C with respect to the central axis 10 that has a value from that of inner wall angle B (e.g., 6°) to that of outer wall angle A (e.g., 17°). In one example, both angle C and angle A are from 14-20° where angle A is equal to or greater than angle C.

In this example, the flash hider 100 includes three radially outer volumes 222 and three secondary radially outer volumes 236, each of which receives gases through an individual port 230 in the proximal portion of the outer wall 224. In other embodiments, the flash hider 200 can include more or fewer radially outer volumes 222 and secondary radially outer volumes 236, such as two, four, five, or other quantity. In yet other embodiments, the number of secondary radially outer volumes 236 need not equal the number of radially outer volumes 222. In one such embodiment, the flash hider 200 has secondary radially outer volumes 236 only between some pairs of radially outer volumes 222. For example, the flash hider 200 includes four radially outer volumes 222 rotationally distributed every ninety degrees. Secondary radially outer volumes 236 are arranged 180° from each other between opposite pairs of adjacent radially outer volumes 222. In another embodiment, the secondary radially outer volumes 236 can be concentrated in a certain region, such as along an upper or lower portion of the flash hider 200. Numerous variations and embodiments will be apparent in light of the present disclosure.

In this example, the sides of the flow partitions 240 extend generally radially, providing larger radially outer volumes 222 and smaller secondary radially outer volumes 236. This geometry also increases the volume ratio of the radially outer volume 222 to secondary radially outer volume 236. Accordingly, to promote greater gas flow through the relatively larger radially outer volumes 222, ports 230 can have a relatively larger size for radially outer volumes 222 and a relatively smaller size for secondary radially outer volumes 236, such as shown in FIG. 12C, but this is not required. Optionally, flash hider 200 defines one or more distal ports 232 in communication with some or all of the radially outer volumes 222 of the second flash hider portion 220. Distal ports 232 can be useful to vent gases in the suppressor's 100 radially outer chamber 120 (e.g., shown in FIG. 11D) through the second flash hider portion 220. Although not illustrated in FIGS. 12A-12D, distal ports 232 can also or alternately be defined in outer wall 224 to communicate with the secondary radially outer volumes 236. Numerous variations and embodiments will be apparent in light of the present disclosure.

In some embodiments, the secondary radially outer volumes 236 can have a reduced radial dimension, a reduced circumferential width, or both, compared to the radially outer volumes 222. The value of angle C contributes to the volume of the secondary radially outer volumes 236. The reduced radial size and/or reduced circumferential width may result in a reduced volume compared to that of the radially outer volumes 222, as will be appreciated. In one embodiment, each secondary radially outer volume 236 has a volume that is less than two thirds of one radially outer volume 222, including less than one half, less than one third, less than one quarter, from one quarter to two thirds, one quarter to one half, lone quarter to one third, one third to two thirds of one radially outer volume 222. Numerous variations and embodiments will be apparent in light of the present disclosure.

Figure 13A:
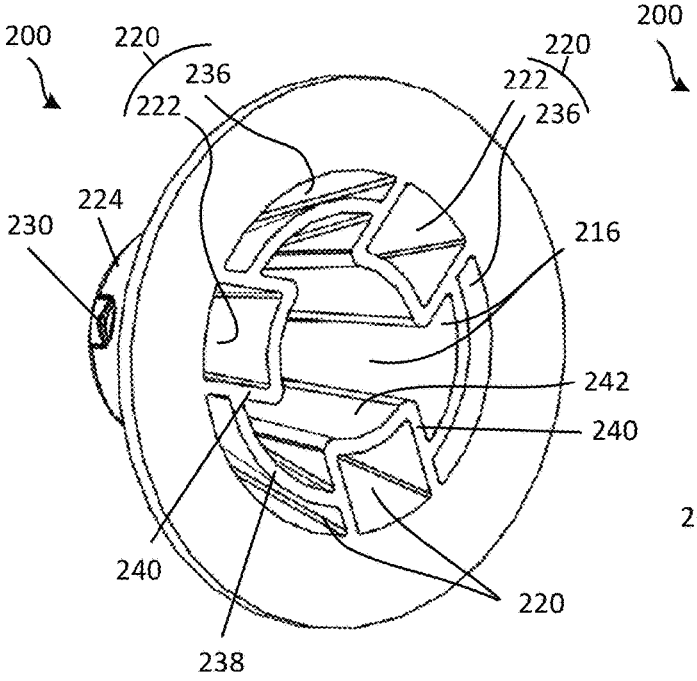
FIGS. 13A-13D illustrate various views of a flash hider having first and second flash hider portions, where the second flash hider portion includes radially outer volumes and secondary radially outer volumes, in accordance with another embodiment of the present disclosure.
Figure 13C:
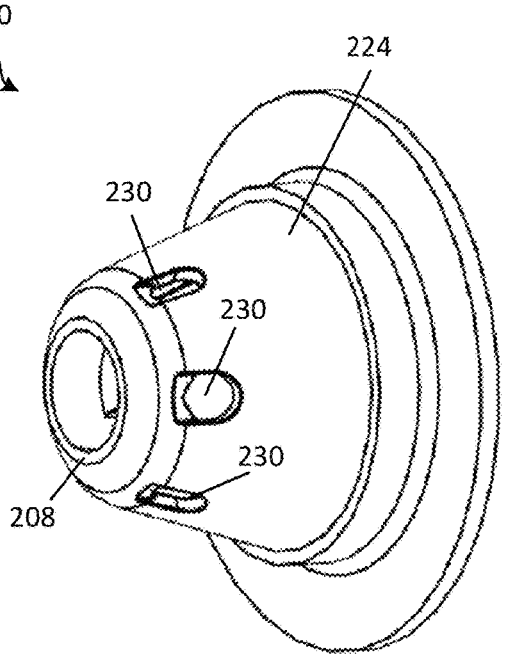
Figure 13B:
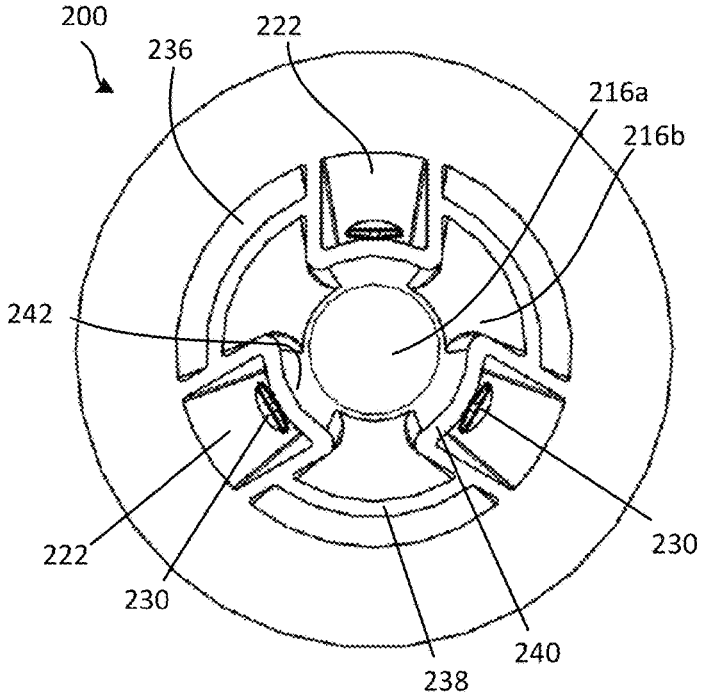
Figure 13D:
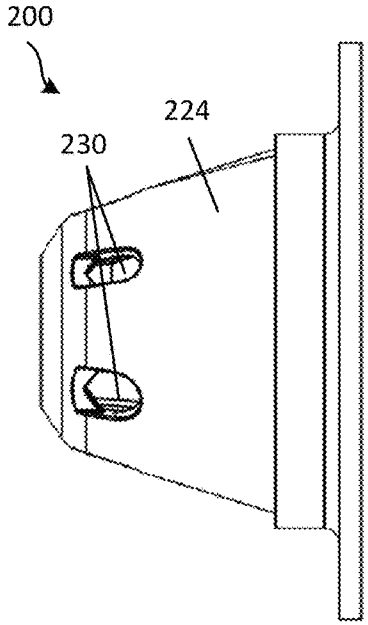

Referring now to FIGS. 13A-13D, various views illustrate a flash hider 200 with first flash hider portion 216 and second flash hider portion 220, in accordance with another embodiment of the present disclosure. FIG. 13A shows a front perspective view, FIG. 13B shows a rear perspective view, FIG. 13C shows a front view, and FIG. 3D shows a side view. As with the embodiment of FIGS. 12A-12D, the first flash hider portion 216 includes inner volume 216*a* and outer volumes 216*b*. Inner volume 216*a* is circumscribed by the radial inner faces 242 of flow partitions 240. In this example, the inner volume 216*a* has a frustoconical shape circumscribed by and defined in part by the radially inner faces 242 of the flow partitions 240. The outer volumes 216*b* of the first flash hider portion 216 are continuous with the inner volume 216*a* and are interspersed circumferentially with flow partitions 240 about the inner volume 216*a*.

The second flash hider portion 220 includes radially outer volumes 222 and secondary radially outer volumes 236, which are interspersed along the outer wall 224. Together with a portion of the outer wall 224, each flow partition 240 defines a radially outer volume 222 of the second flash hider portion 220. Each radially outer volume 222 is physically separated from the first flash hider portion 216 by the flow partition 240 and receives gases through a port 230 in a proximal portion of the outer wall 224.

In this example, each flow partition 240 generally has a rectangular U shape. A circumferential wall segment 238 extends between and connects adjacent flow partitions 240. Each secondary radially outer volume 236 is located radially between the circumferential wall segment 240 and the outer wall 224, and circumferentially between adjacent flow partitions 240. In this example, the flash hider 200 has three radially outer volumes 222 interspersed with three secondary radially outer volumes 236. Also, each radially outer volume 222 has an approximately square cross-sectional shape with generally parallel. Each secondary radially outer volume 236 has the shape of an arcuate, elongated slot. Other geometries are acceptable.

Figure 14A:
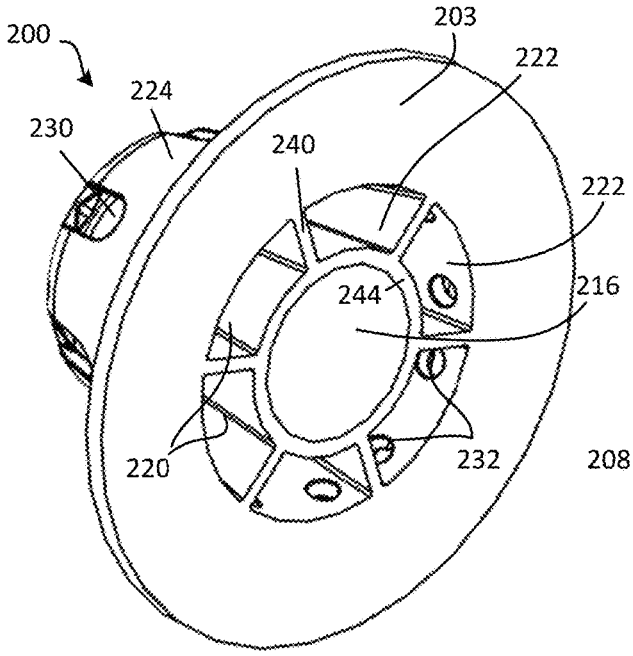
FIGS. 14A-14D illustrate various views of a flash hider having a first flash hider portion and a second flash hider portion, where the second flash hider portion has a plurality of radially outer volumes surrounding the inner volume of the first flash hider portion, in accordance with an embodiment of the present disclosure.
Figure 14B:
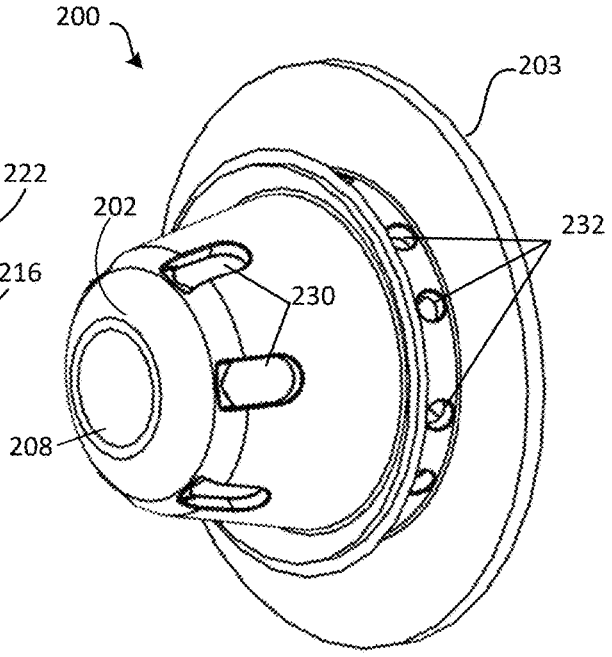
Figure 14C:
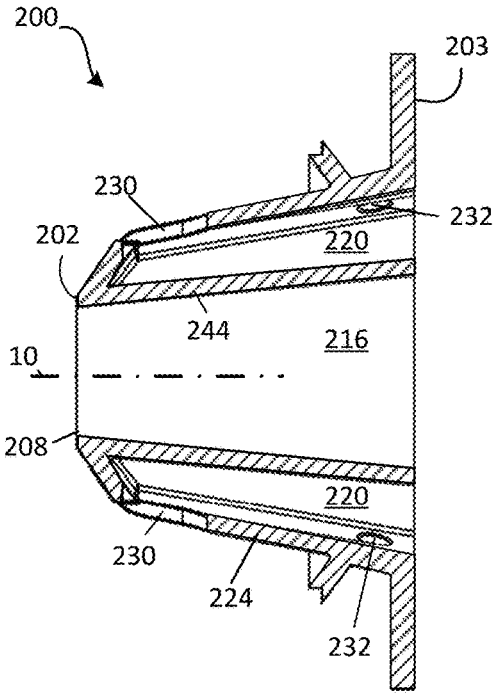
Figure 14D:
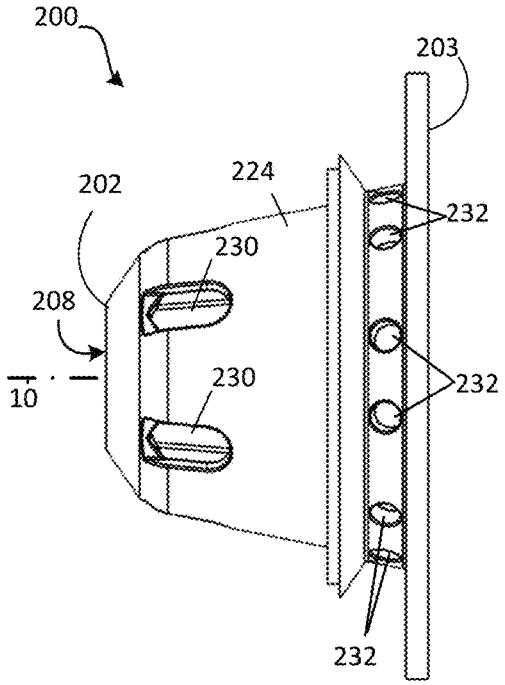

Referring now to FIGS. 14A-14D, various views illustrate flash hider 200 with first flash hider portion 216 and second flash hider portion 220, in accordance with another embodiment of the present disclosure. FIG. 14A shows a front perspective view, FIG. 14B shows a rear perspective view, FIG. 14C shows a side view showing a longitudinal section taken along the central axis 10, and FIG. 14D is a side view.

In this example, the flash hider 200 includes an outer wall 224 and an inner wall 244 coaxially arranged within the outer wall 224. Both the outer wall 224 and the inner wall 244 have a frustoconical shape, but other geometries are acceptable provided that each wall provides an expanding volume for gases flowing through the flash hider 200 to distal end 203. Note that inner wall 244 may define the frustoconical passageway 218 in some embodiments discussed above. The first flash hider portion 216 is defined within the inner wall 244 and extends along the central axis 10. Gases enter the first flash hider portion 216 via the central opening 208 at the proximal end 202 and can expand as permitted and controlled by the inner wall 244.

The second flash hider portion 220 is radially between the inner wall 244 and the outer wall 224 and generally has an annular shape. Gases enter the second flash hider portion 220 via proximal vent openings 230. As shown in FIG. 14C, the second flash hider portion 220 is physically separated from the first flash hider portion 216 by inner wall 224. The second flash hider portion 220 can be divided into a plurality of radially outer volumes 222 by flow partitions 240 extending radially between and connecting inner wall 244 and outer wall 224. Flow partitions 240 provide structural stability between inner wall 244 and outer wall 224 and may also reduce turbulence of gas flowing through the second flash hider portion 220, in accordance with some embodiments. In the example shown, each flow partition 240 defines separate radially outer volumes 222 between the inner wall 244 and the outer wall 224, where adjacent radially outer volumes 222 are separated along their entire axial lengths between proximal end 202 and distal end 203.

In other embodiments, some or all of the flow partitions 240 can be configured to permit some amount of fluid communication between adjacent radially outer volumes 222. In one such embodiment, flow partitions 240 extend radially between the inner wall 244 and the outer wall 224 adjacent the distal end 203 and extend rearward towards the proximal end 202 along only a portion of the axial distance. In another embodiment, one or more flow partitions 240 define one or more openings that allow gas flow laterally between adjacent radially outer volumes 222.

In the example of FIGS. 14A-14D, flash hider 100 has six radially outer volumes 222 of equal size that are distributed around the outside of the first flash hider portion 216. More or fewer radially outer volumes 222 can be used, and such volumes need not be of identical size. For example, second flash hider portion 220 can be divided into two, three, four, five, six, seven, eight, or any other number of radially outer volumes 222. In some embodiments as discussed in more detail below, flow partitions 240 may be omitted such that second flash hider portion 220 is a single volume located radially between inner wall 244 and outer wall 224 (e.g., shown in FIGS. 19A-19D). Although not required, each proximal port 230 communicates with a single radially outer volume 222. In other embodiments, proximal ports 230 may deliver gases to two or more radially outer volumes 222. Numerous variations and flow paths can be used, as will be appreciated.

Figure 15A:
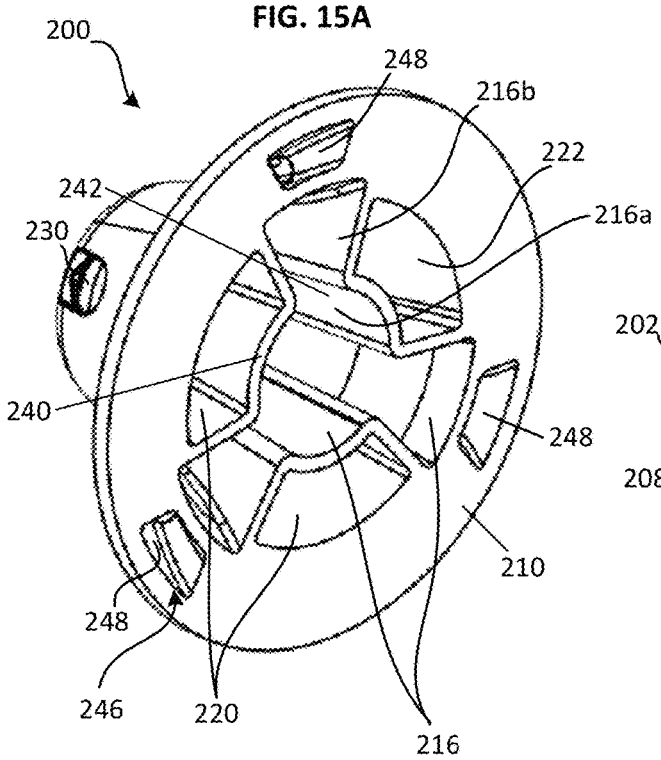
FIGS. 15A-15D illustrate various views of a flash hider having first, second, and third flash hider portions, where the first flash hider portion includes an inner volume and outer volumes, the second flash hider portion includes radially outer volumes interspersed with the outer volumes of the first flash hider portion, and the third flash hider portion includes passageways through the distal wall of the flash hider, in accordance with another embodiment of the present disclosure.
Figure 15B:
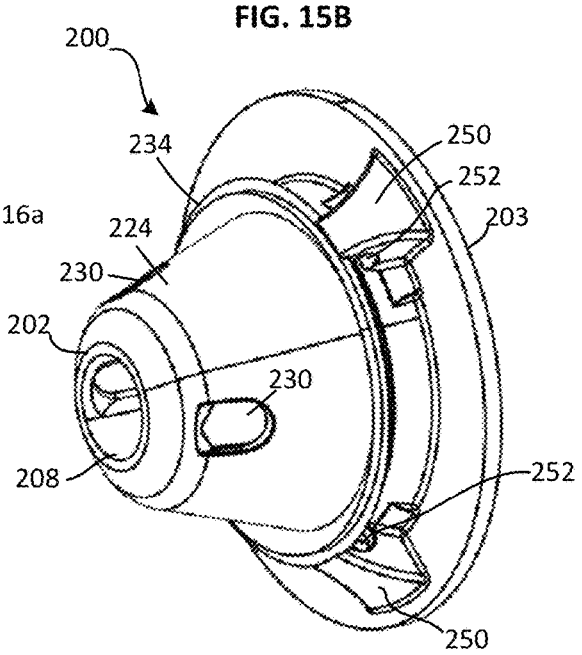
Figure 15C:
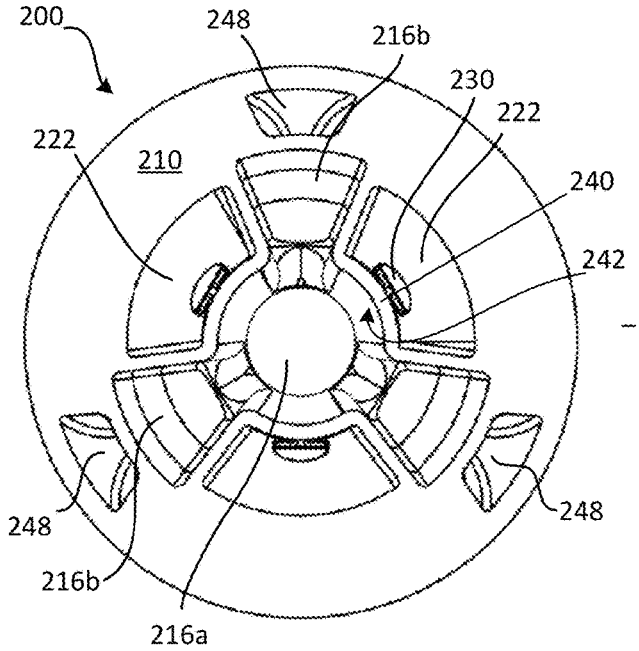
Figure 15D:
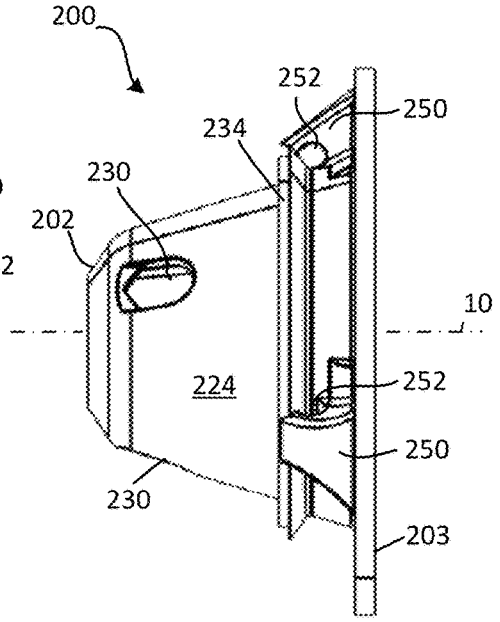

Referring now to FIGS. 15A-15D, various views illustrate a flash hider 200 having first, second, and third flash hider portions, in accordance with another embodiment of the present disclosure. FIG. 15A shows a front perspective view, FIG. 15B shows a rear perspective view, FIG. 15C shows a front view, and FIG. 15D shows a side view. Similar to some embodiments discussed above, flash hider 200 includes a first flash hider portion 216 that includes an inner volume 216*a* circumscribed by and defined in part by radially inner faces 242 of U-shaped flow partitions 240 connected to the outer wall 224. In this example, the inner volume 216*a* has a frustoconical shape that expands in volume moving towards the distal end 203. The first flash hider portion 216 also includes outer volumes 216*b* positioned circumferentially between adjacent flow partitions 240, where the outer volumes 216*b* are continuous with the inner volume 216*a*. Similar to embodiments discussed above, the outer volumes 216*b* allow propellant gases to expand toward the outer wall 224 and direct propellant gases away from the central axis 10. The outer volumes 216*b* provide is a greater amount of radial expansion than permitted alone by the radially inner faces 242 of the inner volume 216*a*.

The second flash hider portion 220 includes a plurality of radially outer volumes 222 arranged in a circumferentially spaced-apart relationship along the outer wall 224. The radially outer volumes 222 are circumferentially interspersed with outer volumes 216*b* of the first flash hider portion 216. For example, flow partitions 240 generally having a U shape connect to the outer wall 224 and define passageways that are isolated from the first flash hider portion 216. In this example, gases can enter each radially outer volume 222 through one or more proximal ports 230.

Flash hider 200 also includes a third flash hider portion 246 configured to vent gases through radially outer openings 248 in distal end plate 210. In the example shown in FIGS. 15A-15D, radially outer openings 248 of the third flash hider portion 246 are positioned radially outside of and radially aligned with outer volumes 216*b* of the first flash hider portion 216. In other embodiments, the radially outer openings 248 can be radially aligned with the radially outer volumes 222 of the second flash hider portion 220, or they can have some other rotational arrangement that is related or unrelated to other features of the flash hider 200.

When included as part of a suppressor 100, for example, gases 305 flowing through a radially outer chamber 120 of the suppressor 100 (e.g., shown in FIG. 11D) can vent forward through radially outer openings 248 in the distal end cap 210. In some such embodiments, the suppressor's 100 outer chamber 120 may be largely separated from an inner chamber 116 by an inner wall or baffle stack 110. For example, the inner wall of the suppressor 100 is defined by baffle bodies 114 and connects to the flange 234 on the outside of the outer wall 224 of the flash hider 200. In one embodiment, passageways 250 of the third flash hider portion 246 are isolated from the first and second flash hider portions 216, 220.

In one example embodiment, a wall or conduit defines a third flash hider passageway 250 that extends rearwardly from the distal wall 204 to the outer wall 224 and/or flange 234. The third flash hider passageway defines an expanding gas passageway 250 of the third flash hider portion 246. The expansion of the third flash hider passageway 250 can be linear or non-linear, as will be appreciated. Gases can enter the third flash hider passageways 250 via ports 252. In one embodiment, the ports 252 are openings in the sides of the third flash hider passageways 250 such that the ports 252 face in a circumferential direction. Such orientation of the ports 252 requires a tortuous path that precludes a direct path for gases through the distal wall 204. In other embodiments, ports 252 can be axially aligned, can face radially outward, can define a serpentine flow path to radially outer openings 248, or have some other suitable orientation. In yet other embodiments, third flash hider passageway 250 is omitted and gases can exit directly through radially outer openings 248 in distal end cap 210. In such an embodiment, the distal wall 204 can define radially outer openings 248 in number, size, and orientation as suitable to reduce pressure in a suppressor 100 and/or to reduce the firearm's visible signature. Numerous variations and embodiments will be apparent in light of the present disclosure.

Figure 16A:
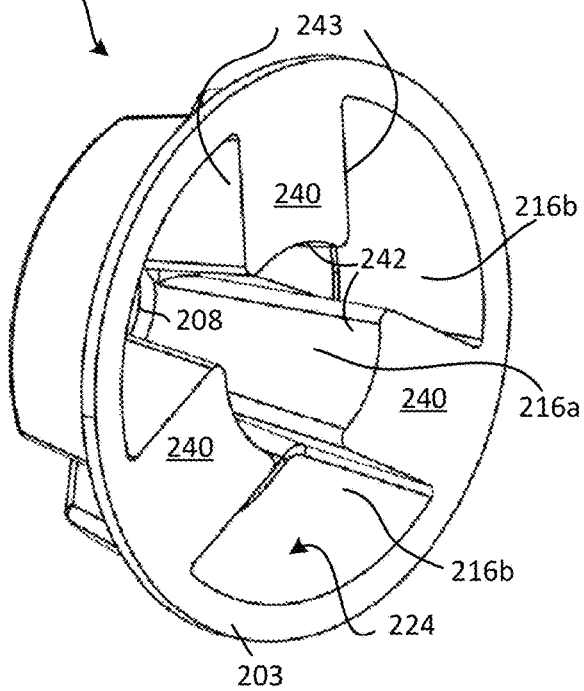
FIGS. 16A-16D illustrate various views of a flash hider having a first flash hider portion with an inner volume and a plurality of outer volumes, where sidewalls of flow partitions extend generally in parallel from the outer wall, in accordance with an embodiment of the present disclosure.
Figure 16B:
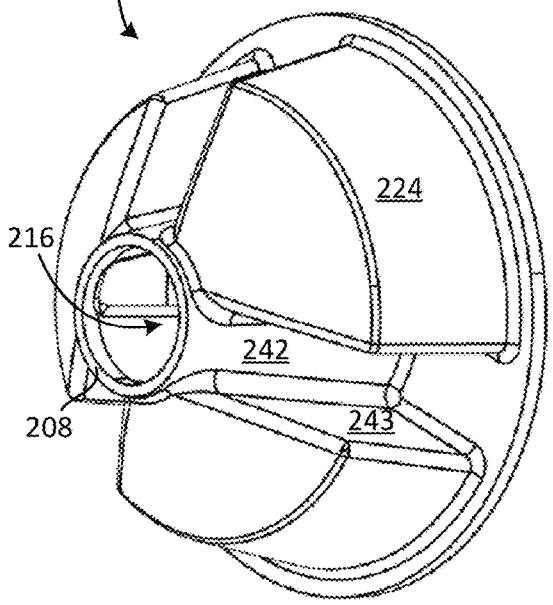
Figure 16C:
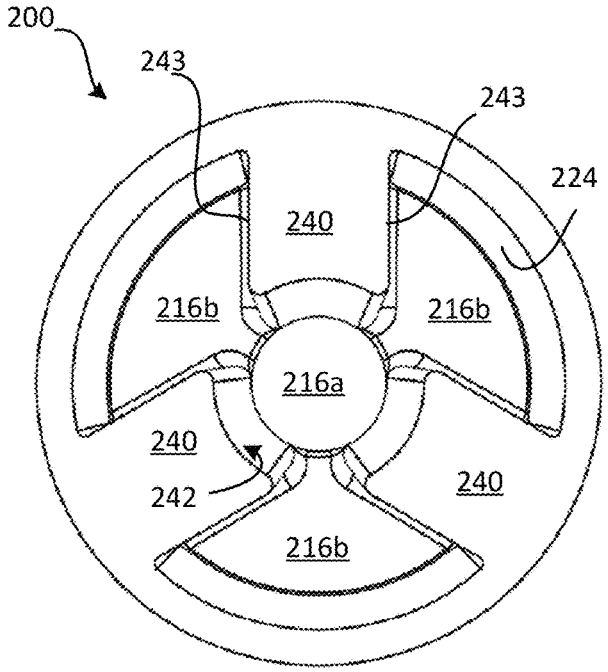
Figure 16D:
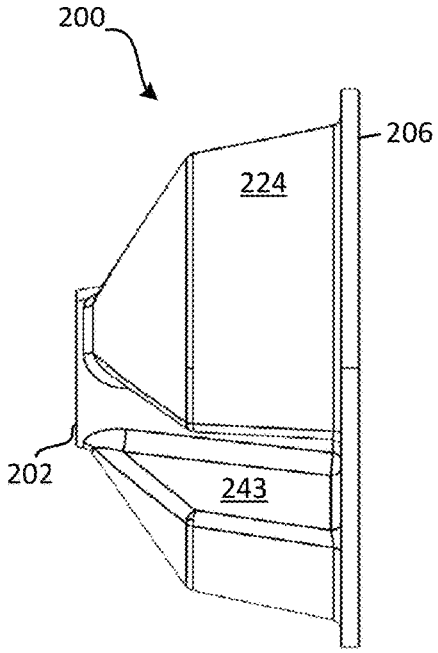

Referring now to FIGS. 16A-16D, various views illustrate a flash hider 200 having a first flash hider portion 216 that includes an inner volume 216*a* and a plurality of outer volumes 216*b*, in accordance with an embodiment of the present disclosure. FIG. 16A shows a front perspective view, FIG. 16B shows a rear perspective view, FIG. 16C shows a front view, and FIG. 16D shows a side view. Similar to some embodiments discussed above, the inner volume 216*a* has an expanding volume defined in part by radially inner faces 242 of flow partitions 240 extending radially inward from an outer wall 224. Here, the inner volume 216*a* has a frustoconical geometry. The outer wall 224 also generally defines a frustoconical volume that is radially outside of and concentric with the inner volume 216*a*. Flow partitions 240 extend into and interrupt the frustoconical volume defined by the outer wall 224 to define outer volumes 216*b* that are positioned circumferentially between adjacent flow partitions 240. Each outer volume 216*b* is continuous with the inner volume 216*a* and provides an expansion chamber for gases flowing through the central opening 208. In this embodiment, sidewalls 243 of each flow partition 240 extend generally in parallel, rather than radially, from the outer wall 224. This geometry provides an increased size of the outer volumes 216*b*. In this example, the flash hider 200 lacks a second flash hider portion 220 (e.g., separate, radially outer passageways) and also lacks distal vent openings 232 or other openings through the distal wall 204. Thus, gases can enter the flash hider 100 only through the central opening 208 on the proximal end 202 and then exit through the first flash hider portion 216 at the distal end 203. In accordance with some such embodiments, the flash hider 200 of FIGS. 16A-16D may be well suited for applications that have an increased demand for visible flash reduction but where reduced back flow of gases is not required, such as for use with bolt-action rifles.

Figure 17A:
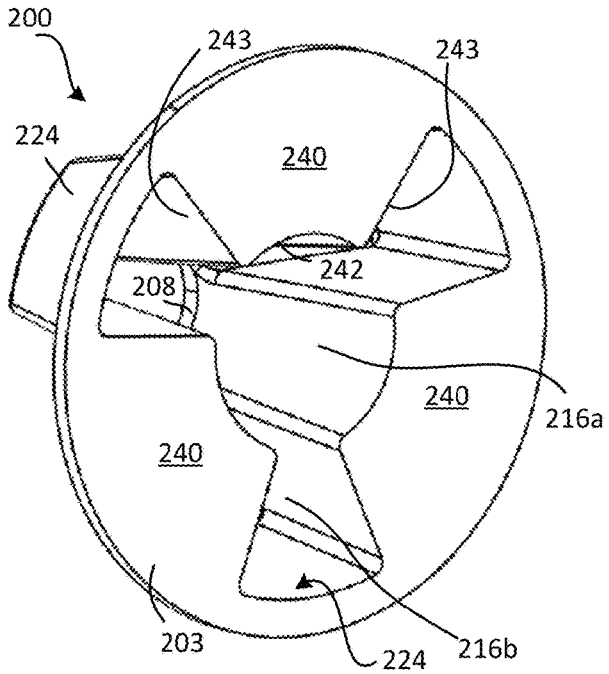
FIGS. 17A-17D illustrate various views of a flash hider having a first flash hider portion with an inner volume and outer volumes, where sidewalls of flow partitions extend generally radially from the outer wall, in accordance with another embodiment of the present disclosure.
Figure 17B:
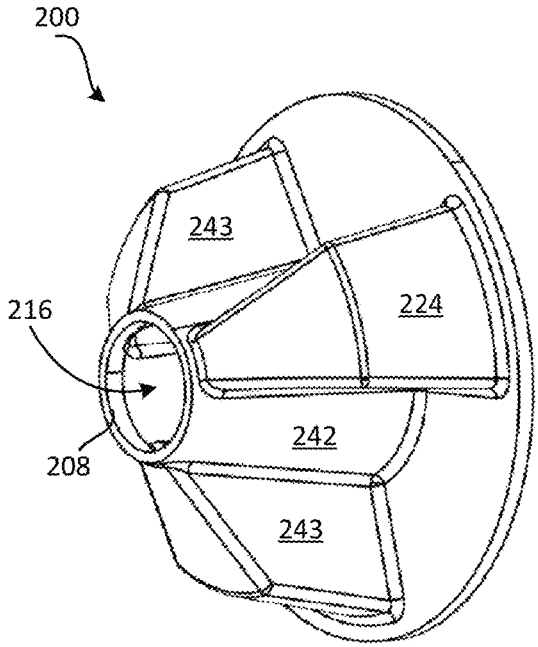
Figure 17C:
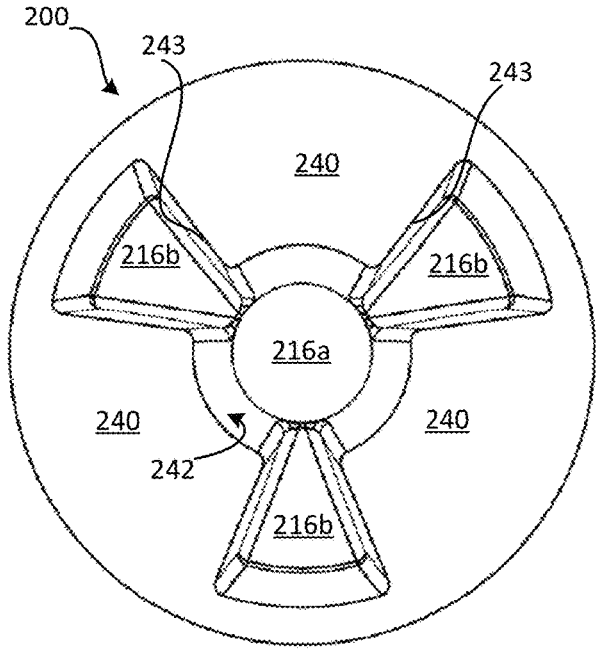
Figure 17D:
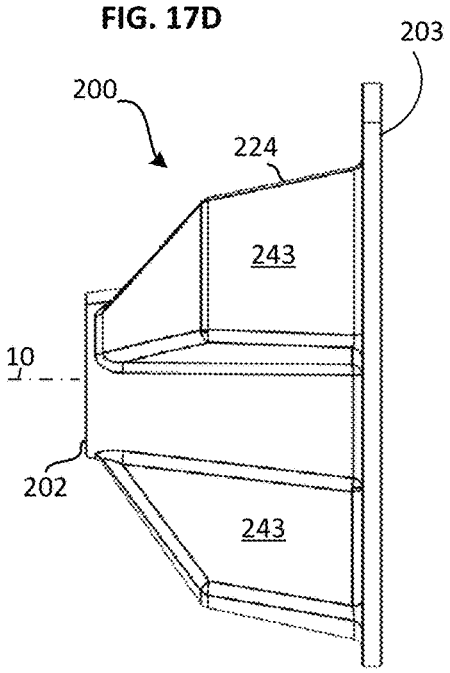

Referring now to FIGS. 17A-17D, various views illustrate a flash hider 200 having a first flash hider portion 216 that includes an inner volume 216*a* and a plurality of outer volumes 216*b*, in accordance with an embodiment of the present disclosure. FIG. 17A shows a front perspective view, FIG. 17B shows a rear perspective view, FIG. 17C shows a front view, and FIG. 17D shows a side view. The embodiment of FIGS. 17A-17D is similar to the embodiment of FIGS. 16A-16D. One difference here is that the sidewalls 243 of each flow partition 240 extend radially towards the central axis 10, rather than in parallel, from the outer wall 224. The result of the radially oriented sidewalls 243 is that the outer volumes 216*b* have a reduced size and the effect of the inner volume 216*a* is therefore augmented. In this example, the outer wall 224 along each outer volume 216*b* spans approximately 30-50 degrees, whereas the outer wall 224 along the outer volume 216*b* of the embodiment of FIGS. 16A-16D spans approximately 100-110 degrees. As can be seen in the figures, the flash hider 300 of FIGS. 17A-17D lacks a second flash hider portion and also lacks forward venting openings. Accordingly, such the embodiment FIGS. 17A-17D may be well suited for flash suppression and less suited for reducing back flow of gases into the receiver, as will be appreciated.

Figure 18A:
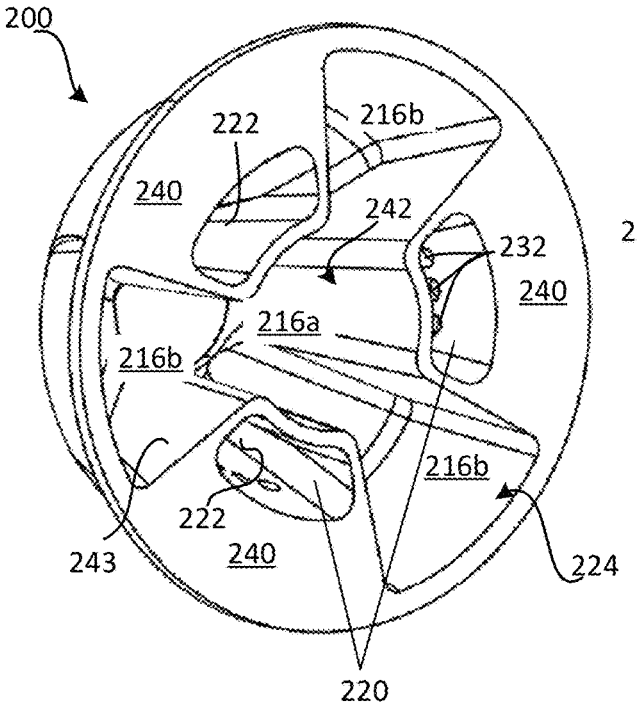
FIGS. 18A-18D illustrate various views of a flash hider having a first flash hider portion and a second flash hider portion, where the first flash hider portion includes an inner volume and outer volumes, and where the second flash hider portion includes gas passageways defined in flow partitions, in accordance with an embodiment of the present disclosure.
Figure 18B:
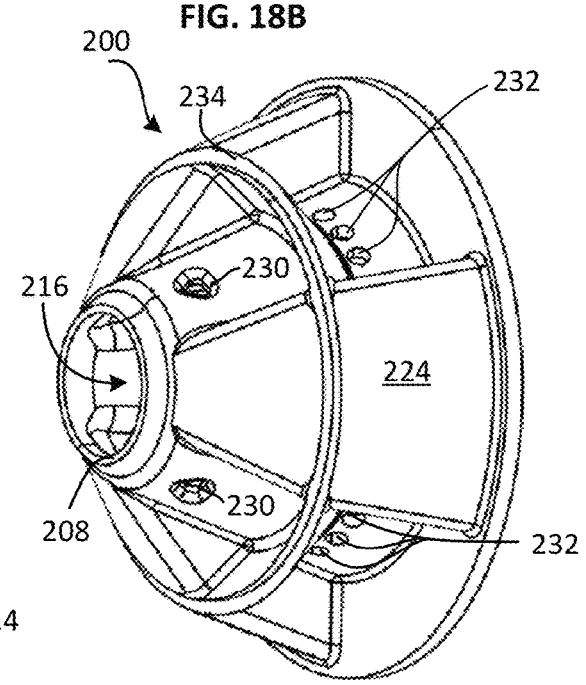
Figure 18C:
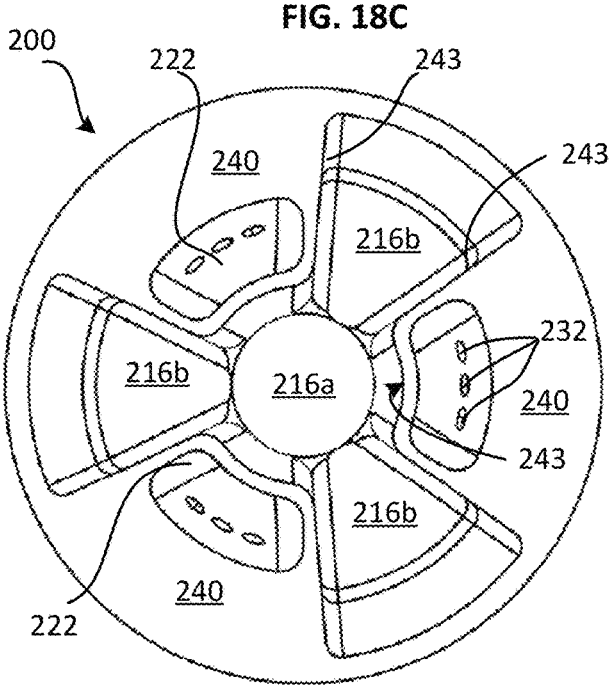
Figure 18D:
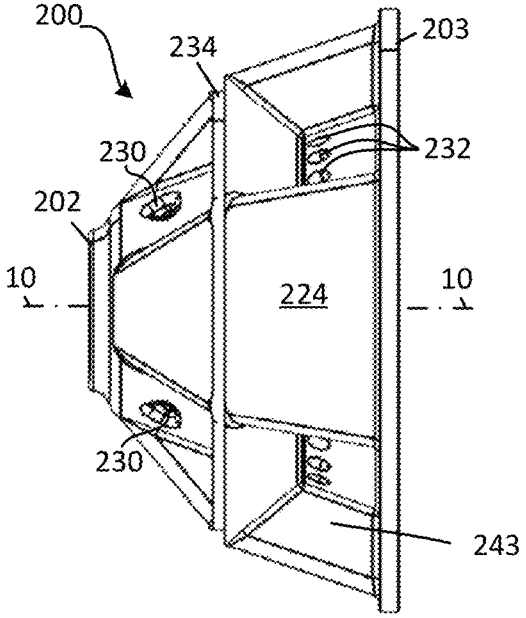

Referring now to FIGS. 18A-18D, various views illustrate a flash hider 200 having a first flash hider portion 216 and a second flash hider portion 220, in accordance with another embodiment of the present disclosure. FIG. 18A shows a front perspective view, FIG. 18B shows a rear perspective view, FIG. 18C shows a front view, and FIG. 18D shows a side view. The first flash hider portion 216 includes an inner volume 216*a* and a plurality of outer volumes 216*b* located circumferentially between flow partitions 240, similar to the embodiment shown in FIGS. 17A-17D. Each flow partition 240 has sidewalls 243 that generally extend radially, therefore providing a relatively reduced gas expansion volume in the outer volumes 216*b*. Note that in various embodiments of the flash hider 200, the sidewalls 243 of the flow partition 240 can extend in parallel, radially, or somewhere between.

In contrast to the embodiment of FIGS. 17A-17D, each flow partition 240 defines a radially outer volume 222 that is part of the second flash hider portion 220. In this example, each radially outer volume 222 is positioned adjacent the radially inner wall 242 of each flow partition 240 and is radially outside of the inner volume 216*a* of the first flash hider portion 216. Each radially outer volume 222 radially overlaps part of each outer volume 216*b* of the first flash hider portion 216. The radially outer volumes 222 receive gases via proximal ports 230 as well as through one or more distal ports 232. In this example, each radially outer volume 222 has one proximal port 230 and three distal ports 232. A flange 234 on the outside of the flash hider 200 can be connected to an inner wall of a suppressor, for example. In one such embodiment, a radially outer chamber 120 of the suppressor can vent primarily through distal ports 232 and off-axis gases in the inner chamber 116 of the suppressor 100 can vent primarily through the proximal ports 230. Gases flowing along the central axis 10 can pass through the central opening 208 to vent via the inner and outer volumes 216*a*, 216*b* of the first flash hider portion 216.

Figure 19A:
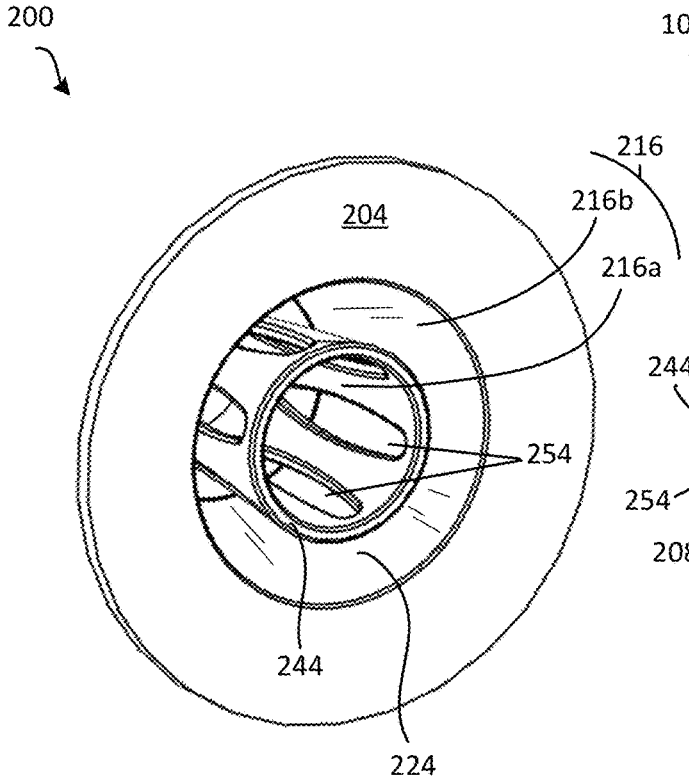
FIGS. 19A-19D illustrate various views of a flash hider having a first flash hider portion with an inner volume and an outer volume that is coaxial with and radially outside of the inner volume, in accordance with an embodiment of the present disclosure.
Figure 19B:
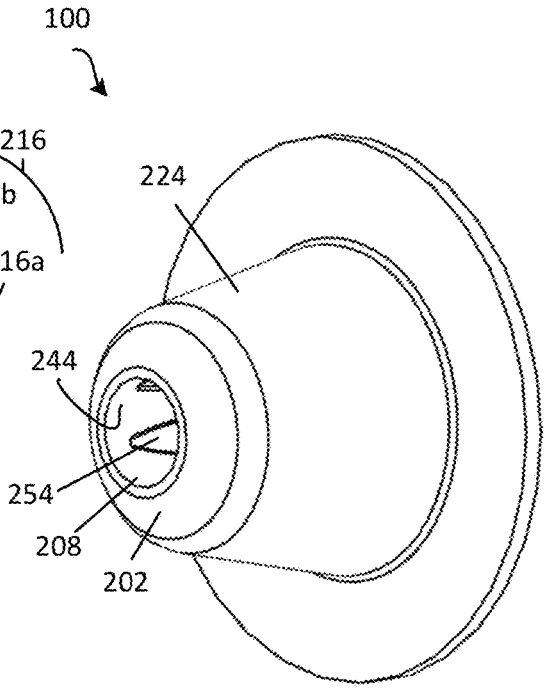
Figure 19C:
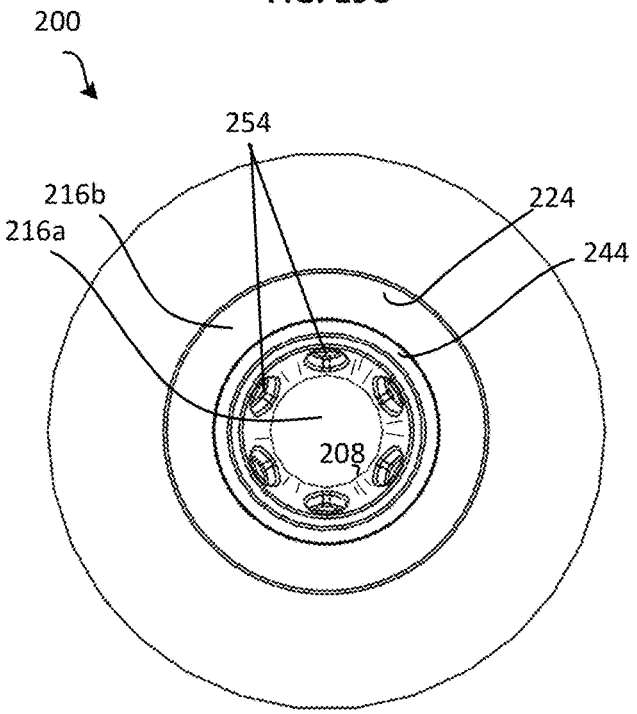
Figure 19D:
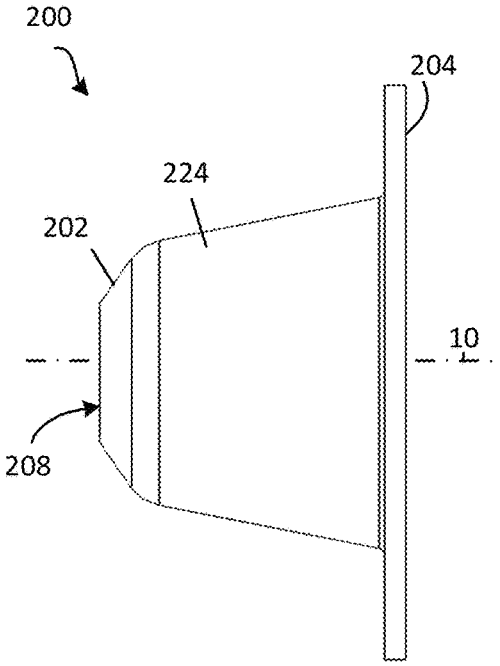

Referring now to FIGS. 19A-19D, various views illustrate a flash hider 200 having a first flash hider portion 216 that includes an inner volume 216*a* and an outer volume 216*b* located coaxially and outside of the inner volume 216*a*, in accordance with an embodiment of the present disclosure. FIG. 19A shows a front perspective view, FIG. 19B shows a rear perspective view, FIG. 19C shows a front view, and FIG. 19D shows a side view.

In this example, the flash hider 200 includes an inner wall 244 and an outer wall 224, both having a generally annular shape that expands in size moving distally along the central axis 10. The inner wall 244 is arranged coaxially within the outer wall 224 and the inner wall 244 is connected to the outer wall 224 at the proximal end 202 of the flash hider 200. As shown in this example, the outer wall 224 and the inner wall 244 both have a frustoconical shape, but other geometries are also acceptable provided that each wall provides an expanding volume for gases flowing through the flash hider 200.

The inner volume 216*a* is defined within the confines of the inner wall 244 and extends along the central axis 10. The outer volume 216*b* is between the inner wall 244 and the outer wall 224. As shown here, the outer volume 216*b* can be a single, uninterrupted volume that has a generally annular shape between the inner wall 244 and the outer wall 224. In other embodiments, the region between the inner wall 244 and the outer wall 224 can be divided into two or more outer volumes 216*b* by flow partitions 240 (shown, e.g., in FIG. 20A) that extend between and connect the inner wall 244 to the outer wall 224. In one such embodiment, the flow partitions 240 extend radially outward from the inner wall 244 to the outer wall 224.

As shown in this example, the inner volume 216*a* communicates with the outer volume 216*b* via openings 254 in the inner wall 244. Gases can enter the flash hider 200 via the central opening 208 at the proximal end 202 and can expand into the inner volume 216*a* of the frustoconical inner wall 244. Gases also can expand into the outer volume 216*b* through openings 254. In one embodiment, each opening 254 has an elongated shape that extends a majority of the distance from the proximal end 202 to the distal end 203. The openings 254 can have a shape of an oval, diamond, paddle, teardrop, wedge, slit, or some other geometry. Here, each opening 254 has a pointed proximal end and expands in width to a wider middle and distal portion, where the middle portion has the greatest width. The inner wall 244 can define two, three, four, five, six, seven, eight, or any other number of openings 254.

In one embodiment, the inner wall 244 and openings 254 are similar in appearance to the M16A1 "birdcage" flash hider developed for the M16 rifle. Here, however, the inner wall 244 is connected to the proximal end 202 of and positioned within the larger volume of the outer wall 224. Accordingly, gases enter the outer volume 216*b* via openings 254, rather than directly through the central opening 208. Stated differently, gases flowing through the outer volume 216*b* must first enter the inner volume 216*a* and then enter the outer volume 216*b* via the openings 254 in the inner wall 244.

Figure 20A:
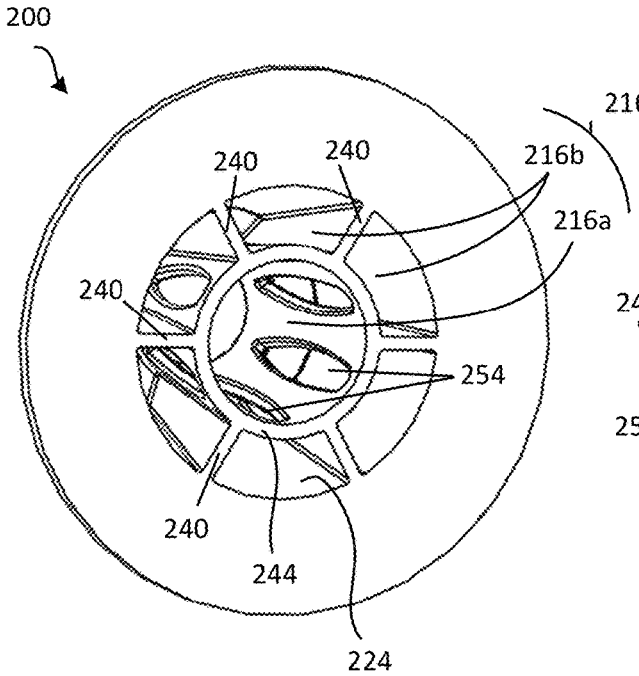
FIGS. 20A-20D illustrate various views of a flash hider having a first flash hider portion with an inner volume and a plurality of outer volumes in fluid communication with the inner volume, in accordance with an embodiment of the present disclosure.
Figure 20B:
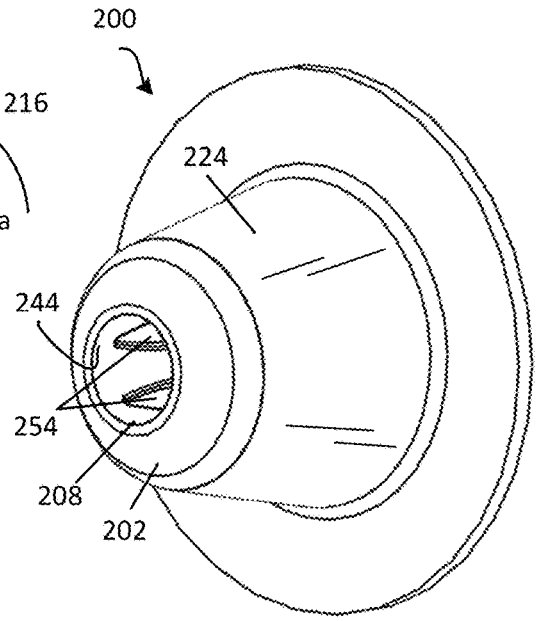
Figure 20C:
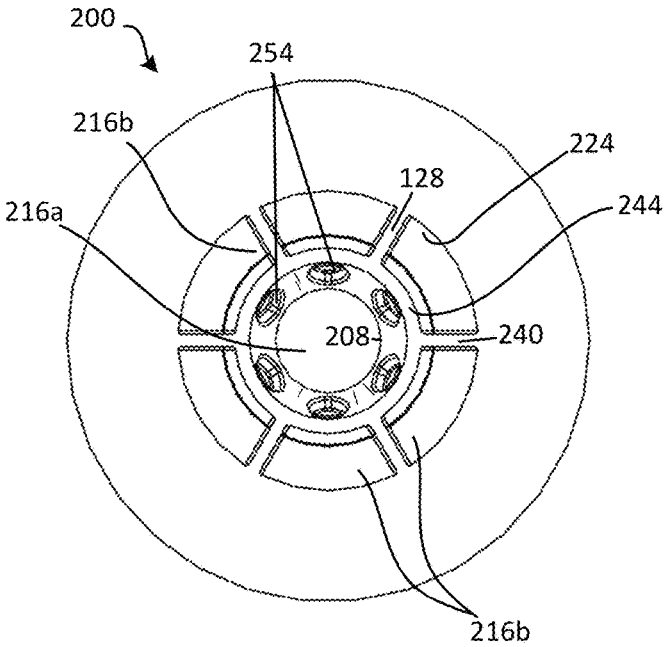
Figure 20D:
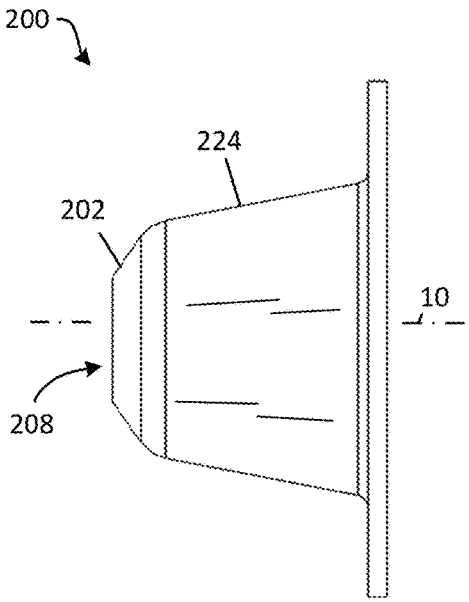

Referring now to FIGS. 20A-20D, various views illustrate a flash hider 200 having a first flash hider portion 216 that includes an inner volume 216*a* and a plurality of outer volumes 216*b* positioned radially outside of the inner volume 216*a*, in accordance with an embodiment of the present disclosure. FIG. 20A shows a front perspective view, FIG. 20B shows a rear perspective view, FIG. 20C shows a front view, and FIG. 20D shows a side view. In addition to other similarities, this embodiment is similar to that of FIGS. 19A-19D in that it includes an inner wall 244 arranged coaxially within an outer wall 224, where the inner volume 216*a* communicates with the outer volume 216*b* via openings 254 in the inner wall 244. This embodiment differs, however, in that the annular volume between the inner wall 244 and outer wall 224 is divided into outer volumes 216*b* by flow partitions 240 that extend radially between the inner wall 244 and the outer wall 224. In this example, each flow partition 224 is located between adjacent openings 254 to define six outer volumes 216*b*. Also, adjacent outer volumes 216*b* communicate only via openings 254 along the length of the flash hider 200. In other embodiments, fewer flow partitions 240 can be used, such as two, three, or four. Also, other embodiments optionally define openings in some or all of the flow partitions 240 to permit communication between adjacent outer volumes 216*b*.

Figure 21A:
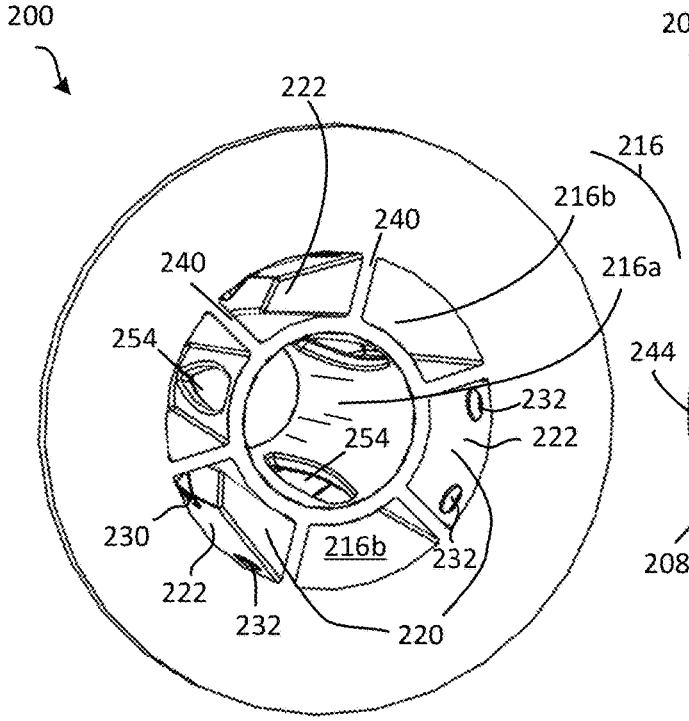
FIGS. 21A-21D illustrate various views of a flash hider having a first flash hider portion with an inner volume and a plurality of outer volumes in addition to a second flash hider portion with radially outer volumes interspersed circumferentially with outer volumes of the first flash hider portion, in accordance with an embodiment of the present disclosure.
Figure 21B:
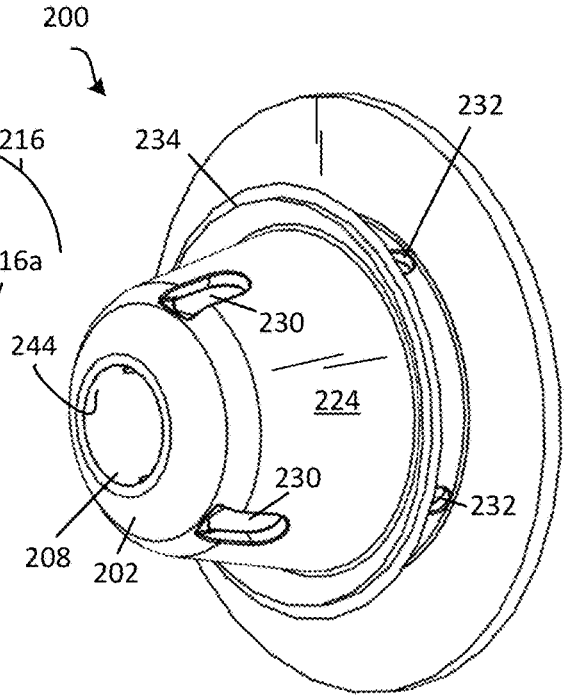
Figure 21C:
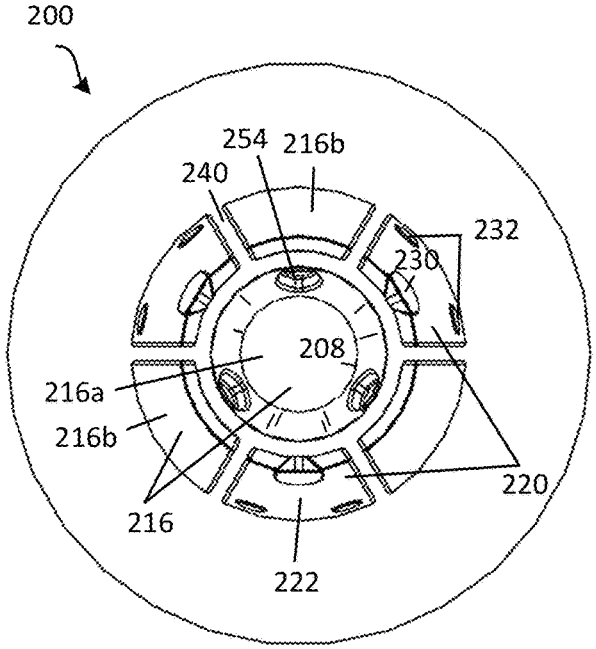
Figure 21D:
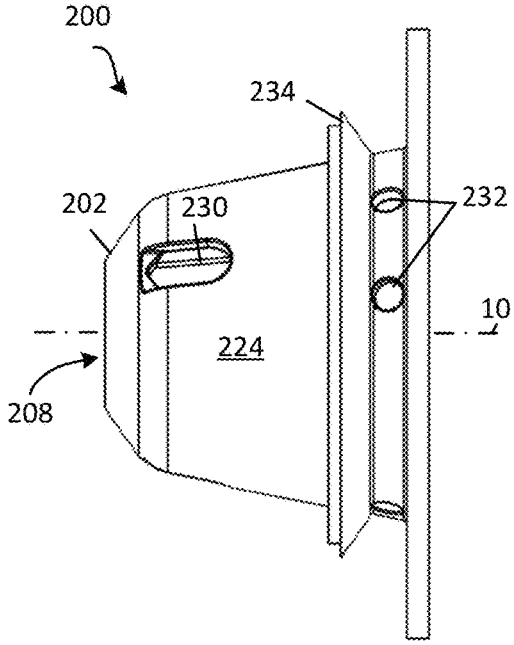

Referring now to FIGS. 21A-21D, various views illustrate a flash hider 200 having a first flash hider portion 216 and a second flash hider portion 220, in accordance with another embodiment of the present disclosure. FIG. 21A shows a front perspective view, FIG. 21B shows a rear perspective view, FIG. 21C shows a front view, and FIG. 21D shows a side view. This embodiment is similar to that of FIGS. 19A-19D and 20A-20D in that it includes an inner wall 244 arranged coaxially within and connected to an outer wall 224 at the proximal end 202 of the flash hider 200. In this embodiment, the first flash hider portion 216 includes an inner volume 216*a* inside of the inner wall 244 of a frustoconical shape. The first flash hider portion 216 also includes a plurality of outer volumes 216*b* radially outside of the inner volume 216*a* between the inner wall 244 and the outer wall 224. The second flash hider portion 220 includes radially outer volumes 222 that are also radially between the inner wall 244 and the outer wall 224, where radially outer volumes 222 are interspersed circumferentially with outer volumes 216*b* of the first flash hider portion 216.

Flow partitions 240 extend between and connect the inner wall 244 and the outer wall 224 to divide the generally annular space between the inner wall 244 and the outer wall 224 into outer volumes 216*b* of the first flash hider portion 216 and radially outer volumes 222 of the second flash hider portion 220. In this embodiment, three outer volumes 216*b* of the first flash hider portion 216 are interspersed circumferentially with three radially outer volumes 222 of the second flash hider portion 220. More or fewer flow partitions 240 can be used, as will be appreciated. Each outer volume 216*b* of the first flash hider portion 216 optionally communicates with the inner volume 216*a* via an opening 254 in the inner wall 244. However, the radially outer volumes 222 of the second flash hider portion 220 are isolated from the first flash hider portion 216 by the flow partitions 240 and inner wall 244. More specifically, the inner wall 244 lacks openings 254 in regions of the inner wall 244 that define part of a radially outer volume 222 of the second flash hider portion 220. Accordingly, the radially outer volumes 222 are isolated from the first flash hider portion 216 along the length of the flash hider 200.

Gases can enter the first flash hider portion 216 via the central opening 208 on the proximal end 202 and can expand into the inner volume 216*a* and into the outer volumes 216*b* via openings 254. Gases can enter the radially outer volumes 222 of the second flash hider portion 220 via proximal ports 230 in the outer wall 224. Optionally, the outer wall 224 also defines distal ports 232 that provide a gas pathway to the radially outer volumes 222 of the second flash hider portion 220. In some such embodiments, the flash hider 220 includes a flange 234 on the outer wall 224 that can be connected to an inner wall of a suppressor assembly 100 (e.g., shown in FIG. 11D). Thus, for example, proximal vent openings 230 may provide a pathway for off-axis gases to vent through the second flash hider portion 220, where such off-axis gases may be in an inner chamber 116 of the suppressor assembly 100. When the flange 234 and distal vent openings 232 are present, the flash hider 200 can be connected to the inner wall (e.g., baffle body 114) of the suppressor assembly 100 and provide a pathway to vent gases 305 flowing through an outer chamber 120 of the suppressor assembly 100 (shown, e.g., in FIG. 11D). Providing pathways to vent gases through the second flash hider portion 220 has the effect of reducing pressure in the suppressor assembly 100, and in turn reduces gas back flow into the firearm's chamber, in accordance with some embodiments.

FURTHER EXAMPLE EMBODIMENTS

The following examples pertain to further embodiments, from which numerous permutations and configurations will be apparent.

Example 1 is a flash hider for a suppressor, the flash hider comprising a flash hider body extending along a central axis from a proximal end to a distal end, the proximal end defining a central opening, the flash hider body having an outer wall defining one or more vent openings; a first flash hider portion defining a central volume that expands along the central axis between the proximal end and the distal end; and a second flash hider portion including a plurality of gas passageways radially outside of the central volume, the plurality of gas passageways in fluid communication with the one or more vent openings and isolated from the central volume.

Example 2 includes the subject matter of Example 1, wherein the central volume has a frustoconical shape circumscribed by the gas passageways of the second flash hider portion.

Example 3 includes the subject matter of Examples 1 or 2, wherein the first flash hider portion includes a plurality of outer volumes in fluid communication with the central volume, the plurality of outer volumes interspersed circumferentially with the plurality of gas passageways of the second flash hider portion.

Example 4 includes the subject matter of Example 3, wherein the plurality of outer volumes and the plurality of gas passageways of the second flash hider portion are distributed circumferentially along the outer wall.

Example 5 includes the subject matter of any of Examples 1-4, wherein each of the plurality of gas passageways is defined at least in part by a flow partition connected to the outer wall.

Example 6 includes the subject matter of Example 5, wherein the flow partition generally has a U shape with ends of the U connected to an inside of the outer wall.

Example 7 includes the subject matter of Example 6, wherein sides of the flow partition extend radially towards the central axis.

Example 8 includes the subject matter of Example 7, wherein each of the plurality of gas passageways generally has an annulus sector shape.

Example 9 includes the subject matter of Example 7, wherein sides of the flow partition extend generally in parallel from the outer wall.

Example 10 includes the subject matter of any of Examples 1-9, wherein the one or more vent openings includes at least one vent opening for each of the plurality of gas passageways.

Example 11 includes the subject matter of any of Examples 1-10, wherein the one or more vent openings includes at least one proximal vent opening located closer to the proximal end and at least one distal vent opening located closer to the distal end.

Example 12 includes the subject matter of any of Examples 1-11, wherein plurality of gas passageways of the second flash hider portion includes at least three gas passageways.

Example 13 includes the subject matter of any of Examples 1-12, wherein the gas passageways of the second flash hider portion are evenly distributed circumferentially.

Example 14 includes the subject matter of any of Examples 1-13, wherein a circumferential width of each gas passageway of the second flash hider portion is greater than or equal to a circumferential width between adjacent gas passageways.

Example 15 includes the subject matter of any of Examples 1-13, wherein a circumferential width of each gas passageway of the second flash hider portion is less than a circumferential width between adjacent gas passageways.

Example 16 includes the subject matter of any of Examples 1-15, wherein each of the plurality of gas passageways generally spans from 30 to 80 degrees along the outer wall.

Example 17 includes the subject matter of any of Examples 1-16 and further comprises a flange on the distal end, the flange extending radially outward from the outer wall.

Example 18 includes the subject matter of Example 17, wherein the flange defines a plurality of distal vent openings.

Example 19 includes the subject matter of Example 18 and further comprises a wall extending rearwardly from the flange and defining a passageway to at least one of the plurality of distal vent openings, the passageway having an inlet opening. For example, the wall defines a conduit between the flange and the distal vent opening(s).

Example 20 includes the subject matter of Example 19, wherein the inlet opening is directed transversely to the central axis.

Example 21 is a flash hider for a suppressor, the flash hider comprising a hollow flash hider body having an outer wall extending along a central axis from a proximal end to a distal end, the proximal end defining a central opening, wherein a volume of the flash hider body increases in size moving towards the distal end; and flow partitions extending into the volume from the outer wall toward the central axis, the flow partitions distributed about the central axis in a circumferentially spaced-apart arrangement, each of the flow partitions having sides and a radially inner surface; wherein the volume includes (i) an inner volume that expands along the central axis between the proximal end and the distal end, the inner volume circumscribed by the radially inner surfaces of the flow partitions, and (ii) a plurality of outer volumes located radially outside of the inner volume and continuous with the inner volume, the plurality of outer volumes interspersed circumferentially with the flow partitions.

Example 22 includes the subject matter of Example 21, wherein the outer wall follows a frustoconical shape.

Example 23 includes the subject matter of Examples 21 or 22, wherein the sides of each flow partition extend generally in parallel from the outer wall.

Example 24 includes the subject matter of Examples 21 or 22, wherein the sides of each flow partition extend radially from the outer wall.

Example 25 includes the subject matter of any of Examples 21-24, wherein each of the flow partitions defines a gas passageway extending therethrough generally in an axial direction, the gas passageway isolated by the flow partition from the inner volume and the outer volumes along an axial length of the flash hider.

Example 26 includes the subject matter of Example 25, wherein the gas passageway communicates with an outside of the outer wall via one or more proximal vent openings.

Example 27 includes the subject matter of Example 26, wherein the gas passageway further communicates with an outside of the outer wall via one or more distal vent openings.

Example 28 is a suppressor for a firearm, the suppressor including the flash hider of any of Examples 1-27. The suppressor comprises a suppressor housing extending along a central axis from a proximal suppressor end to a distal suppressor end, where the flash hider is secured to the suppressor housing adjacent the distal suppressor end.

Example 29 includes the subject matter of Example 28, wherein the suppressor defines a central suppressor volume and a radially outer volume, the central suppressor volume configured to direct propellant gases into the central opening of the flash hider.

Example 30 includes the subject matter of Example 29, wherein the radially outer volume of the suppressor is isolated at least in part from the central suppressor volume by an inner tubular wall located within and coaxially arranged with the housing.

Example 31 includes the subject matter of Example 30, wherein the inner tubular wall is connected to the outer wall of the flash hider.

Example 32 includes the subject matter of any of Examples 28-31, wherein the flash hider is a monolithic structure with the suppressor housing.

Example 33 is a suppressor for a firearm, the suppressor comprising a tubular suppressor housing extending along a central axis from a first end to a second end; and a flash hider secured in the housing adjacent the second end, the flash hider having (a) a hollow flash hider body with an outer wall extending along the central axis from a proximal end to a distal end, the proximal end defining a central opening, a volume of the flash hider body increasing in size moving towards the distal end; and (b) flow partitions extending into the volume from the outer wall toward the central axis, the flow partitions distributed about the central axis in a circumferentially spaced-apart arrangement, each of the flow partitions having sides and a radially inner surface; wherein the volume includes (i) an inner volume that expands along the central axis between the proximal end and the distal end, the inner volume circumscribed by the radially inner surface of the flow partitions, and (ii) a plurality of outer volumes located radially outside of the inner volume and continuous with the inner volume, the plurality of outer volumes interspersed circumferentially with the flow partitions.

Example 34 includes the subject matter of Example 33, wherein at least part of the outer wall has a frustoconical shape.

Example 35 includes the subject matter of any of Examples 33-34, wherein the sides of each flow partition extend generally in parallel from the outer wall.

Example 36 includes the subject matter of any of Examples 33-34, wherein the sides of each flow partition extend generally radially from the outer wall.

Example 37 includes the subject matter of any of Examples 33-36, wherein each of the flow partitions defines a gas passageway isolated from the inner volume and the outer volumes along an axial length of the flash hider.

Example 38 includes the subject matter of Example 37, wherein each flow partition generally has a shape of an annulus sector.

Example 39 includes the subject matter of Examples 37 or 38 and further comprises an inner suppressor wall extending axially along an inside of the suppressor housing and coaxially arranged with the suppressor housing, wherein the suppressor defines an inner suppressor volume within the inner suppressor wall and an outer suppressor volume between the suppressor housing and the inner suppressor wall.

Example 40 includes the subject matter of Example 39, wherein the tubular suppressor housing is connected to the distal end of the flash hider and wherein the inner suppressor wall is connected to the outer wall of the flash hider.

Example 41 includes the subject matter of any of Examples 37-40, wherein the gas passageway has a proximal end portion in direct or indirect fluid communication with the outer suppressor volume via a proximal vent opening.

Example 42 includes the subject matter of Example 41, wherein the gas passageway further is in direct fluid communication with the outer suppressor volume via one or more distal vent openings.

Example 43 includes the subject matter of any of Examples 33-42, wherein the flash hider is a monolithic structure with the tubular suppressor housing.

Example 44 is a suppressor for a firearm, the suppressor comprising a suppressor housing extending along a central axis from a first end to a second end; and a flash hider secured in the second end of the suppressor housing. The flash hider comprises a flash hider body extending along the central axis from a proximal end to a distal end, the proximal end defining a central opening, the flash hider body having an outer wall defining one or more vent openings; a first flash hider portion defining a central volume that expands along the central axis between the proximal end and the distal end; and a second flash hider portion including a plurality of gas passageways radially outside of the central volume, the plurality of gas passageways in fluid communication with the one or more vent openings and isolated from the central volume.

Example 45 includes the subject matter of Example 44, wherein the first end of the suppressor housing is configured to attach to a barrel of a firearm.

Example 46 includes the subject matter of Examples 44 or 45 and further comprises an inner suppressor wall extending axially along an inside of the suppressor housing and coaxially arranged with the suppressor housing, wherein the suppressor defines an inner suppressor volume within the inner suppressor wall and an outer suppressor volume between the suppressor housing and the inner suppressor wall.

Example 47 includes the subject matter of any of Examples 44-46, wherein the central volume has a frustoconical shape defined at least in part by a radially inner surface of each of the gas passageways of the second flash hider portion.

Example 48 includes the subject matter of any of Examples 44-47, wherein the first flash hider portion includes a plurality of outer volumes that are continuous with the central volume, the plurality of outer volumes interspersed circumferentially with the plurality of gas passageways of the second flash hider portion.

Example 49 includes the subject matter of Example 48, wherein the plurality of outer volumes and the plurality of gas passageways of the second flash hider portion are distributed circumferentially along the outer wall.

Example 50 includes the subject matter of any of Examples 44-49, wherein each of the plurality of gas passageways is defined at least in part by a flow partition connected to the outer wall.

Example 51 includes the subject matter of Example 50, wherein the flow partition generally has a U shape with ends of the U connected to an inside of the outer wall.

Example 52 includes the subject matter of Examples 50 or 51, wherein sides of the flow partition extend radially towards the central axis.

Example 53 includes the subject matter of Example 52, wherein each of the plurality of gas passageways generally has a shape of an annulus sector.

Example 54 includes the subject matter of Example 51, wherein sides of the flow partition extend generally in parallel from the outer wall.

Example 55 includes the subject matter of any of Examples 44-54, wherein the one or more vent openings includes at least one vent opening for each of the plurality of gas passageways.

Example 56 includes the subject matter of any of Examples 44-55, wherein the one or more vent openings includes at least one proximal vent opening located closer to the proximal end and at least one distal vent opening located closer to the distal end.

Example 57 includes the subject matter of any of Examples 44-56, wherein plurality of gas passageways of the second flash hider portion includes at least three gas passageways.

Example 58 includes the subject matter of any of Examples 44-57, wherein the gas passageways of the second flash hider portion are evenly distributed circumferentially.

Example 59 includes the subject matter of any of Examples 44-58, wherein a circumferential width of each of the plurality of gas passageways of the second flash hider portion is greater than or equal to a circumferential width between adjacent gas passageways.

Example 60 includes the subject matter of any of Examples 44-58, wherein a circumferential width of each of the plurality of gas passageway of the second flash hider portion is less than a circumferential width between adjacent gas passageways.

Example 61 includes the subject matter of any of Examples 44-60, wherein each of the plurality of gas passageways generally spans from 30 to 80 degrees along the outer wall.

Example 62 includes the subject matter of any of Examples 44-61 and further comprises a flange on the distal end of the flash hider, the flange extending radially outward from the outer wall to the suppressor housing.

Example 63 includes the subject matter of Example 62, wherein the flange defines a plurality of distal vent openings.

Example 64 includes the subject matter of Example 63 and further comprises a wall extending rearwardly from the flange and defining a passageway to at least one of the plurality of distal vent openings, the passageway having an inlet opening.

Example 65 includes the subject matter of Example 64, wherein the inlet opening is directed transversely to the central axis.

Example 66 includes the subject matter of any of Examples 44-65, wherein the flash hider is a monolithic structure with the suppressor housing.

Example 67 is a flash hider for a suppressor, the flash hider comprising a flash hider body extending along a central axis from proximal end to a distal end, the flash hider body including an outer wall having a shape that expands in volume towards the distal end; and an inner wall connected to the proximal end of the flash hider body, the inner wall having a shape that is coaxially arranged within the outer wall and that expands in volume towards the distal end, the inner wall defining a plurality of openings. The flash hider body defines one or more outer volumes between the inner wall and the outer wall, and the inner wall defines an inner volume in communication with the one or more outer volumes via the plurality of openings. In one example, the outer volume is a single, uninterrupted outer volume around the inner volume.

Example 68 includes the subject matter of Example 67 and further comprises a plurality of flow partitions extending between and connecting the outer wall and the inner wall, the plurality of flow partitions distributed about the central axis in a circumferentially spaced-apart arrangement. The flow partitions can divide the region between the inner and outer walls into a plurality of outer volumes, where at least some of the outer volumes communicate with the inner volume via the openings in the inner wall.

Example 69 includes the subject matter of Example 68, wherein each of the plurality of flow partitions extends radially between the inner wall and the outer wall.

Example 70 includes the subject matter of any of Examples 67-69, wherein at least one of the outer wall and the inner wall has a frustoconical shape.

Example 71 includes the subject matter of any of Examples 67-70, wherein inner volume and the outer volumes are part of a first flash hider portion, and the flash hider body further defines a second flash hider portion including a plurality of radially outer volumes interspersed circumferentially with the outer volumes of the first flash hider portion. The outer wall defines at least one vent opening in communication with each radially outer volume of the second flash hider portion. The first flash hider portion is isolated from the second flash hider portion along a length of the flash hider body.

Example 72 includes the subject matter of Example 71, wherein the at least one vent opening includes one or more proximal vent openings and one or more distal vent openings.

Example 73 includes the subject matter of Example 72 and further comprises a flange extending outward from an outside of the outer wall.

Example 74 is a suppressor for a firearm, the suppressor comprising a tubular suppressor housing extending along a central axis from a first end to a second end; and a flash hider secured to the housing adjacent the second end, the flash hider having (i) a flash hider body extending along the central axis from proximal end to a distal end, the flash hider body including a first wall that expands in volume towards the distal end, and (ii) a second wall connected to the proximal end of the flash hider body, the second wall is coaxially arranged within the first wall and expands in volume towards the distal end, the second wall defining a plurality of openings; wherein the flash hider body defines one or more outer volumes between the second wall and the first wall, and the first wall defines an inner volume in communication with the one or more outer volumes via the plurality of openings.

Example 75 includes the subject matter of Example 74 and further comprises a plurality of flow partitions extending between and connecting the first wall and the second wall, the plurality of flow partitions distributed about the central axis in a circumferentially spaced-apart arrangement.

Example 76 includes the subject matter of Example 75, wherein each of the plurality of flow partitions extends radially between the first wall and the second wall.

Example 77 includes the subject matter of any of Examples 74-76, wherein at least one of the first wall and the second wall has a frustoconical shape.

Example 78 includes the subject matter of any of Examples 74-77 wherein inner volume and the outer volumes are part of a first flash hider portion, the flash hider body further defining a second flash hider portion including a plurality of radially outer volumes interspersed circumferentially with the outer volumes of the first flash hider portion; wherein the outer wall defines at least one vent opening in communication with each radially outer volume of the second flash hider portion; and wherein the first flash hider portion is isolated from the second flash hider portion along a length of the flash hider body.

Example 79 includes the subject matter of Example 78, wherein the at least one vent opening includes one or more proximal vent openings and one or more distal vent openings.

Example 80 includes the subject matter of Example 79 and further comprises a flange on an outside of the first wall.

Example 81 includes the subject matter of Example 80 and further comprises an inner suppressor wall extending axially along an inside of the suppressor housing and coaxially arranged with the suppressor housing, wherein the suppressor defines an inner suppressor volume inside of the inner suppressor wall and an outer suppressor volume between the suppressor housing and the inner suppressor wall.

Example 82 includes the subject matter of Example 81, wherein the tubular suppressor housing is connected to the distal end of the flash hider and wherein the inner suppressor wall is connected to the flange on the first wall of the flash hider.

Example 83 includes the subject matter of any of Examples 74-82, wherein the flash hider is a monolithic structure with the tubular suppressor housing.

Example 84 is a firearm suppressor comprising a baffle stack having an outer surface and defining an inner chamber with a projectile pathway through the baffle stack along a central axis. An outer housing has an inner surface separated from and confronting the outer surface of the baffle stack, where the inner surface of the outer housing and the outer surface of the baffle stack defining an outer chamber therebetween. Flow-directing structures are in the outer chamber. A flash hider is in a distal end of the suppressor, the flash hider defining a first flash hider volume arranged to vent gases from the inner chamber and a second flash hider volume arranged to vent gases from the inner and the outer chamber, wherein the first flash hider volume is isolated from the second flash hider volume along a length of the flash hider Example 85 includes the subject matter of Example 84, wherein each of the baffles defines a central opening along the projectile pathway, the central opening having a circular shape as viewed along the central axis, and having an elliptical shape as viewed along an axis transverse to the central axis.

Example 86 includes the subject matter of Example 84 or 85, where the flow-directing structures include vanes connected to one or both of the outer surface of the baffle stack and an inner surface of the outer housing and disposed within the outer chamber.

Example 87 includes the subject matter of Example 86, where the vanes are connected to both of the outer surface of the baffle stack and the inner surface of the outer housing.

Example 88 includes the subject matter of any of Examples 84-87, wherein the flow-directing structures include pairs of vanes arranged in a converging V shape and pairs of vanes arranged in a diverging V shape, wherein the plurality of baffle ports includes an inlet port within the converging V shape and a port port within the diverging V shape.

Example 89 includes the subject matter of Example 87 or 88, wherein the inlet port is configured to direct a flow of combustion gas from the outer chamber to the inner chamber, and the outlet port is configured to direct a flow of combustion gas from the inner chamber to the outer chamber.

Example 90 includes the subject matter of any of Examples 84-89, and further comprises a wall defining a blast chamber in a proximal end portion of the outer housing, where the wall located proximally of the baffle stack and defines (i) a central opening in communication with the inner chamber and (ii) one or more openings radially outside of the central opening and in communication with the outer chamber, where the wall has a smaller size adjacent the central opening.

Example 91 includes the subject matter of any of Examples 84-90, where the inner chamber is coaxially arranged with the outer chamber.

Example 92 includes the subject matter of any of Examples 84-91, where each of the baffles defines a central opening aligned with the longitudinal axis.

Example 93 includes the subject matter of Example 92, where the central opening of at least one of the coaxially aligned baffles has a non-circular shape.

Example 94 includes the subject matter of any of Examples 84-93, and further comprises a flash hider in a distal end portion of the suppressor.

Example 95 includes the subject matter of Example 94, where the flash hider directly communicates with the inner chamber and directly or indirectly with the outer chamber via one or more openings therebetween.

Example 96 includes the subject matter of Example 94 or 95, where the flash hider includes an outer flash hider portion and an inner flash hider portion concentric with and located within the outer flash hider portion.

Example 97 includes the subject matter of Example 96, where the inner flash hider portion defines a first expanding passageway along the central axis and the outer flash hider portion defines a second expanding passageway radially outside of and coaxially arranged with the first expanding passageway.

Example 98 includes the subject matter of Example 96 or 97, where the outer flash hider portion is in direct or indirect fluid communication with the outer chamber and the inner flash hider portion is in direct fluid communication with the inner chamber.

Example 99 includes the subject matter of any of Examples 96-98, where the outer flash hider portion defines at least one exit channel in direct or indirect fluid communication with the outer chamber.

Example 100 includes the subject matter of Example 99, where the exit channel is in fluid communication with a vent, the vent having a cross-sectional profile that increases in size toward a distal end of the flash hider.

Example 101 includes the subject matter of any of Examples 96-100, where at least a portion of gases in the suppressor can enter the outer flash hider portion via the outer chamber.

Example 102 includes the subject matter of any of Examples 96-100, where a portion of gases in the suppressor can enter the outer flash hider portion via the inner chamber.

Example 103 includes the subject matter of any of Examples 96-100, where a portion of gases in the outer chamber can enter the outer flash hider portion and a portion of gases in the inner chamber can enter the inner flash hider portion.

Example 104 includes the subject matter of any of Examples 96-100, where a portion of gases in the inner chamber can enter the outer flash hider portion and a portion of gases in the outer chamber can enter the inner flash hider portion.

Example 105 includes the subject matter of any of Examples 96-104, where a proximal end of the inner flash hider portion directly communicates only with the inner chamber.

Example 106 is a suppressor baffle comprising a cylindrical baffle body extending along a central axis from a proximal body end to a distal body end; vanes protruding outward from an outside surface of the cylindrical baffle body, each of the vanes extending a majority of an axial distance from the proximal body end to the distal body end and oriented transversely to the central axis; a tapered wall connected to a proximal body end of the cylindrical baffle body and extending rearward to define a central opening centered on the central axis, the central opening having a circular shape when viewed along the central axis; and a gutter connected to the tapered wall adjacent the central opening and extending rearward therefrom, the gutter around one side of the central opening such that the central opening has an enlarged opening size compared to the circular shape when viewed from an angle transverse to the central axis.

Example 107 includes the subject matter of Example 106, wherein the gutter has a semicircular shape.

Example 108 includes the subject matter of Examples 106 or 107, wherein the vanes are arranged in an alternating pattern around the outside surface of the cylindrical baffle body such that adjacent vanes generally define a converging V shape or a diverging V shape with respect to forward gas flow along the central axis, each converging V shape or diverging V shape having an open vertex generally pointing in a direction parallel to the central axis.

Example 109 includes the subject matter of Example 108, wherein the cylindrical baffle body defines an inlet opening positioned within the converging V shape.

Example 110 includes the subject matter of Example 109, wherein the inlet opening is opposite the central axis of the gutter.

Example 111 includes the subject matter of any of Examples 108-110, wherein the cylindrical baffle body defines an opening positioned within the diverging V shape, the opening configured to direct gas flow between the inner chamber and the outer chamber.

Example 112 includes the subject matter of any of Examples 106-111, wherein the tapered wall defines an opening positioned opposite the central axis of the gutter.

Example 113 includes the subject matter of any of Examples 106-112, wherein at least some of the vanes have a helical shape.

Example 114 includes the subject matter of any of Examples 106-113, wherein a distal end of each of the vanes defines a V-shaped notch.

Example 115 includes the subject matter of any of Examples 106-114, wherein the tapered wall has a frusto-conical shape.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A suppressor comprising:

a baffle stack having an outer surface, the baffle stack comprising a plurality of baffles that define an inner chamber coaxially aligned with a central axis of the baffle stack and a projectile pathway through the baffle stack along the central axis;

an outer housing around the baffle stack, the outer housing having an inner surface separated from and confronting the outer surface of the baffle stack, the inner surface of the outer housing and the outer surface of the baffle stack defining an outer chamber therebetween;

flow-directing structures in the outer chamber, the flow-directing structures including pairs of individual vanes arranged in a V shape that converges moving distally along the central axis; and an end cap connected to a distal end of the outer housing, the end cap defining a central opening aligned with the central axis.

2. The suppressor of claim 1, wherein the end cap further defines a plurality of radially outer openings, the radially outer openings configured to vent combustion gases from the outer chamber.

3. The suppressor of claim 1, wherein the baffle stack defines a plurality of baffle ports in the outer surface so that the inner chamber is in fluid communication with the outer chamber via the plurality of baffle ports, the plurality of baffle ports including an inlet port within the V shape of at least some of the pairs of individual vanes arranged in the V shape.

4. The suppressor of claim 3, wherein the plurality of vanes includes pairs of individual vanes arranged in a diverging V shape, the diverging V shape oriented such that a vertex of the V shape generally points in a proximal direction along the central axis, and wherein the plurality of baffle ports includes a port within the diverging V shape, the port configured to direct a flow of combustion gas between the inner chamber and the outer chamber.

5. The suppressor of claim 1, wherein at least some of the baffles of the plurality of baffles define a central opening along the projectile pathway, the central opening having a circular shape as viewed along the central axis, and having an elliptical or elongated shape as viewed along an axis transverse to the central axis, the elliptical shape having a greater area than the circular shape.

6. The suppressor of claim 5, wherein each baffle of the at least some of the plurality of baffles comprises:

a tubular baffle body defining a portion of the outer surface, the tubular baffle body extending along the central axis from a proximal body end to a distal body end;

an expanding baffle wall connected to the proximal body end and tapering rearwardly from the proximal body end to a central opening smaller than the tubular baffle body; and a gutter connected to the expanding baffle wall at the central opening, the gutter extending proximally from the central opening.

7. The suppressor of claim 6, wherein adjacent baffles of the at least some of the plurality of baffles have a relative rotation about the central axis such that the gutter of one baffle is rotated about the central axis from 60°-180° with respect to the gutter of an adjacent baffle.

8. The suppressor of claim 6, wherein the tubular baffle body defines an inlet port configured to direct a flow of combustion gas from the outer chamber to the inner chamber, the inlet port positioned opposite the central axis of the gutter.

9. The suppressor of claim 8, wherein expanding baffle wall defines a gas port between the central opening and the tubular baffle body, and wherein the inlet port is configured to direct the flow of combustion gas from the outer chamber to the inner chamber via the inlet port and then into the inner chamber via the gas port in the expanding baffle wall.

10. The suppressor of claim 1 wherein each baffle of at least some of the plurality of baffles comprises:

a tubular baffle body defining a portion of the outer surface, the tubular baffle body extending along the central axis from a proximal body end to a distal body end;

an expanding baffle wall connected to the proximal body end and tapering rearwardly from the proximal body end to a central opening smaller than the tubular baffle body, the central opening having a non-circular shape when viewed along the central axis.

11. The suppressor of claim 10, wherein the central opening includes a recess in the expanding baffle wall at the central opening.

12. The suppressor of claim 11, wherein the tubular baffle body of a baffle adjacent each of the at least some of the plurality of baffles defines a port adjacent the central opening, the port configured to direct combustion gases towards the central opening in a direction transverse to the central axis.

13. The suppressor of claim 1, further comprising a blast diffusor located proximally of the baffle stack, the blast diffusor having a cylindrical diffusor body connected to the outer housing and defining at least a portion of a blast chamber.

14. The suppressor of claim 13, wherein the blast diffusor includes a perforated diffusor wall that reduces in size as it extends distally from the diffusor body to a diffusor central opening in fluid communication with the blast chamber, the perforated diffusor wall defining one or more openings radially outside of the central opening and in fluid communication with the outer chamber.

15. The suppressor of claim 1, further comprising a flash hider in a distal end portion of the suppressor, the flash hider including the end cap.

16. The suppressor of claim 15, wherein the flash hider defines a first flash hider volume arranged to vent gases from the inner chamber and a second flash hider volume arranged to directly or indirectly vent gases from the outer chamber, wherein the first flash hider volume is isolated from the second flash hider volume along an axial length of the flash hider.

17. The suppressor of claim 16, wherein the first flash hider volume is concentric with and located within a diameter of the second flash hider volume.

18. The suppressor of claim 16, wherein the flash hider comprises:

a flash hider proximal end portion defining a central entrance opening;

an outer wall extending along the central axis from the flash hider proximal end portion to the end cap, the outer wall expanding in size moving from the proximal end portion to the end cap and connected to the end cap at the central opening of the end cap; and flow partitions extending inward from the outer wall toward the central axis, the flow partitions distributed about the central axis in a circumferentially spaced-apart arrangement, each of the flow partitions generally having a shape of an annulus sector with sides and a radially inner surface;

wherein the flash hider defines (i) an inner volume that expands along the central axis between the flash hider proximal end portion and the end cap, the inner volume circumscribed by the radially inner surface of the flow partitions, and (ii) a plurality of outer volumes located radially outside of the inner volume and continuous with the inner volume, the plurality of outer volumes interspersed circumferentially with the flow partitions.

19. The suppressor of claim 18, wherein the sides of each flow partition extend generally in parallel from the outer wall.

20. The suppressor of claim 18, wherein the sides of each flow partition extend in a generally radial direction from the outer wall.

21. The suppressor of claim 18, wherein each of the flow partitions defines a gas passageway between the sides, the outer wall, and the radially inner surface, wherein the gas passageway is isolated from the inner volume and from the outer volumes along an axial length of the flash hider, and wherein the gas passageway is in direct or indirect fluid communication with the outer chamber via a vent opening in the outer wall of the flash hider.

22. The suppressor of claim 1, wherein at least some of the pairs of individual vanes include a first vane and a second vane, the first and second vanes being only indirectly connected by the baffle stack or the outer housing.

23. A suppressor comprising:

a baffle stack having an outer surface, the baffle stack comprising a plurality of baffles that define an inner chamber coaxially aligned with a central axis of the baffle stack and a projectile pathway through the baffle stack along the central axis;

an outer housing around the baffle stack, the outer housing having an inner surface separated from and confronting the outer surface of the baffle stack, the inner surface of the outer housing and the outer surface of the baffle stack defining an outer chamber therebetween;

flow-directing structures in the outer chamber; and an end cap connected to a distal end of the outer housing, the end cap defining a central opening aligned with the central axis;

a flash hider in a distal end portion of the suppressor, the flash hider including the end cap and having (i) a flash hider proximal end portion defining a central entrance opening, (ii) an outer wall having an expanding shape extending from the flash hider proximal end portion to the end cap, the outer wall connected to the end cap and defining the central opening of the end cap, the outer wall further defining a plurality of ports, and (iii) an inner wall connected to the proximal end portion at the central entrance opening and having an expanding shape moving distally, the inner wall arranged coaxially within the outer wall;

wherein the flash hider defines a first flash hider volume within the inner wall and arranged to vent gases from the inner chamber, the flash hider further defining a second flash hider volume between the inner wall and the outer wall, the second flash hider volume arranged to directly or indirectly vent gases from the outer chamber, wherein the first flash hider volume is isolated from the second flash hider volume along an axial length of the flash hider, wherein the first flash hider volume is concentric with and located within the second flash hider volume, and wherein the second flash hider volume fluidly communicates with the outer chamber directly or indirectly via the plurality of ports.

24. The suppressor of claim 23 further comprising flow partitions extending radially between the outer wall and the inner wall.

* * * * *